US006288494B1

(12) United States Patent
Tsukamoto et al.

(10) Patent No.: US 6,288,494 B1
(45) Date of Patent: Sep. 11, 2001

(54) ELECTRON-EMITTING APPARATUS AND IMAGE-FORMING APPARATUS

(75) Inventors: Takeo Tsukamoto, Atsugi; Shigeki Matsutani, Sagamihara; Daisuke Sasaguri, Atsugi, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/513,842

(22) Filed: Feb. 25, 2000

(30) Foreign Application Priority Data

| | | |
|---|---|---|
| Feb. 26, 1999 | (JP) | 11-049614 |
| Feb. 26, 1999 | (JP) | 11-052012 |
| Feb. 26, 1999 | (JP) | 11-052043 |
| Feb. 18, 2000 | (JP) | 12-46829 |

(51) Int. Cl.[7] ..... G09G 3/10

(52) U.S. Cl. ..... 315/169.1; 345/74.1; 345/76; 313/306

(58) Field of Search ..... 315/169.1, 169.2, 315/169.3, 169.4; 313/306, 310, 484, 495; 345/74.1, 76, 45, 47

(56) References Cited

U.S. PATENT DOCUMENTS

| | | | |
|---|---|---|---|
| 4,904,895 | 2/1990 | Tsukamoto et al. | 313/336 |
| 5,066,883 | 11/1991 | Yoshioka et al. | 313/309 |
| 5,866,988 * | 2/1999 | Oda | 315/169.3 |

(List continued on next page.)

FOREIGN PATENT DOCUMENTS

| | | |
|---|---|---|
| 0 619 594 | 10/1994 | (EP) . |
| 0 716 439 | 6/1996 | (EP) . |
| 64-31332 | 2/1989 | (JP) . |

(List continued on next page.)

OTHER PUBLICATIONS

J. Dyke et al., "Field Emission", Advances in Electronics and Electron Physics, vol. VIII, 1956, pp. 89–185.
M.I. Elinson et al., "The Emission of Hot Electrons and The Field Emission of Electrons From Tin Oxide", Radio Engineering and Electronic Physics, Jul. 1965, pp. 1290–1296.
H. Araki, "Electroforming and Electron Emission of Carbon Thin Films", Journal of the Vacuum, Society of Japan, 1983, pp. 22–29 (with English Abstract on p. 22).

(List continued on next page.)

*Primary Examiner*—Haissa Philogene
*Assistant Examiner*—Thuy Vinh Tran
(74) *Attorney, Agent, or Firm*—Fitzpatrick, Cella, Harper & Scinto

(57) ABSTRACT

An electron-emitting apparatus according to the present invention comprises (A) a substrate, which has a first major surface and a second major surface that are positioned opposite each other, (B) an electron-emitting device, which includes a first electrode, to which a first voltage is applied, and a second electrode, to which a voltage Vf is applied, that are mounted, with an intervening interval, on the first major surface, (C) an anode electrode, which is located opposite and at a distance H from the first major surface, (D) first voltage application means, for applying to the second electrode the voltage Vf that is higher than the first voltage, and (E) second voltage application means, for applying to the anode electrode a voltage Va that is higher than the voltage Vf, wherein a space defined between the anode electrode and the electron-emitting device is maintained in a reduced-pressure condition, and wherein, when a value $Xs=H*Vf/(\pi*Va)$ is established for a plane that is substantially perpendicular to the first major surface, a width w of the second electrode, in a direction substantially parallel to the first major surface, equals or exceeds 0.5 times the value Xs and is smaller than or equals 15 times the value Xs.

38 Claims, 48 Drawing Sheets

U.S. PATENT DOCUMENTS

| | | | | |
|---|---|---|---|---|
| 5,872,541 | * | 2/1999 | Yoshioka et al. | 345/74.1 |
| 5,986,389 | | 11/1999 | Tsukamoto | 313/310 |
| 6,005,540 | * | 12/1999 | Shinjo et al. | 345/74.1 |
| 6,121,942 | * | 9/2000 | Sanou et al. | 345/75.1 |
| 6,144,350 | * | 11/2000 | Fujii et al. | 345/74.1 |
| 6,184,626 | * | 2/2001 | Oda | 315/169.1 |

FOREIGN PATENT DOCUMENTS

| | | |
|---|---|---|
| 1-257552 | 10/1989 | (JP) . |
| 1-283749 | 11/1989 | (JP) . |
| 1-311532 | 12/1989 | (JP) . |
| 1-311533 | 12/1989 | (JP) . |
| 1-311534 | 12/1989 | (JP) . |
| 3-20941 | 1/1991 | (JP) . |
| 7-6714 | 1/1995 | (JP) . |
| 7-235256 | 9/1995 | (JP) . |
| 9-63461 | 3/1997 | (JP) . |
| 9-82214 | 3/1997 | (JP) . |

OTHER PUBLICATIONS

G. Dittmer, "Electrical Conduction and Electron Emission of Discontinuous Thin Films", Thin Solid Films, 9, 1972, pp. 317–328.

M. Hartwell, "Strong Electron Emission From Patterned Tin–Indium Oxide Thin Films", IEDM, 1975, pp. 519–521.

C.A. Spindt, "Physical Properties of Thin–Film Emission Cathodes with Molybdenum Cones", J. Applied Physics, vol. 47, No. 12, Dec. 1976, pp. 5248–5263.

C.A. Mead, "Operation of Tunnel–Emission Devices", Journal of Applied Physics, Apr. 1961, pp. 646–652.

* cited by examiner

PRIOR ART

ELECTRON-EMITTING APPARATUS AND IMAGE-FORMING APPARATUS

BACKGROUND OF THE INVENTION

1. Field of the Invention

The present invention relates to an electron-emitting device having an innovative arrangement, and to an image-forming apparatus, such as an electron source apparatus or an image-displaying apparatus, that uses such an electron-emitting device.

2. Related Background Art

Conventionally, roughly there are two types of well known electron-emitting devices: one is a thermionic cathode, and the other is a cold-cathode. A field emission type (hereinafter referred to as an "FE"), a metal/insulator-metal type (hereinafter referred to as an MIM), and a surface conduction electron-emitting type are classified into the cold cathode.

A well known FE example is disclosed in "Field Emission", W. P. Dyke and W. W. Dolan, Advances in Electron Physics, 8.89 (1956), or in "Physical Properties of Thin-film Field Emission Cathodes With Molybdenum Cones", C. A. Spindt, J. Applied Physics, 47, 5248 (1976).

Additional, current discussions are: "Fluctuation-free Electron Emission From Non-formed Metal-insulator-metal (MIM) Cathodes Fabricated By Low Current Anodic Oxidation", Toshiaki Kusunoki, Jpn., J. Applied Physics, vol. 32 (1993), pp. L1695; and "An MIM-Cathode Array For Cathode Luminescent Displays", Mutsumi Suzuki, et al., IDW '96, (1996), pp. 529.

An example surface conduction type is disclosed in a report by M. I. Elinson in Radio Engineering Electron Physics, 10 (1965). The surface conduction electron-emitting device employs a phenomenon whereby an electron emission occurs when a current is supplied in parallel to the surface of a thin film that is formed on a small area of a substrate. The surface conduction electron-emitting devices are devices that use an $SnO_2$ thin film (described in the Elinson report), a device that employs an Au thin film (reported by G. Dittmer, Thin Solid Films, 9, 317 (1972), and a device that employs an $In_2O_3/SnO_2$ thin film (reported by M. Hartwell and C. G. Fonstad, IEEE Trans. ED Conf., 519 (1983)).

A plane type electron-emitting device shown in FIGS. 50A and 50B and a step type electron-emitting device shown in FIG. 52 are other surface conduction type devices proposed by the present inventor.

In FIGS. 50A and 50B, schematic diagrams illustrate a conventional surface conduction electron-emitting device. In FIG. 50A, a specific top plan view of an electron-emitting device is shown, and in FIG. 50B, a specific transverse cross-sectional view of the device is shown. In the views shown, a high-potential side electrode 1002 and a low-potential side electrode 1003, which together constitute the electron-emitting device, are mounted on a substrate 1001 and are connected to a power source (not shown). The high-potential side electrode 1002 is connected to an electroconductive thin film 1004, while the low-potential side electrode 1003 is connected to an electroconductive thin film 1005. The thicknesses of the electrodes 1002 and 1003 are several tens of nm to several $\mu$m, and the thicknesses of the films 1004 and 1005 are 1 to several tens of [nm]. A gap 1006 is defined that substantially electrically discontinues the thin films 1004 and 1005.

For these conventional surface condition electron-emitting devices, generally, before electron emission, an electron-emitting region is formed by performing a so-called "energization-forming" process for electroconductive thin film. That is, in the "energization forming" process, a direct-current voltage, or a very gradual boosting voltage, i.e., a voltage of 1 V, is applied at both ends of an electroconductive thin film to locally destroy, deform or degenerate the electroconductive thin film, so as to form an electron-emitting region wherein the electrical resistance is high.

Furthermore, when a process is performed called activation, during which, for energization, an organic gas is introduced into a vacuum, a carbon film is deposited at the distal ends of the electroconductive thin films facing each other across the gap between them, so as to form an electron-emitting region having an improved electron emission characteristic. When a voltage is applied to the electroconductive thin films and a current is supplied to the surface conduction electron-emitting device that is provided by the energization forming operation and the activation operation, electrons are emitted from the electron-emitting region.

Recently, a flat type display apparatus has become popular for which a liquid crystal, instead of a CRT, is used as an image-forming apparatus, such as a display device. However, since this display apparatus is not an emissive type, it must include a backlight, and as result, a demand exists for an emissive display apparatus. An emissive type display apparatus is, for example, an image forming apparatus that comprises: an electron source, wherein multiple surface conduction electron-emitting devices are arranged; and a phosphor, which emits visible light using electrons output by the electron source (e.g., U.S. Pat. No. 5,066,883). An example electron source wherein multiple surface conduction electron-emitting devices are arranged is one having multiple surface conduction electron-emitting devices that are arranged in parallel as multiple arrays (ladder-shaped arrays), and wherein both ends (both device electrodes) of each electron-emitting device are connected by wiring (common wiring) (e.g., Japanese Patent Application Laid-Open Nos. 64-31332, 1-283749 and 1-257552).

SUMMARY OF THE INVENTION

An electron-emitting apparatus according to the present invention comprises:

- a substrate, which has a first major surface and a second major surface that are positioned opposite each other;
- an electron-emitting device, which comprises a first electrode, to which a first voltage is applied, and a second electrode, to which a voltage Vf is applied, that are mounted, with an interval, on the first major surface;
- an anode electrode, which is located opposite and at a distance H from the first major surface;
- first voltage application means, for applying to the second electrode the voltage Vf that is higher than the first voltage; and
- second voltage application means, for applying to the anode electrode a voltage Va that is higher than the voltage Vf,
- wherein a space defined between the anode electrode and the electron-emitting device is maintained in a reduced-pressure condition, and
- wherein, when a value $Xs=H*Vf/(\pi*Va)$ is established for a plane that is substantially perpendicular to the first major surface, a width w of the second electrode, in a direction substantially parallel to the first major surface, equals or exceeds 0.5 times the value Xs and is smaller than or equals 15 times the value Xs.

An image-forming apparatus according to the present invention comprises:

a substrate having a first major surface and a second major surface that are positioned opposite each other;

an electron-emitting device, which includes a first electrode, to which a first voltage is applied, and a second electrode, to which a voltage Vf is applied, that are mounted, with an interval, on the first major surface;

a second substrate, on which an anode electrode, which is located opposite and at a distance H from the first major surface, and an image-forming member are mounted;

first voltage application means, for applying to the second electrode the voltage Vf that is higher than the first voltage; and second voltage application means, for applying to the anode electrode a voltage Va that is higher than the voltage Vf, wherein a space defined between the anode electrode and the electron-emitting device is maintained in a reduced-pressure condition, and wherein, when a value $Xs=H*Vf/(\pi*Va)$ is established for a plane that is substantially perpendicular to the first major surface, a width w of the second electrode in a direction substantially parallel to the first major surface equals or exceeds 0.5 times the value Xs and is smaller than or equals 15 times the value Xs.

For the electron-emitting apparatus and the image-forming apparatus of the present invention, the first electrode is located outside both ends of the second electrode, which is defined by the width w.

For the electron-emitting apparatus and the image-forming apparatus of the present invention, an electroconductive film is located between the first and the second electrodes, and a gap is formed in a part of the electroconductive film.

For the electron-emitting apparatus and the image-forming apparatus of the present invention, a first electroconductive film and a second electroconductive film are formed between the first and the second electrodes. The first electroconductive film is connected to the first electrode, while the second electroconductive film is connected to the second electrode, and the first and the second electroconductive films are positioned opposite each other on opposite sides of an intervening gap.

For the electron-emitting apparatus and the image-forming apparatus of the present invention, the second electrode is positioned nearer the anode electrode than is the first electrode.

For the electron-emitting apparatus and the image-forming apparatus of the present invention, the second electrode is on the first electrode via an insulating layer.

For the electron-emitting apparatus and the image-forming apparatus of the present invention, the first electrode is positioned nearer the anode electrode than the second electrode.

For the electron-emitting apparatus and the image-forming apparatus of the present invention, the first electrode is on the second electrode via an insulating layer.

For the electron-emitting apparatus and the image-forming apparatus of the present invention, an opening is formed in the first electrode and the insulating layer, and the second electrode is exposed through the opening.

For the electron-emitting apparatus and the image-forming apparatus of the present invention, the first electrode comprises a pair of electrodes, which are positioned on the second electrode, via an insulating layer, at an interval so that the second electrode is exposed.

For the electron-emitting apparatus and the image-forming apparatus of the present invention, the second electrode and the first electrode are arranged on a same plane that is substantially parallel to the first major surface.

For the electron-emitting apparatus and the image-forming apparatus of the present invention, the first electrode comprises a pair of electrodes, and the second electrode is located between the pair of electrodes.

For the electron-emitting apparatus and the image-forming apparatus of the present invention, of circles that are circumscribed on the external surface circumference of the second electrode, on the plane that is substantially parallel to the first major surface, the smallest circle has a diameter Wmax that equals or is smaller than 15 times the value Xs.

For the electron-emitting apparatus and the image-forming apparatus of the present invention, the diameter Wmax equals or exceeds 0.5 times the value Xs.

For the electron-emitting apparatus and the image-forming apparatus of the present invention, of circles inscribed on the external surface circumference of the second electrode, on the plane that is substantially parallel to the first major surface, the largest circle has a diameter Wmin that equals or exceeds 0.5 times the value Xs.

For the electron-emitting apparatus and the image-forming apparatus of the present invention, the diameter Wmin equals or is smaller than 15 times the value Xs.

For the electron-emitting apparatus and the image-forming apparatus of the present invention, of circles circumscribed on the external surface circumference of the second electrode, on the plane that is substantially parallel to the first major surface, the largest circle has a diameter Wmin that equals or exceeds 0.5 times the value Xs and that is smaller than or equals 15 times the value Xs; and of circles inscribed on the external surface circumference of the second electrode, on the plane that is substantially parallel to the first major surface, the smallest circle has a diameter Wmax that equals or exceeds 0.5 times the value Xs and that is smaller than or equals 15 times the value Xs.

For the electron-emitting apparatus and the image-forming apparatus of the present invention, a plurality of the electron-emitting devices are arranged on the first major surface.

Further, an electron-emitting apparatus according to the present invention comprises:

a substrate, which has a first major surface and a second major surface that are positioned opposite each other;

an electron-emitting device, which comprises a first electrode, to which a first voltage is applied, and a second electrode, to which a voltage Vf is applied, that are mounted, with an interval, on the first major surface;

an anode electrode that is located opposite and at a distance H from the first major surface;

first voltage application means, for applying to the second electrode the voltage Vf that is higher than the first voltage; and second voltage application means, for applying to the anode electrode a voltage Va that is higher than the voltage Vf, wherein, when viewed from the anode electrode, the second electrode is sandwiched between the first electrode pair, and wherein, when a value $Xs=H*Vf/(\pi*Va)$ is established for a plane that is substantially perpendicular to the first major surface, a width w of the second electrode sandwiched between the first electrode pair equals or exceeds 0.5 times the value Xs and equals or is smaller than 15 times the value Xs.

Furthermore, an image-forming apparatus according to the present invention comprises:

a substrate having a first major surface and a second major surface that are positioned opposite each other;

an electron-emitting device, which comprises a first electrode, to which a first voltage is applied, and a second electrode, to which a voltage Vf is applied, that are mounted, with an intervening interval, on the first major surface;

a second substrate, on which an anode electrode, which is located opposite and at a distance H from the first major surface, and an image-forming member are mounted;

first voltage application means, for applying to the second electrode the voltage Vf that is higher than the first voltage; and second voltage application means, for applying to the anode electrode a voltage Va that is higher than the voltage Vf, wherein, when viewed from the anode electrode, the second electrode is sandwiched between the first electrode pair, and wherein, when a value $Xs=H*Vf/(\pi*Va)$ is established for a plane that is substantially perpendicular to the first major surface, a width w of the second electrode sandwiched between the first electrode pair equals or exceeds 0.5 times the value Xs and equals or is smaller than 15 times the value Xs.

DETAILED DESCRIPTION OF THE PREFERRED EMBODIMENTS

Figure 53:
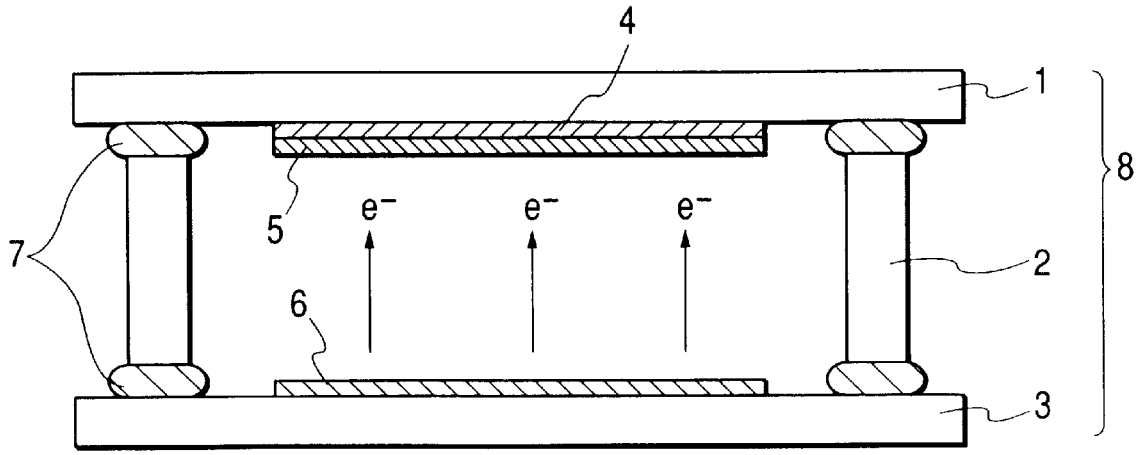
FIG. 53 is a specific cross-sectional view of an image forming apparatus that employs an electron-emitting device.

A display apparatus, a flat type that employs the above described surface conduction electron-emitting device, has the specific arrangement shown in FIG. 53. In FIG. 53, the display apparatus comprises a face plate 1, an external frame 2, a rear plate 3, a phosphor layer 4, an anode 5, an electron source 6 constituted by a plurality of electron-emitting devices, and a bonding member 7. The face plate 1, the external frame 2 and the rear plate 3 constitute an airtight container, and a reduced pressure condition is internally maintained.

It is known that the size of an electron beam spot that is emitted by a surface conduction electron-emitting device and is formed on an anode (positive electrode) is determined by values Va and Vf and a distance H between the device and the anode (SID 98 Digest, Okuda, et al.). The size of a beam spot emitted by a conventional electron source is approximately a submillimeter, and as an image-forming apparatus, a conventional image display apparatus has a satisfactory resolution.

Recently, however, higher resolutions have been demanded for image display apparatuses.

Therefore, in accordance with the subject of the present invention, a high resolution beam is obtained by controlling the trajectory of an electron, and the control of the trajectory of an electron is enhanced so as to avoid any reduction in the efficiency that is thus provided.

To obtain a suitable size for a high resolution beam spot, conventional methods are available for producing an electron-emitting device of a field emission type: as disclosed in Japanese Patent Application Laid-Open No. 7-6714, an electrode for the convergence of electrons is located above an electron-emitting region, and is employed to focus electron trajectories; and as is described in Japanese Patent Application Laid-Open No. 9-63461, a focusing electrode is arranged on the same plane as an electron-emitting region. However, in these cases the fabrication methods are complicated, the areas of devices are increased, and the efficiency with which electrons are emitted, which will be described later, is deteriorated.

For an electron-emitting apparatus that employs a general surface conduction electron-emitting device, a device wherein facing electrodes are asymmetrically formed is disclosed in Japanese Patent Application Laid-Open Nos. 1-311532, 1-311533 and 1-311534.

Further, for a surface conduction electron-emitting device, a reduction in the size of an electron-emitting region is proposed in Japanese Patent Application Laid-Open No. 3-20941, and an increase in efficiency is proposed in Japanese Patent Application Laid-Open No. 9-82214. However, neither of these proposals is satisfactory for the implementation of a high resolution, image-forming apparatus. An arrangement similar to the present invention is disclosed in Japanese Patent Application Laid-Open No. 7-235256; however, the objective of this publication is the provision of a simple arrangement for an electron-emitting device.

The present invention is provided to resolve the above described conventional shortcomings: one objective of the present invention being the provision of an electron-emitting apparatus and an image-forming apparatus that ensures both improved electron emission efficiency and improved electron trajectory focusing.

The best modes of an electron-emitting device according to the present invention will now be described.

Before an explanation is given for the primary objectives of the invention, the convergence operation and the efficiency improvement processing, a conventional surface conduction electron-emitting device will be described.

Figure 50A:
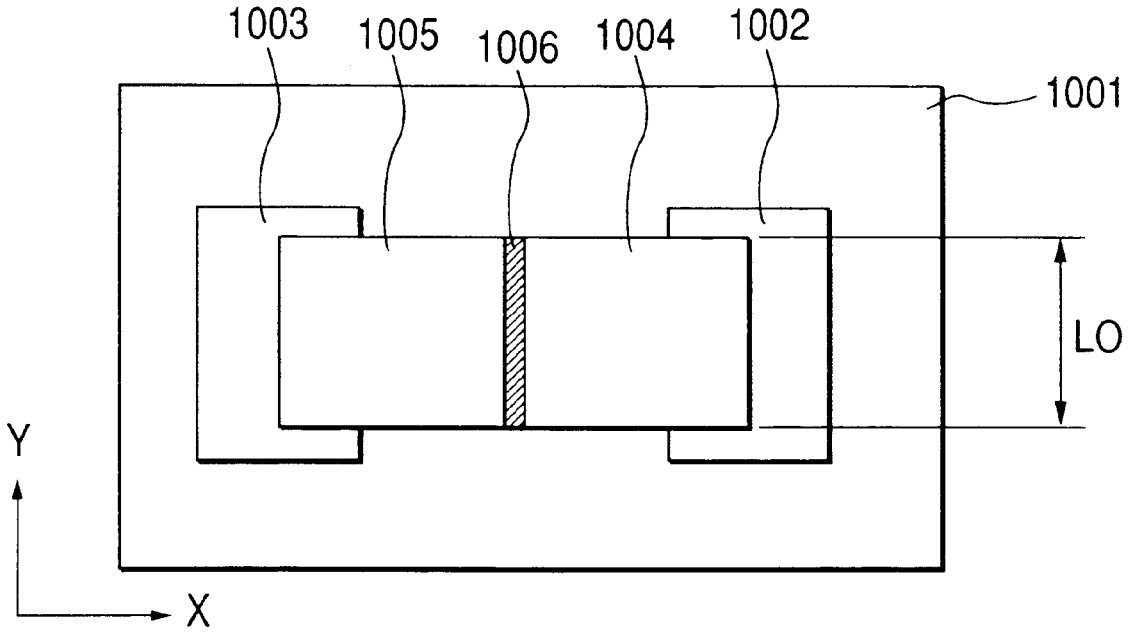
FIG. 50A PRIOR ART
FIGS. 50A and 50B are diagrams showing a conventional plane type surface conduction electron-emitting device.
Figure 50B:
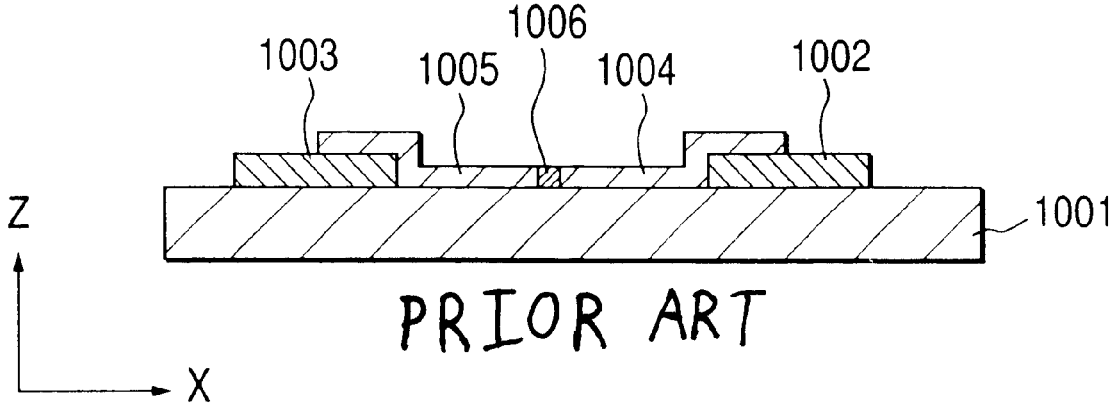
Figure 51:
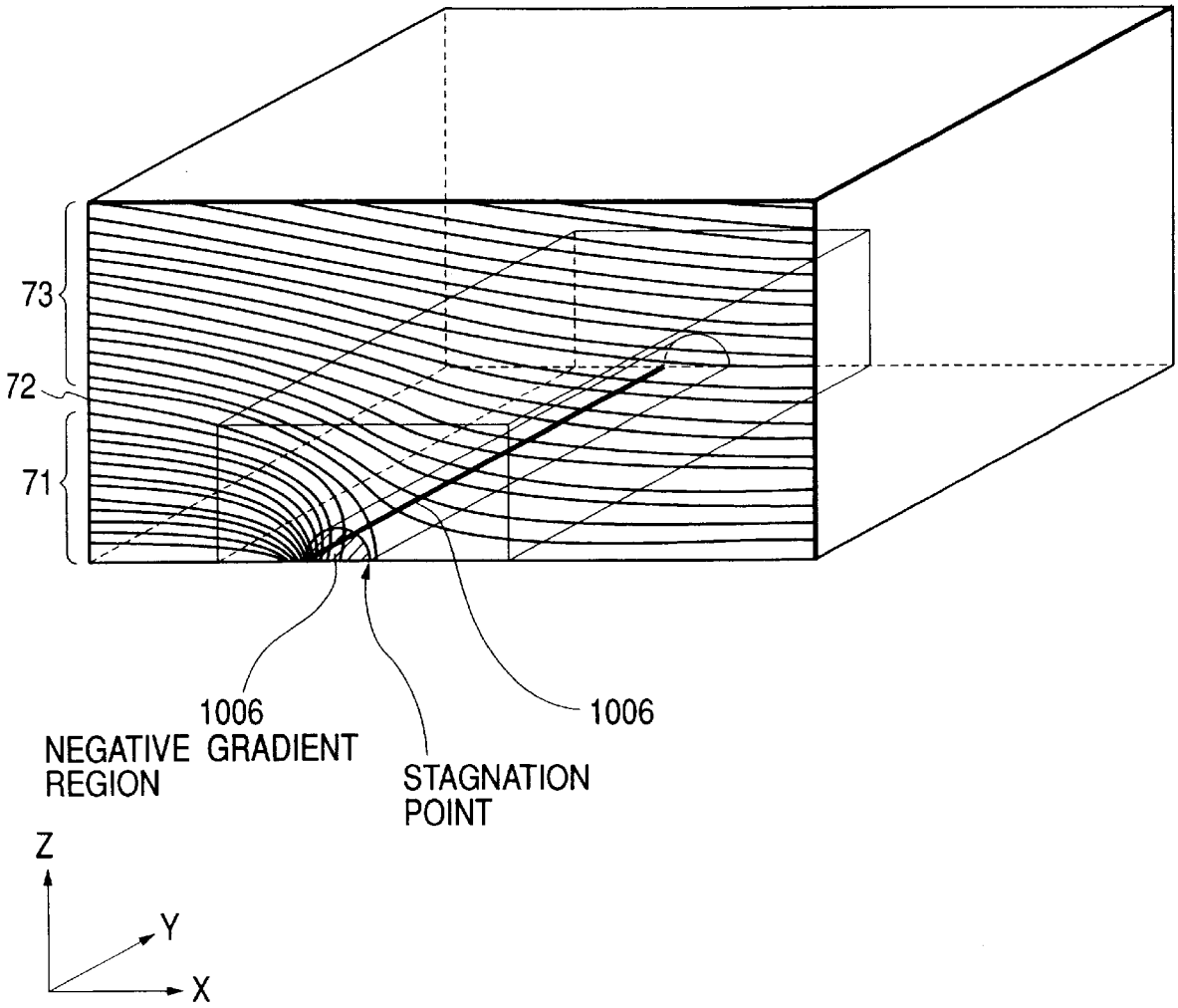
FIG. 51 is a diagram showing the equipotential surface of a plane type conventional surface conduction electron-emitting device.

FIGS. 50A and 50B are diagrams showing a conventional surface conduction electron-emitting device, a plane type, and FIG. 51 is a diagram showing the equipotential surface of the device. In FIGS. 50 and 51, the surface conduction electron-emitting device comprises: a substrate 1001; a high-potential side electrode 1002 that constitutes the device; a low-potential side electrode 1003 that constitutes the device; and electroconductive thin films 1004 and 1005. The electroconductive thin film 1004 is electrically connected to the high-potential side electrode 1002 that constitutes the device, and the electroconductive thin film 1005 is electrically connected to the low-potential side electrode 1003 that constitutes the device. A gap 1006 is defined to electrically discontinue the thin films 1004 and 1005.

In the following explanation, the "high-potential side electrode that constitutes the device" is called a "high-potential side electrode", and the "low-potential side electrode that constitutes the device" is called a "low-potential side electrode". The high-potential side electrode may include the electroconductive thin film that is connected to the high-potential electrode, and similarly, the low-potential side electrode may include the electroconductive thin film that is connected to the low-potential electrode.

In FIG. 51 is shown the equipotential line on plane xz around the gap 6 when a high voltage is applied to an anode electrode (not shown) in the upper portion of the device.

Disclosed in SID 98 Digest, Okuda. et al., is an arrangement whereby a positive electrode (anode) is formed at a distance H from the electron-emitting device, and whereby a voltage Vf is applied between a high-potential side electrode and a low-potential side electrode, while a voltage Va is applied between the low-potential side electrode and the positive electrode (anode). According to this arrangement, a gap on an order of nm is defined in the device, and when the voltage Vf is applied, an electron is tunneled from the distal end of the low-potential side electrode to the opposite high-potential side electrode, and electrons at the distal end of the high-potential side electrode are isotopically scattered.

Elastic scattering is repeated several times for most of the electrons that are scattering at the high-potential side electrode, while electrons whose path distances exceed a characteristic distance Xs arrived at the positive electrode (anode). The characteristic distance Xs is also called a stagnation point.

The following equation is established:

$$Xs=H^*Vf/(\pi^*Va) \quad (1).$$

For example, when Va=10 [KV], Vf=15 [V] and H=2 [mm], Xs is approximately 1 $\mu$m.

The efficiency of the process is affected by a reduction in the number of electrons, the result of the absorption, induced by multiple scattering, of part of the electrons by the high-potential side electrode before the paths of the electrons have exceeded the distance Xs. While the scattering rate $\beta$ for electrons that are diffracted at several tens of eVs is not clear, it has been estimated that the values 0.1 to 0.5 are reasonable for a single incident.

It is apparent that when a scattering mechanism is employed that has a scattering rate $\beta$ of 1 or smaller, the number of electrons is reduced in accordance with the power series as the scattering times are increased.

Thereafter, the electrons whose paths exceeded the distance Xs, are arrived at the positive electrode (anode) along trajectories that are traveled in the electric field by the positive electrode and the device.

Further, as in the SID 98 Digest, Okuda, et al., it is known that the size of a beam spot emitted by a conventional plane type electron-emitting device can be represented by $$Lh \cong 4Kh\sqrt{(Vf/Va)}+L0 \quad (2a)$$

$$Lw \cong 2Kw\sqrt{(Vf/Va)} \quad (2b),$$

where Lh denotes the size of the beam spot in the vertical direction (direction y), while Lw denotes the size of the beam spot in the horizontal direction (direction x). Further, L0 denotes the length of an electron-emitting region (gap 1006) in direction y, and Kh and Kw can be approximately 1, even though they differ slightly, depending on the device structure.

The conventional plane type surface condition electron-emitting device has been explained, but there is another conventional electron-emitting device, a step type.

Figure 52:
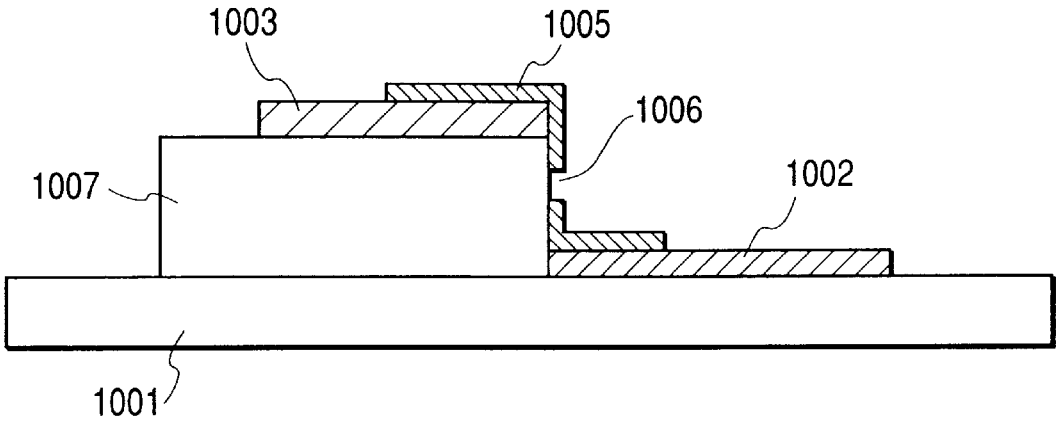
FIG. 52 is a diagram showing a conventional step type surface conduction electron-emitting device.

FIG. 52 is a diagram showing an example step type electron-emitting device. To denote corresponding members, the same reference numerals are used in FIG. 52 as are used in FIGS. 50A and 50B. In the step type device, electrodes 1002 and 1003 are positioned opposite each other via a step formation member 1007.

With this arrangement, while the electron emission mechanism is the same as the one provided for the plane type, the electric field differs and the step type is assumed to have a different characteristic.

While taking into account the drive condition of a focusing function, proposed by the present invention is an arrangement that incorporates the focusing function so that an electron that is emitted will reach the positive electrode, even though its trajectory is affected and changed by the electric field that reflects the locations and the potentials of the electrodes.

Furthermore, the present invention has been thoroughly discussed so that the arrangement of the electron-emitting device has been improved, the times at which electrons scatter (or drop) to the high-potential side electrode are reduced, and the electron emission efficiency has been improved.

First, second and third modes of the present invention will now be described in order.

The first and the second modes employ an arrangement whereby a high-potential side electrode, having a width W, is positioned in the middle of a low-potential side electrode in the direction X. The first mode is an arrangement whereby a gap 6 is provided on both sides of the high-potential side electrode, and the second mode is an arrangement whereby a gap 6 is provided on only one side of the high-potential side electrode.

The third mode is an arrangement wherein the high-potential side electrode is enclosed by a low-potential side electrode in the directions X and Y, and has a maximum width Wmax and a minimum width Wmin.

(First Mode)

Figure 1A:
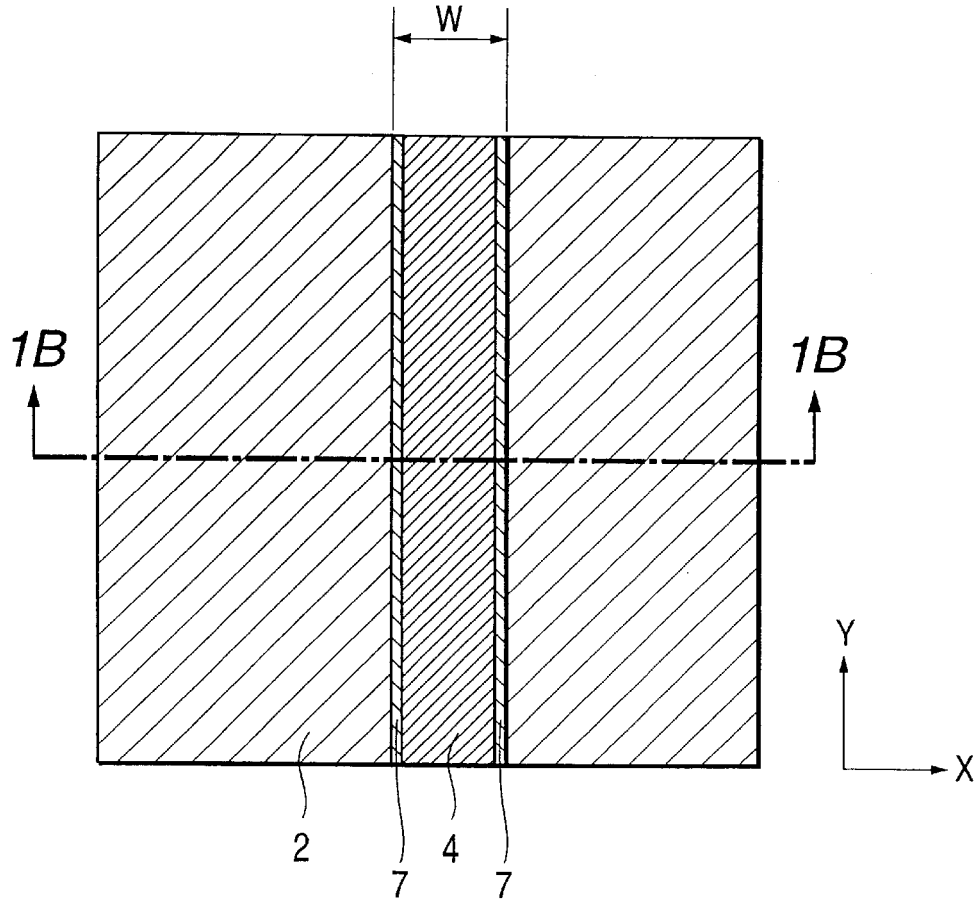
FIGS. 1A and 1B are diagrams illustrating a basic electron-emitting device according to a first mode of the present invention.
Figure 1B:
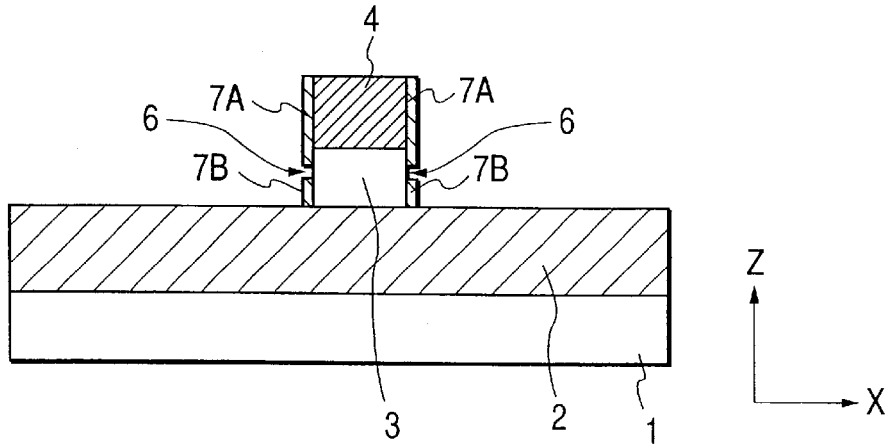

FIG. 1A is a top view (viewed from an anode) of an electron-emitting device according to a first mode of the present invention, and FIG. 1B is a cross-sectional view taken along line 1B—1B in FIG. 1A. In FIGS. 1A and 1B, the electron-emitting device comprises: a low-potential side electrode 2; an insulating layer 3; a high-potential side electrode 4; a gap 6; an electroconductive film 7A that is electrically connected to the high-potential side electrode 4; and an electroconductive film 7B that is electrically connected to the low-potential side electrode 2.

Figure 2:
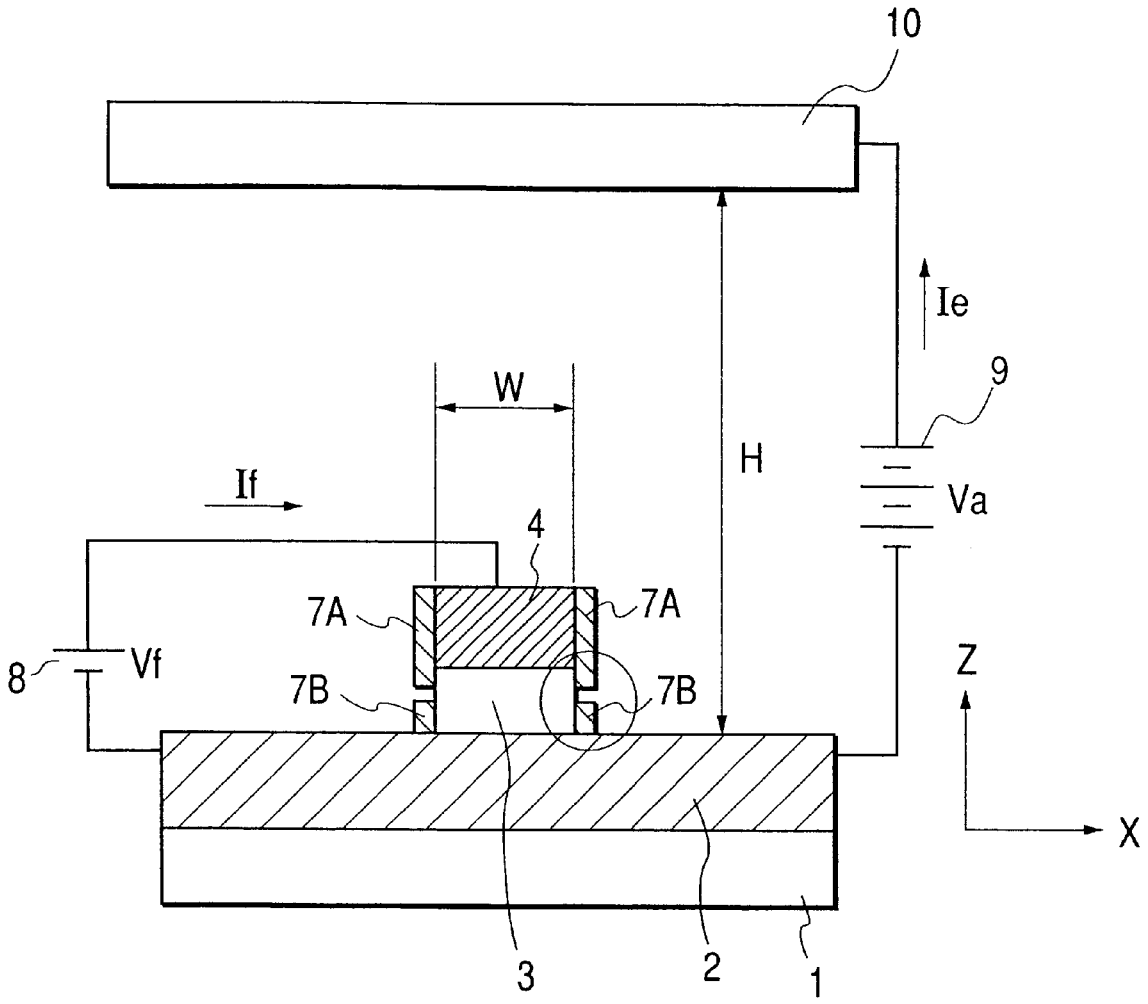
FIG. 2 is a cross-sectional view and a diagram of the electron-emitting device and an anode according to the first mode of the present invention.

FIG. 2 is a diagram showing the state, according to the first mode of the invention, wherein a voltage is applied to the electron-emitting device. A power source 8 is used to apply a voltage to the high-potential side electrode 4 and the low-potential side electrode 2, and a power source 9 is used to apply a voltage to a positive electrode (anode) 10. Vf denotes the voltage that is applied between the high-potential side electrode 4 and the low-potential side electrode 2; If denotes a device current that, upon the application of the voltage Vf, flows across the low-potential side electrode 2 and the high-potential side electrode 4; Va denotes the voltage that is applied between the low-potential side electrode 2 and the positive electrode (anode) 10; and Ie denotes an emission current that is acquired by the positive electrode (anode) 10. It should be noted that efficiency ($\eta$) is an emission current/device current (=Ie/If).

Figure 3A:
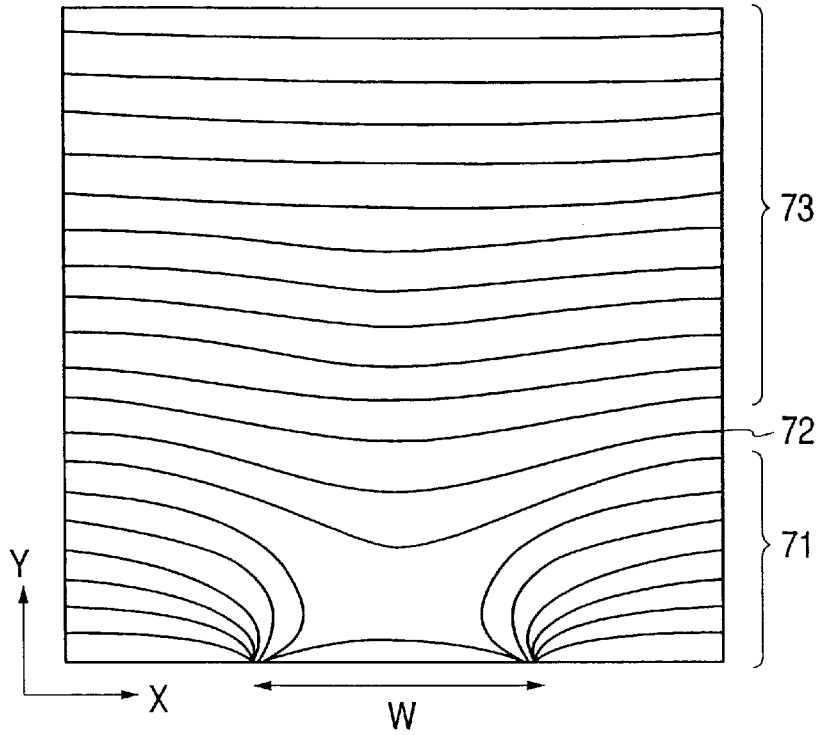
FIGS. 3A and 3B are diagrams showing an equipotential line formed in a cross section of the electron-emitting device of the present invention.
Figure 3B:
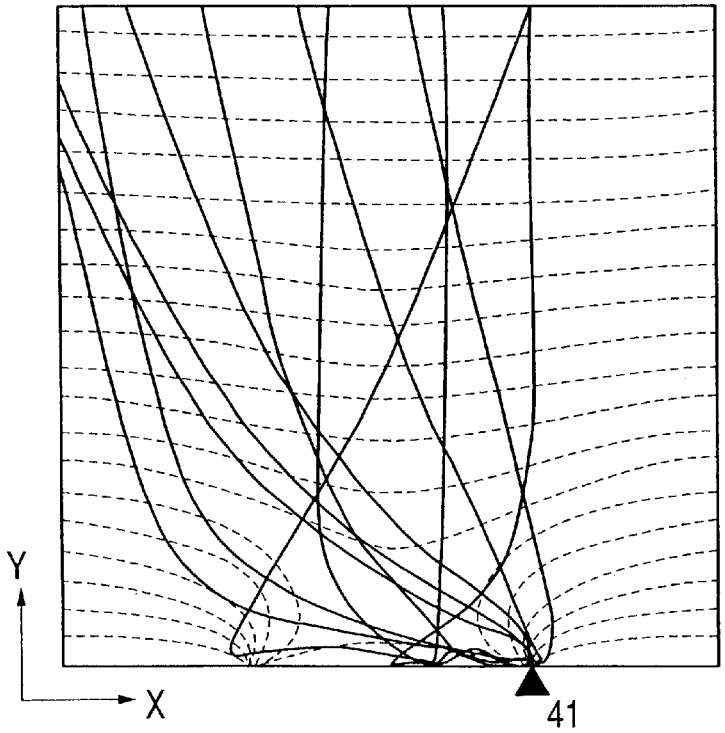

FIGS. 3A and 3B are diagrams showing a electric field when a 15 V voltage Vf is applied to the above described arrangement, and showing the trajectories of emitted electrons that are calculated in accordance with the electric field (for convenience sake, in the diagram electrons are emitted at only one emission point 41). In FIG. 3A is shown the electric field when the 15 V voltage Vf is applied. In FIG. 3B, a solid line is used to describe the trajectories of electrons when they are emitted upon the application of the 15 V voltage Vf, and broken lines are used to indicate the equipotential line. In FIGS. 3A and 3B are shown the macro electric field and the macro trajectories of emitted electrons when the apparatus in FIG. 2 is driven. That is, since the thicknesses of the insulating layer 3 and the high-potential side electrode 4 are so small, compared with the distance between the anode 10 and the substrate 1, that they can be ignored, the point 41 that corresponds to one part of the gap 6 of the device is located along the axis X.

For the electron-emitting devices according to the first, the second and the third modes of the invention, strictly speaking, the distance H between the device and the anode is the distance between the surface of the low-potential side electrode (e.g., the electrode 2 in FIGS. 1A and 1B) and the anode. However, since the thickness of the device of this invention is much smaller than the interval between the anode and the device, and can therefore be ignored, no substantial problem occurs when the distance H is defined as the distance between the anode and the first major surface of the substrate.

In FIGS. 3A and 3B, the lower portion represents the side of the high-potential side electrode that has the width W, while the upper portion represents the side of the positive electrode (anode). An equipotential line 71 has a lower potential than has the high-potential side electrode; an equipotential line 72 has the same potential as the high-potential side electrode; and an equipotential line 73 has a higher potential than has the high-potential side electrode.

For the electron-emitting devices according to the first, the second and the third modes of the invention, a "high-potential side electrode that constitutes the device" is called a "high-potential side electrode", and a "low-potential side electrode that constitutes the device" is called a "low-potential side electrode". The "high-potential side electrode" may include the electroconductive thin film (e.g., the film 7A in FIG. 1B) that is connected to the "high-potential side electrode that constitutes the device" (e.g., the electrode 4 in FIGS. 1A and 1B). Similarly, the "low-potential side electrode" may include the electroconductive thin film (e.g., the film 7B in FIG. 1B) that is connected to the "low-potential side electrode that constitutes the device" (e.g., the electrode 2 in FIGS. 1A and 1B).

For the devices in the first, the second and the third modes of the invention, the width W of the high-potential side electrode is obtained by referring to the cross-section of the device on the plane that is substantially perpendicular to the first major surface of the substrate on which the device is mounted. And the width W corresponds to the width of the "high-potential side electrode" in the direction substantially parallel to the first major surface. The "width of the high-potential side electrode" in this case may be the width of the electrode itself (the electrode 4 in FIGS. 1A and 1B) to which a high potential is applied, and may be the sum of the width of the electrode (the electrode 4 in FIGS. 1A and 1B) to which a high potential is applied and the thickness (length) of the electroconductive film (e.g., the film 7A in FIG. 1B) that is connected to the high-potential side electrode (the electrode 4 in FIGS. 1A and 1B). Since the thickness (length) of the electroconductive film is so small that substantially it can be ignored, no problem occurs even when the "width W of the high-potential side electrode" is approximately the width of the electrode (the electrode 4 in FIGS. 1A and 1B) to which a high potential is applied.

As is apparent from the drawings, the equipotential line 71, which has a (negative) potential that is lower than that of the high-potential side electrode, is present above and around the high-potential side electrode. Since the low (negative) equipotential line 71 is present, electrons are affected by the low (negative) potential that is formed above the high-potential side electrode, and their trajectories are deflected, curved. Thus, the region on the positive electrode (anode) 10 at which electrons can arrived is limited.

The circumstances under which the size of a beam spot of electrons that is projected onto the positive electrode 10 is reduced by the deflection of its trajectory can be ascertained by calculating the numerical value of electric field while using the voltages Vf and Va and the distance H as parameters.

Figure 4:
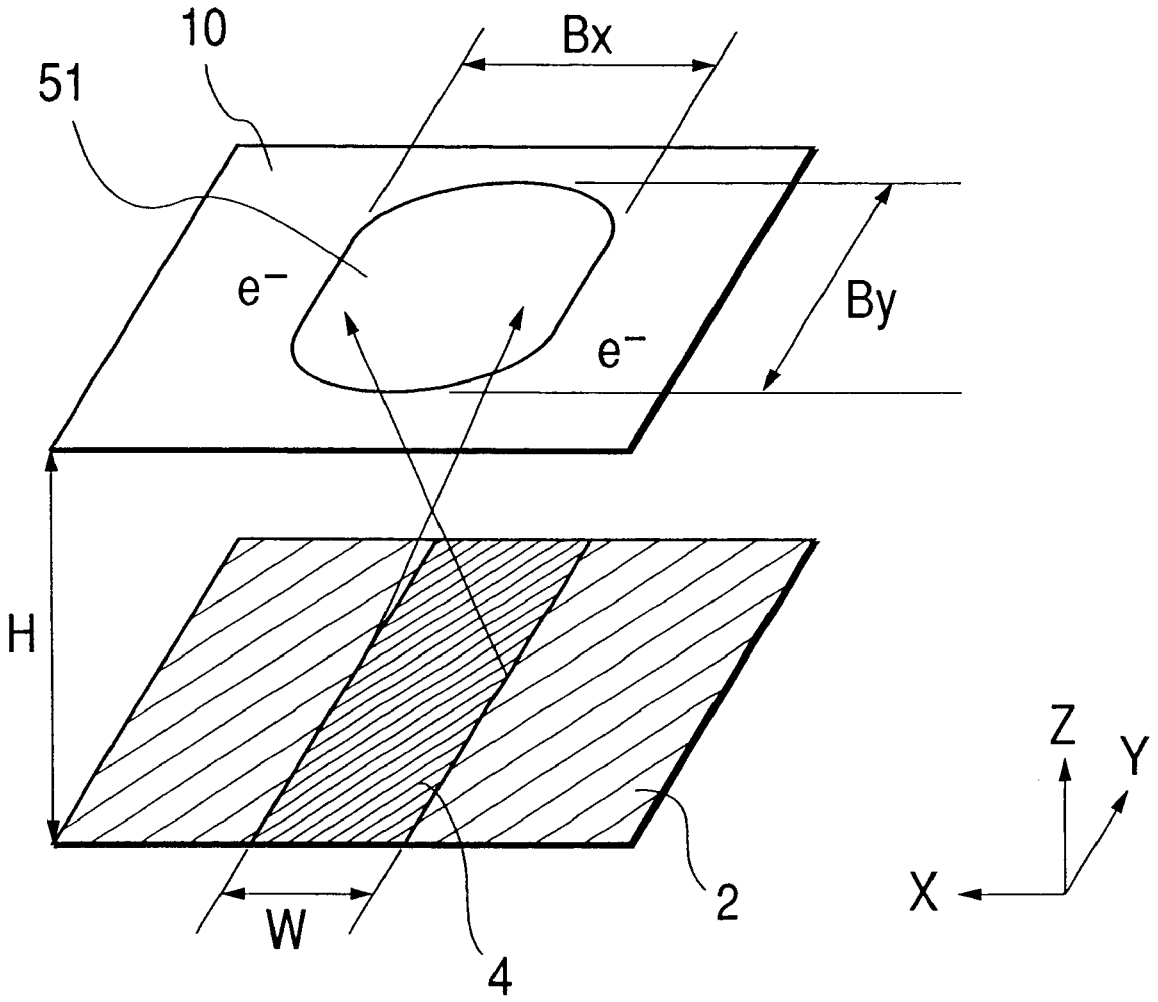
FIG. 4 is a diagram showing the relationship between the basic electron-emitting device of the present invention and the diameter of its beam spot.

In FIG. 4 is shown a beam spot 51 that is formed when electrons, from an electron-emitting device according to the first mode of the invention, are irradiated onto a phosphor located at a distance H from the electron-emitting device, which is positioned as is shown in FIG. 2.

In the present invention, Bx denotes the size in direction X of a beam spot 51 that is formed on the anode (phosphor) by an electron beam emitted by the electron-emitting device; and By denotes the size of the beam spot 51 in direction Y. The beam spot 51 is defined as the outer circumference when the luminance is 1/10 the peak luminance of the phosphor.

According to the electron-emitting device of the first mode of the present invention, beam convergence is accompanied by a large change in the beam size Bx in direction X, but by less change in the beam size By in direction Y.

This occurs because the electron-emitting device is linearly shaped in direction Y, and therefore, the electric field that causes the trajectories of electrons to be deflected is formed in direction X, while such a electric field is not formed in direction Y, and the same electric field is formed for all the cross-sections of the device.

Figure 5:
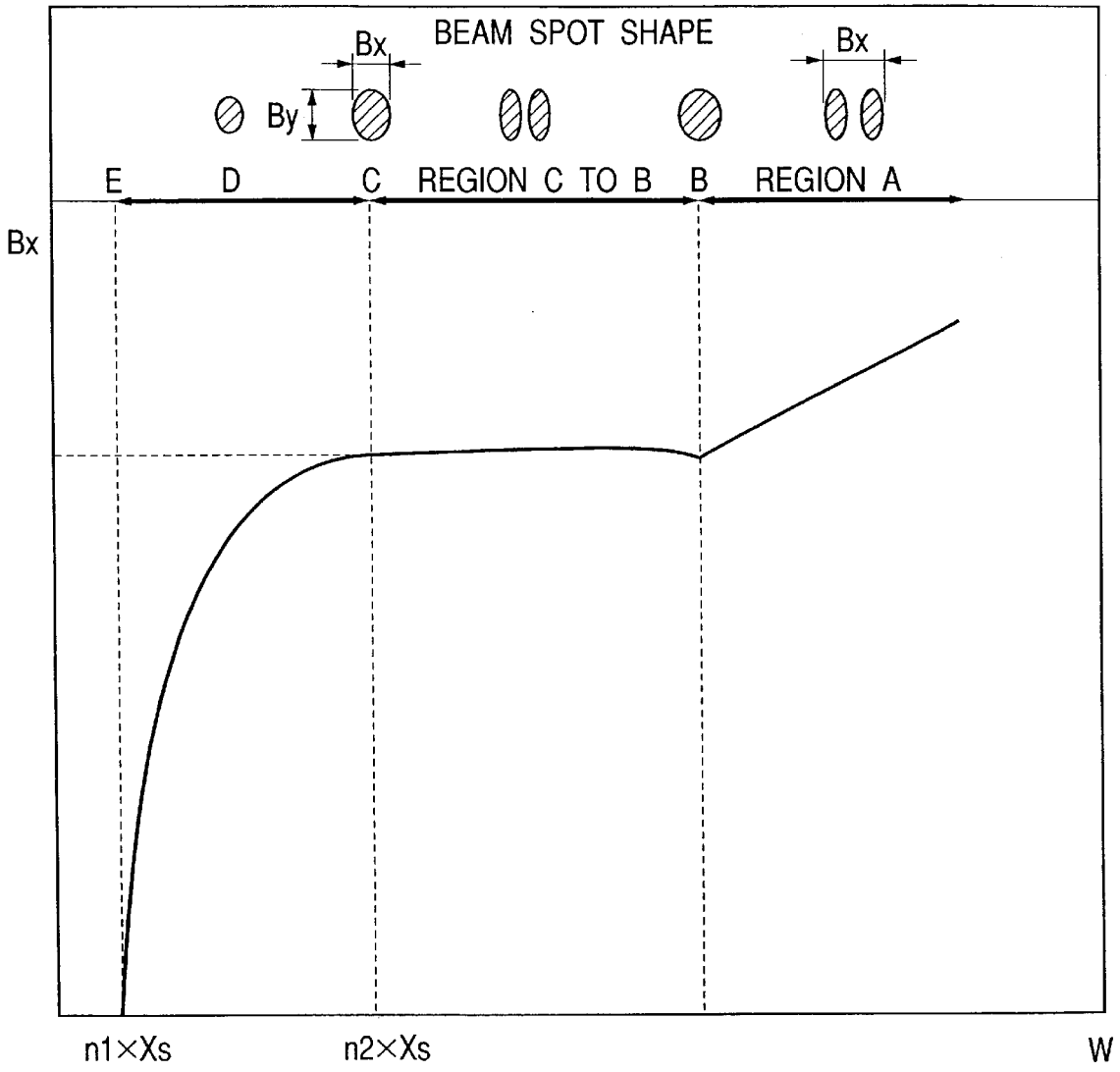
FIG. 5 is a diagram showing the relationship between the width w of a high-potential side electrode, and a beam spot diameter.

FIG. 5 is a graph showing a change in the beam spot shape when the width W of the high-potential side electrode is altered. As is shown in FIG. 5, when the width W of the high-potential side electrode is greatly enlarged, electrons are emitted from two places at the distance H. This fact is reflected in the beam shape, and as is indicated for region A, two beam spot shapes are observed.

When the width W is reduced, there is a point (point B) at which the two beam spots converge, so they are focused on one spot and can not be separated.

When the width W is further reduced, the size of the beam may again be extended. This is because the trajectories of electrons that are emitted from two emission regions intersect each other.

When the width W is reduced even more, after passing a point C, in the direction X, the size Bx of the beam spot becomes extremely small.

When the point whereat the beam size is extremely small is defined as n2, the value of n2 is estimated to be approximately 15 times that of the value Xs.

As the reduction in the width W of the high-potential side electrode is continued, a point (point E) is reached whereat no beam at all can be observed. It is assumed that the equipotential line 71, which has a (negative) potential lower than that of the high-potential side electrode, is formed and covers the electron-emission region, and that the electrons that are emitted can not overcome the electric field and are continuously scattered across the high-potential side electrode.

When the point whereat no beam is observed is defined as n1, the value of n1 is estimated to be approximately 0.5 times the value Xs.

Therefore, the reduction in the size of the beam spot can be observed in an area D extending from point C to point E.

Figure 6:
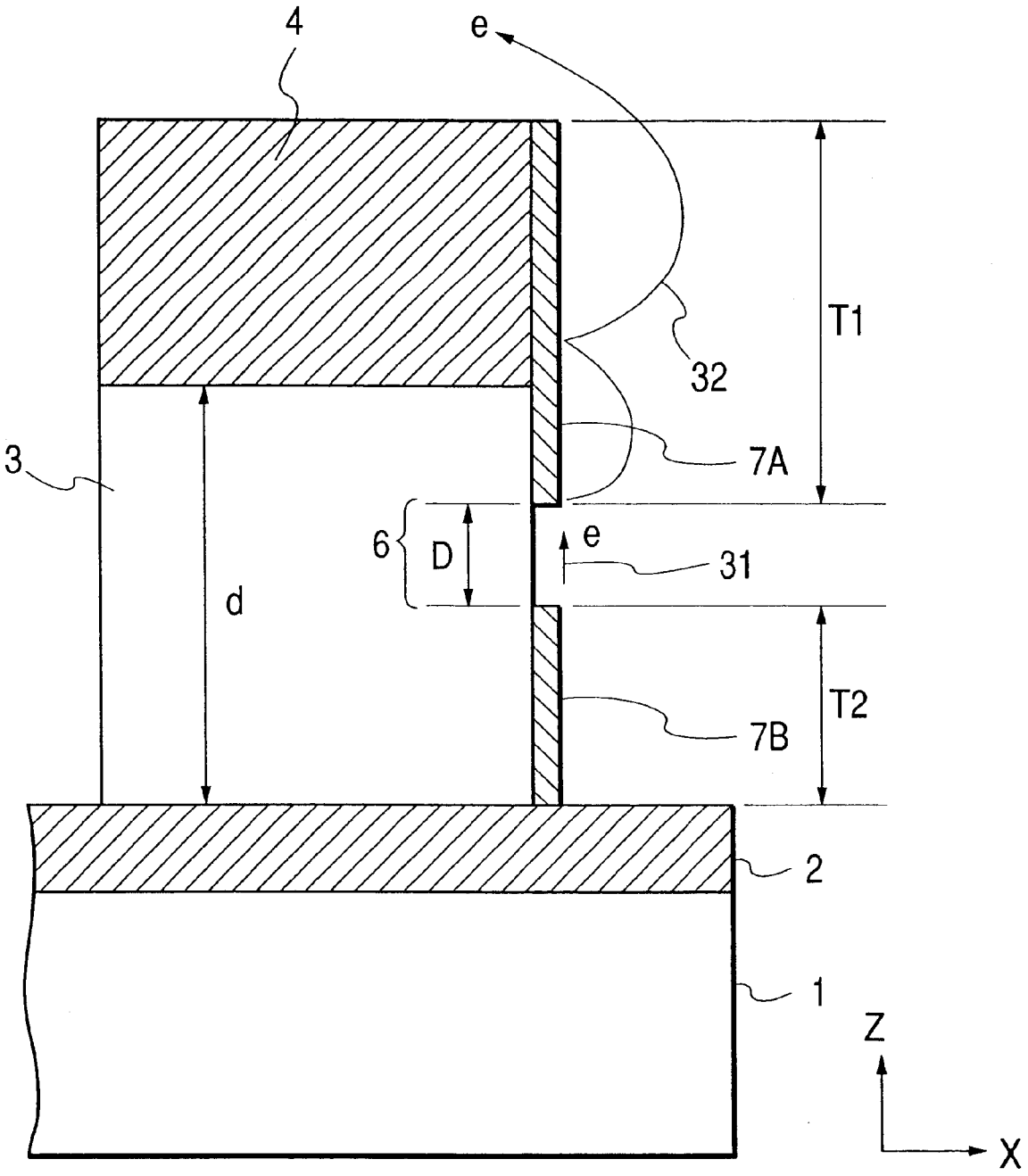
FIG. 6 is an enlarged cross-sectional view of an electron-emitting region in FIGS. 1A and 1B.

FIG. 6 is an enlarged diagram showing the electron-emission region of the device. In FIG. 6, the space between the electroconductive films 7A and 7B, at the gap 6, defines a distance D; the surface measurement from the end face of the electroconductive film 7A at the gap 6 to the top of the high-potential side electrode 4 defines a distance T1; and the surface measurement from the end face of the electroconductive film 7B at the gap 6 to the top of the low-potential side electrode 2 defines a distance T2.

High-potential side electrode is used as an inclusive term for all the electrodes, including the high-potential electrode 4 and the electroconductive film 7A, that are electrically connected to the potential side, i.e., it is used to describe the high-potential area. Similarly, low-potential side electrode is used as an inclusive term for all the electrodes, including the low-potential electrode 2 and the electroconductive film 7B, i.e., it is used to describe the low-potential area. Hereinafter, for convenience sake, high-potential side electrode is employed for of the high-potential electrode 4 or the high-potential side area, and low-potential electrode is employed for the low-potential electrode 2 or the low-potential side area.

When the voltage Vf is applied to the electron-emitting device, in FIG. 6, electrons 31 tunnel from the distal end of the low-potential side electrode that faces the gap 6 to the opposite high-potential side electrode. The electrons 31 isotopically scatter at the distal end of the high-potential side electrode.

Then, as is described above, most of the electrons 31 that have tunneled repeat elastic scattering (multiple scattering) several times at the high-potential side electrode.

As was previously described, it is apparent that, when scattering is repeated at the surface conduction electron-emitting device, the number of electrons to be extracted into a vacuum is reduced in accordance with the power series.

With the arrangement of the step type device in FIG. 6, electrons scatter even at the side walls of the high-potential side electrode. However, those electrons that clear the side wall and that have sufficient kinetic energy to propel them toward the positive electrode (anode) do not scatter again, and fly toward the positive electrode 10.

The distance flown by scattering electrons is disclosed in SID 98 Digest, Okuda, et al.

The maximum distance flown by scattering electrons is obtained from a function of the gap D, the drive voltage Vf and the work function Wf of the electrode, and is specifically estimated as being 100 to 200 times the distance defined by the gap D.

Therefore, when the thickness T1 is set so that it is the same as the electron flying distance, the electrons that do not scatter across the high-potential side electrode several times can arrived the positive electrode 10.

As is apparent from the above explanation, when the thickness T1 is set as small (thin) as possible, the scattering of electrons can be prevented.

Since the gap D is several nm to several tens of nm, the distance T1 that can be achieved during the fabrication process is 5 to 200 nm, so that a reduction in efficiency can be satisfactorily prevented.

As is described above, the distance T1 is an important parameter as regards multiple scattering. This distance T1 is closely related to the distance T2 between the low-potential side electrode and the positioning of the gap 6 that is formed in the insulating layer 3, i.e., the positioning of the end face of the low-potential side electrode at the gap 6. In accordance with a detailed study, it was found that with the arrangement in FIG. 6 efficiency was not greatly affected when the gap 6 was positioned higher than half the thickness d of the insulating layer 3 and the length of distance T2 approached that of the thickness d, but that efficiency was drastically reduced when the gap 6 was positioned low relative to the insulating layer and the distance T2 was nearly zero. The import of this study is that efficiency is affected by the positioning of the gap.

Therefore, the average position employed for the gap 6 that is formed in the side face (the face in the direction of the thickness) of the insulating layer is higher than half the thickness of the insulating layer 3, and the average distance T2 between the gap 6 and the surface of the low-potential side electrode 2 is greater than ½ the thickness d of the insulating layer 3. As a result, variances and fluctuations in the efficiency can be suppressed.

Figure 7:
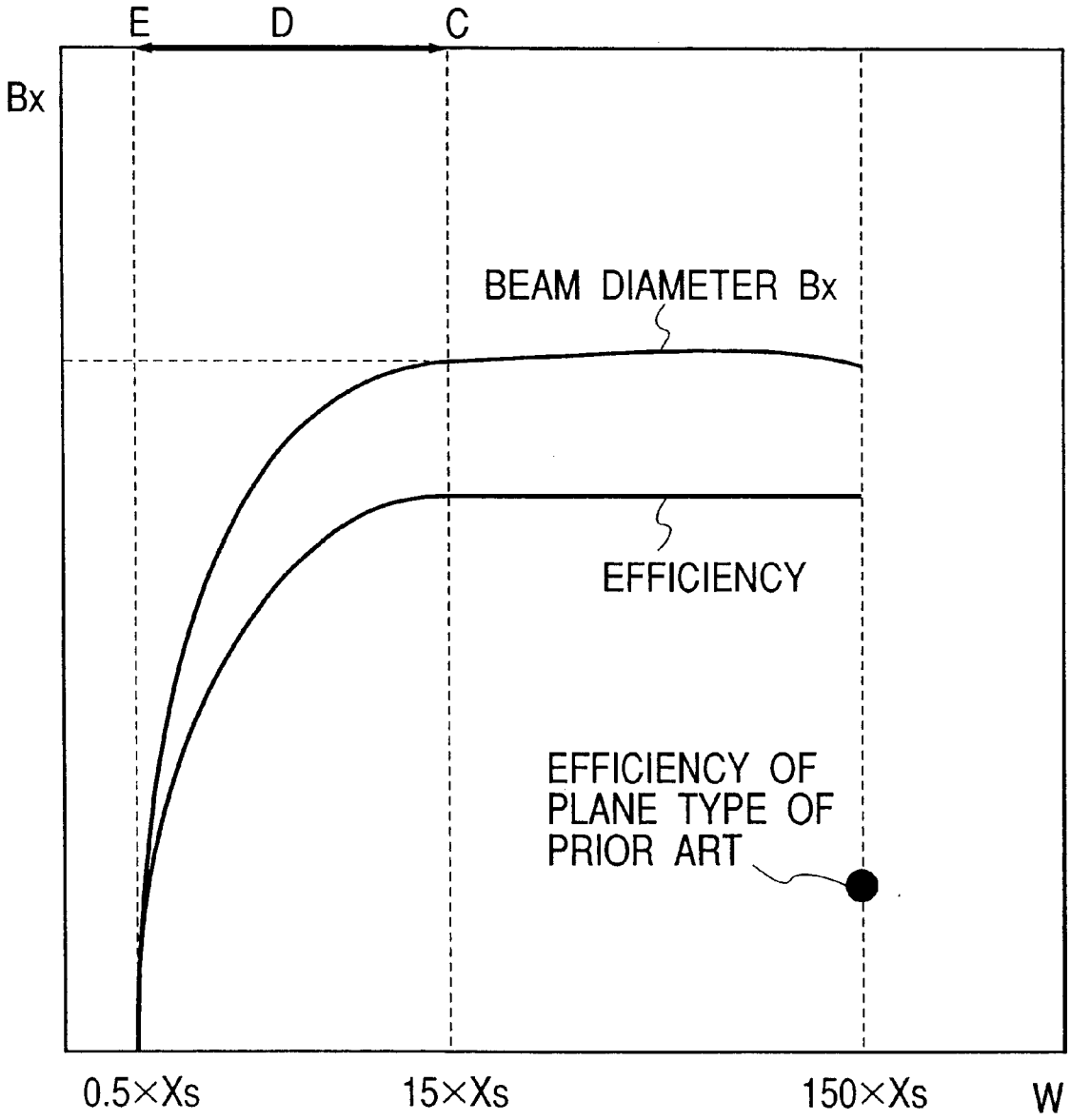
FIG. 7 is a diagram showing the relationship between the width w of a high-potential side electrode and efficiency.

FIG. 7 is a graph showing efficiency and diameter of beam spot as it is related when the width W of the high-potential side electrode is changed.

Figure 40:
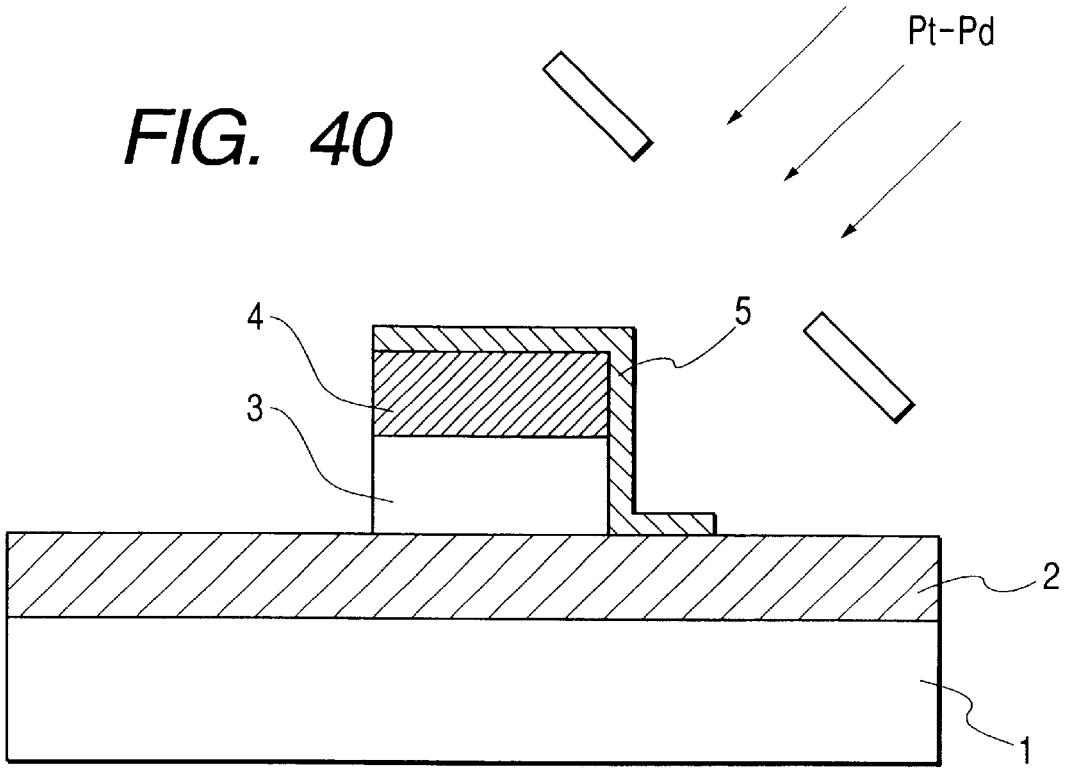
FIG. 40 is a cross-sectional view of an electron-emitting device according to a sixth embodiment of the present invention.

The above described function of the electron-emitting device of a step type improves efficiency compared with the conventional plane type shown in FIG. 40. When the width W is further reduced in the area following point C, wherein the beam diameter becomes smaller, efficiency is deteriorated until it is nearly 0 at point E. However, when the beam spot in the area D is effectively focused, efficiency can be attained that is higher than that possible with the conventional plane type.

Another example electron-emitting device of this invention will now be described.

Figure 8A:
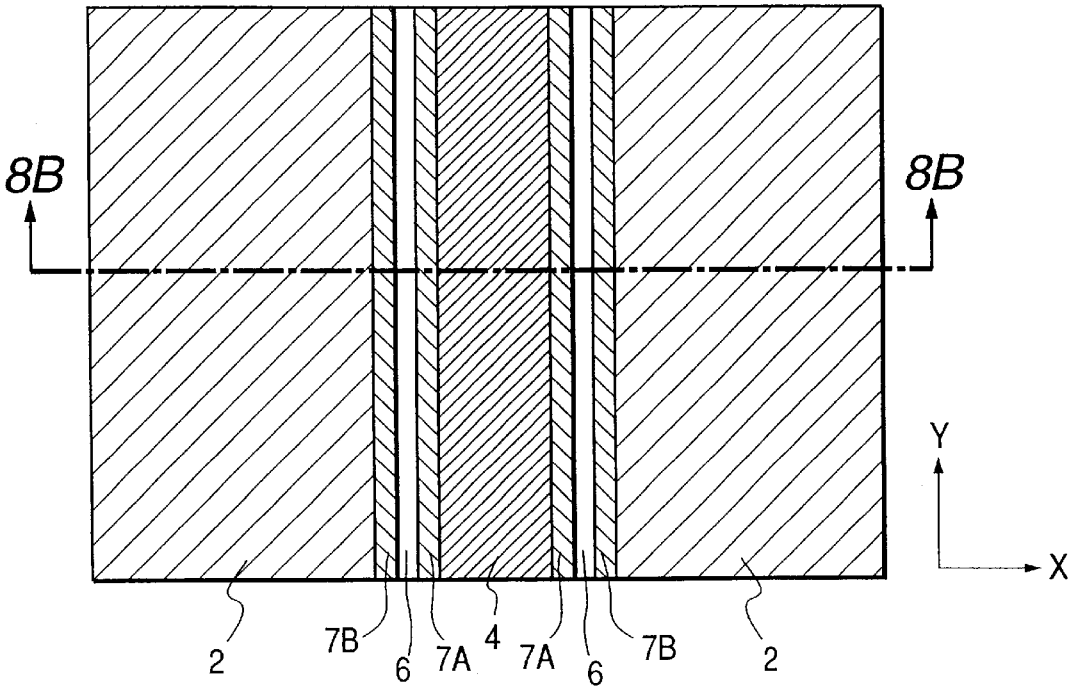
FIGS. 8A and 8B are diagrams showing another example of the electron-emitting device according to the first mode of the present invention.
Figure 8B:
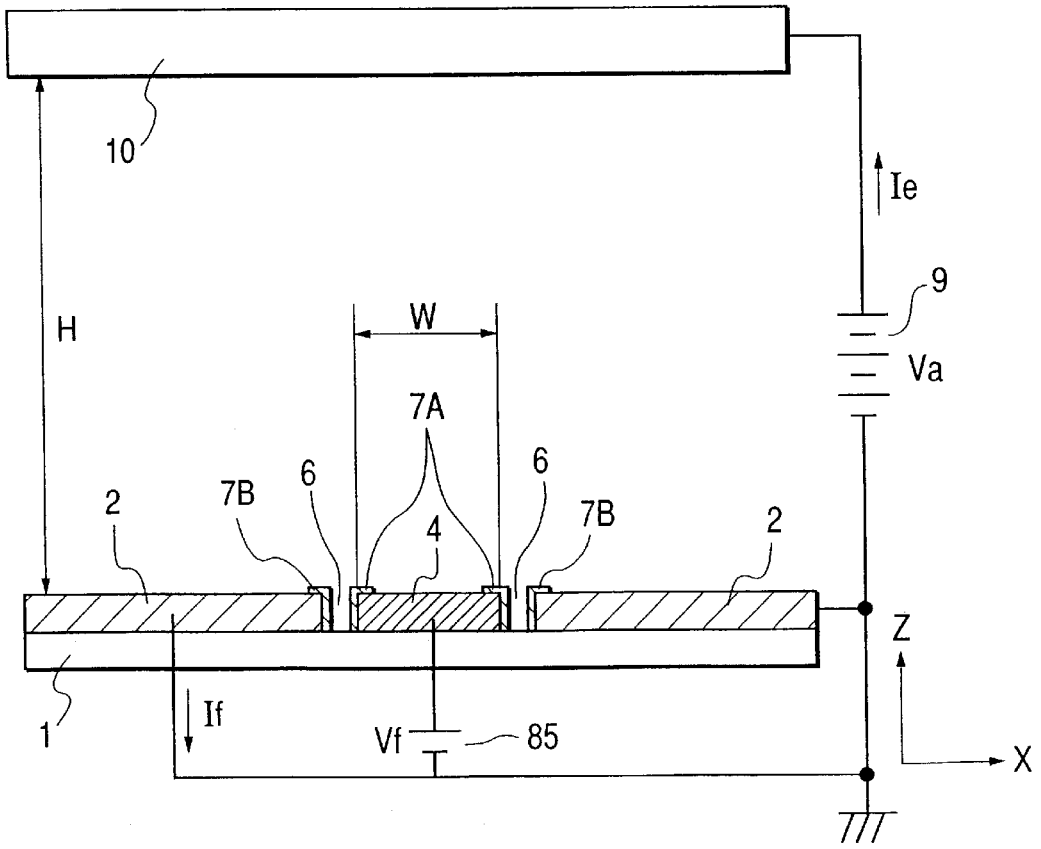

FIG. 8A is a specific diagram illustrating another example electron-emitting device according to the first mode of the present invention, and FIG. 8B is a cross-sectional view taken along line 8B—8B in FIG. 8A.

Figure 9A:
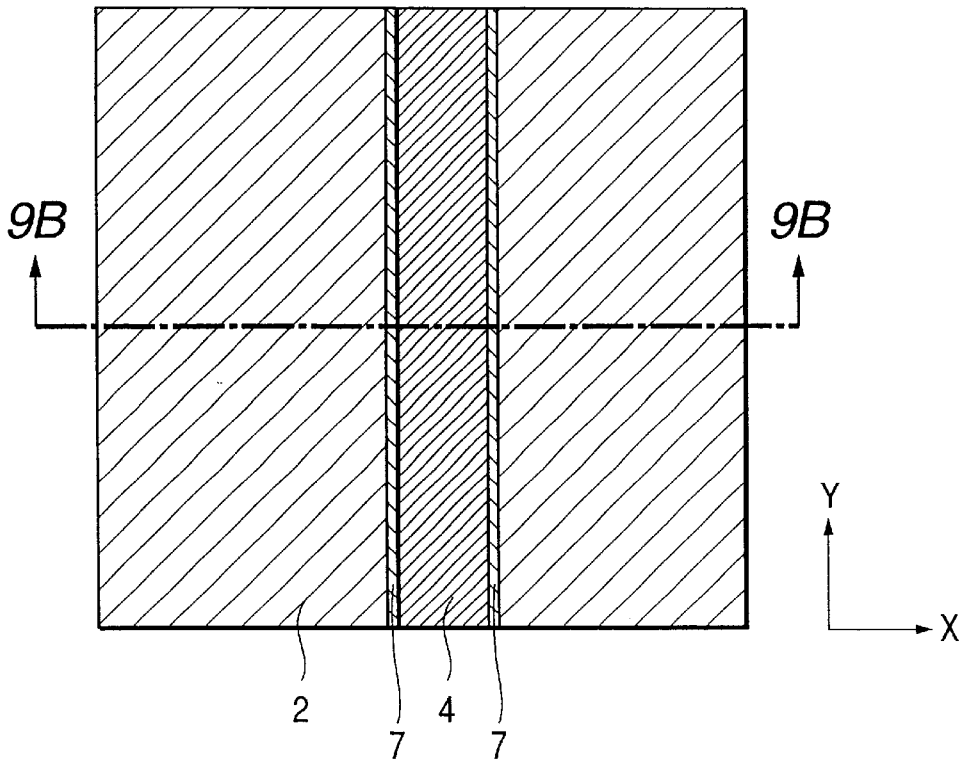
FIGS. 9A and 9B are diagrams showing an additional example of the electron-emitting device according to the first mode of the present invention.
Figure 9B:
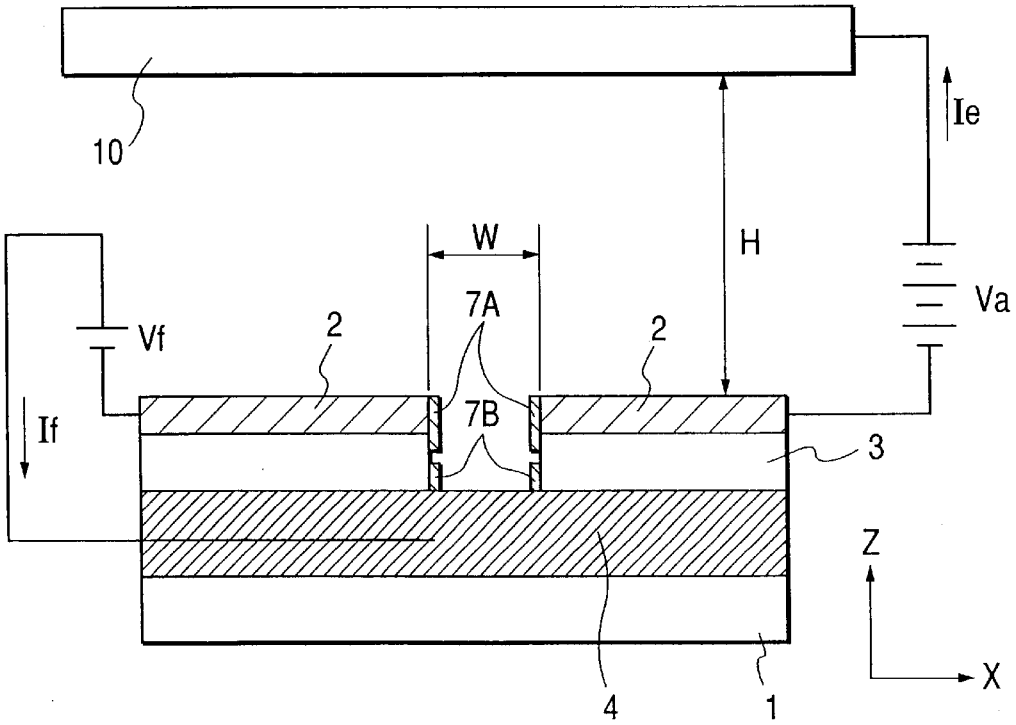

FIG. 9A is a specific diagram showing an additional example electron-emitting device according to the first mode of the invention, and FIG. 9B is a cross-sectional view taken along 9B—9B in FIG. 9A.

As is described above, in the first mode of the invention, the width W is defined when the high-potential side electrode is positioned in the middle of the low-potential side electrode in the direction X. The simplest arrangement is the rectangular arrangement shown in FIGS. 1A and 1B (this arrangement may be called a ridge shape). The shape, however, is not limited to this one only, and a part of the shape may have at least a width W that corresponds to that of the high-potential side electrode that is sandwiched by the low-potential side electrode.

For example, when the ridge type electron-emitting device is employed for an image-forming apparatus while the device drive voltage Vf=15 [V], the positive voltage Va=10 [KV], and the distance H between the device and the positive electrode=2 [mm], an electrode having a width equal to or smaller than 15 $\mu$m is required.

To obtain the same beam spot reduction effect, another example can provided by using the plane type arrangement in FIGS. 8A and 8B or the step type arrangement in FIG. 9, wherein the high-potential side electrode 4, the insulating layer 3 and the low-potential side electrode 2 are laminated in order to form a rectangular slit (called a slit shape). While considering only the potential structure viewed from the positive electrode (the direction Z), the high-potential side electrode is sandwiched by the low-potential side electrode. Such a structure is important as regards the beam diameter.

It should be noted that with the arrangement in FIGS. 8A and 8B or 9 there is no improvement in the efficiency obtained by the ridge type (FIG. 1).

Therefore, as the first mode of the invention, the ridge-shaped arrangement of a step type, wherein the low-potential side electrode 2, the insulating layer 3 and the high-potential side electrode 4 are laminated together, most preferably provides both high efficiency and a high-resolution beam spot.

FIGS. 10A to 10E are diagrams showing an example method for fabricating the electron-emitting device according to the first mode of the invention. The fabrication method will now be explained.

Figure 10A:
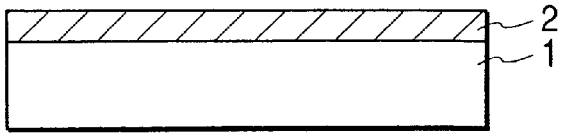
FIGS. 10A, 10B, 10C, 10D and 10E are diagrams showing a basic method for fabricating the electron-emitting device according to the first mode of the present invention.

The low-potential side electrode 2 is formed on the first major surface of the substrate 1 (FIG. 10A).

The insulating substrate 1 can be: silica glass, the surface of which is well washed; glass, for which the impurity content, such as Na, is reduced and which is partially replaced by K; soda-lime glass or a silicon substrate on which $SiO_2$ is laminated by sputtering; or an insulating substrate made of ceramics, such as alumina.

The low-potential side electrode 2 is generally electroconductive, and is formed using a common vacuum film formation technique, such as vacuum evaporation or sputtering, or photolithography. The material for the electrode is selected from among such metals or alloys as Be, Mg, Ti, Zr, Hf, V, Nb, Ta, Mo, W, Al, Cu, Ni, Cr, Au, Pt and Pd. The thickness set for the low-potential side electrode 2 ranges from several tens of nm to several mm, while the thickness set for the high-potential side electrode 4 ranges from several nm to several hundreds of $\mu$m, and preferably, from several tens to several hundreds of nm.

Figure 10B:
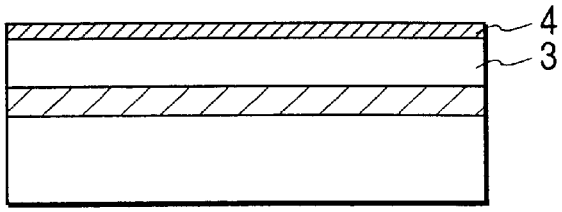
Figure 10C:
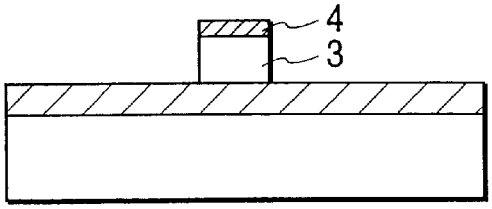

The insulating layer 3 and the high-potential side electrode 4 are deposited over the low-potential side electrode 2 (FIG. 10B).

The insulating layer 3 is formed using a common vacuum film formation technique, such as sputtering, a thermal oxidation method, or an anodic oxidation method. The thickness set for the insulating layer 3 ranges from several nm to several tens of $\mu$m, but preferably ranges from several tens of nm to several $\mu$m. A preferable material is one such as $SiO_2$, SiN, $Al_2$, $O_3$ or CaF that exhibits high resistance in a high-voltage electric field.

The material used for the high-potential side electrode 4 can be the same as that used for the low-potential side electrode 2, or a different material may be used, but preferably, the material is used should be heat-resistant. The thickness set for the high-potential side electrode 4 ranges from several nm to several $\mu$m, but preferably ranges from several to several hundreds of nm. If a potential drop is anticipated because the electrode 4 is thin, or if the electron-emitting device is employed in a matrix array, as needed, a low-resistant wiring metal may be used for a portion that is not related to electron emission.

The insulating layer 3 and the high-potential side electrode 4 are partially removed from the substrate 1 using photolithography, so that viewed from the positive electrode (anode) 10 at the top of the device, the high-potential side electrode 4 appears to be sandwiched by the low-potential side electrode 2. The etching process may be halted when the low-potential side electrode 2 has been reached, or after a part of the low-potential side electrode 2 has been removed. Further, during this process, the insulating layer 3 and the high-potential side electrode 4 may be removed from the substrate 1, so that a structure may be formed that appears to have either a convex shape or a concave shape when in the driven state the device is viewed from the positive electrode 10 at the top.

A smooth and vertically etched face is preferable for the etching process, and an etching method may be selected that is suitable for the materials that are used for the individual electrodes and the insulating layer.

For another structure, the high-potential side electrode and the low-potential side electrode are arranged on the same plane. In this case, first, an electrode layer is deposited on the substrate 1, and then, the low-potential side electrode 2 and the high-potential side electrode 4 are formed using photolithography. Using this process, an electron-emitting device can be provided wherein the high-potential side electrode 4 is sandwiched by the low-potential side electrode 2 and wherein the high-potential side electrode 4 and the low-potential side electrode 2 are arranged on the same plane. In this case, an interval ranging from several nm to several hundreds of $\mu$m is provided between the high-potential side electrode 4 and the low-potential side electrode 2.

Following this, the process for forming the gap 6 between the electroconductive films 7A and 7B is performed.

To deposit the electroconductive films 7A and 7B, a common vacuum film formation process such as sputtering, thermal oxidization or anodic oxidization, or an activation operation may be employed either individually or in combination.

When the vacuum film formation or oxidization method is performed, the same material that is used for the low-potential side electrode 2, or a different material, may be employed. Preferably, the material that is used is a heat resistant one, such as W, Ta or Mo; a carbide, such as Tic, ZrC, HfC, TaC, SiC or WC; a boride, such as $HfB_2$, $ZrB_2$, $LaB_6$, $CeB_6$, $YB_4$ or $GdB_4$; a nitride, such as TiN, ZrN or HfN; a semiconductor material, such as Si or Ga; an organic polymer material; or a carbon, such as amorphous carbon, graphite, diamond-like carbon, or a compound.

When the activation operation is employed, a process called activation is performed. But before initiating this process, usually a "forming" operation is performed.

Figure 10D:
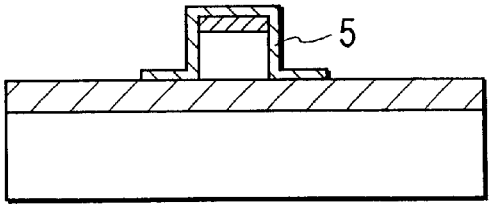

For the "forming" operation, first, an electroconductive film 5 is deposited (FIG. 10D).

Figure 10E:
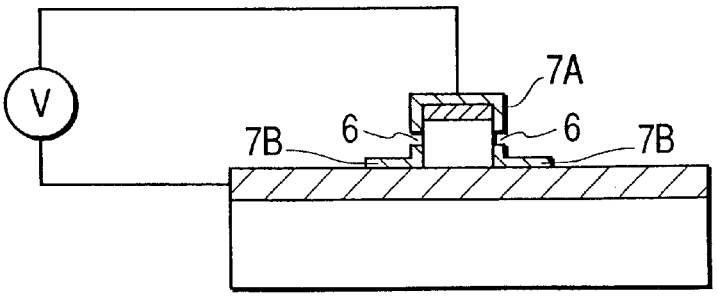

Then, a voltage is applied at either end of the electroconductive film 5, a current is locally supplied to destroy, deform or degenerate the electroconductive film 5 and to set it in a highly-resistant state (a gap 6 is also formed in a part of the electroconductive film 5) (FIG. 10E).

The material used for the electroconductive film 5 is a metal, such as Pd, Ru, Ag, Au, Ti, In, Cu, Cr, Fe, Zn, Sn, Ta, W or Pd, or one of their alloys; an oxide, such as PdO, $SnO_2$, $In_2O_3$, PbO or $Sb_2O_3$; a boride, such as $HfB_2$, $ZrB_2$, $LaB_6$, $CeB_6$, YB4 or GdB4; a carbide, such as TiC, ZrC, HfC, TaC, SiC or WC; a nitride, such as TiN, ZrN or HfN; a semiconductor material, such as Si or Ge; or carbon, AgMg, NiCu, Pb or Sn. The resistance provided by the film 5 is sheet resistance having a rated value of $10^3$ to $10^7$ $\Omega/\square$.

A common vacuum film formation technique, such as vacuum evaporation or sputtering, is used to form the electroconductive film 5; and for this, the ink-jet method and the heat treatment process may be employed. After the forming process has been completed, the electroconductive film 5 is separated to obtain the electroconductive film 7A that is connected to the high-potential side electrode 4, and the electroconductive film 7B that is connected to the low-potential side electrode 2.

The activation operation is performed by applying a voltage between the electrodes in an atmosphere containing a carbon compound.

The substrate 1 is placed in a vacuum container 61 (see FIG. 11), and air is evacuated from the container 61 by a vacuum discharge pump 62 to obtain a vacuum. Then, a carbon compound (organic material) gas from a carbon compound gas source 63 is introduced into the vacuum container 61, and in the carbon compound gas atmosphere a voltage is applied between the electrodes (2, 4). For this procedure, a pulse waveform voltage is repetitiously applied. The voltage application method can be either one for repetitiously applying a pulse for which the pulse pitch value is a constant voltage, as is shown in FIG. 12A, or one for repetitiously applying a pulse for which the pulse pitch value is an increasing voltage, as is shown in FIG. 12B.

Figure 12A:
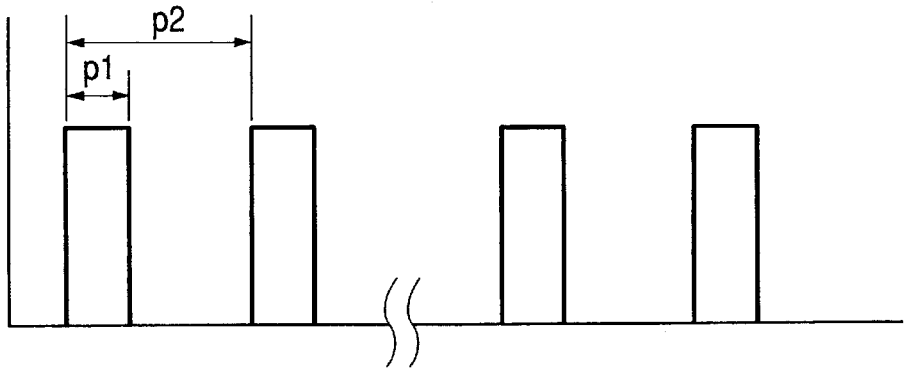
FIGS. 12A, 12B and 12C are diagrams showing a pulse waveform.
Figure 12B:
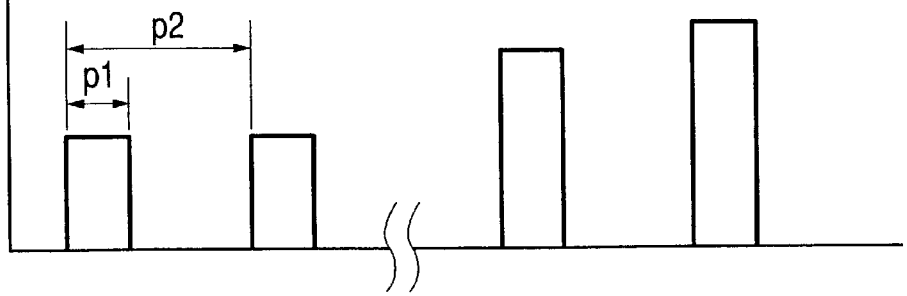
Figure 12C:
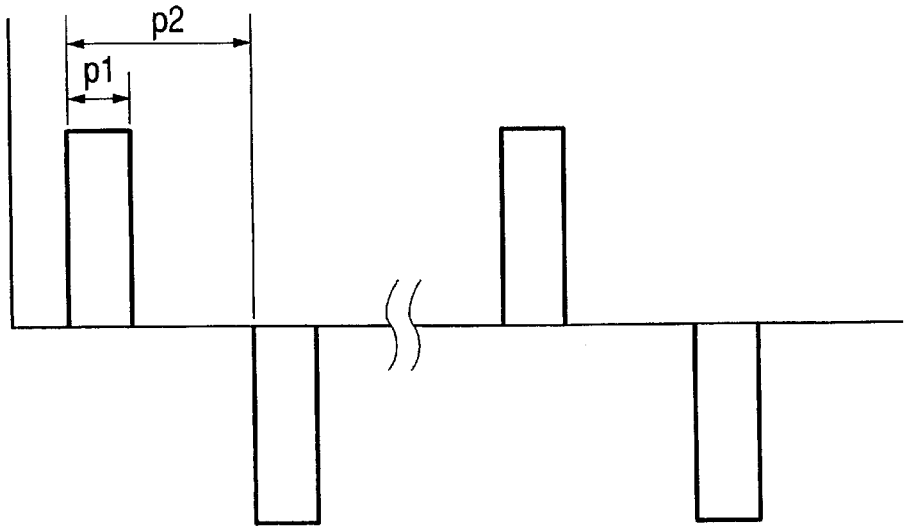

Further, a pulse may be repetitiously applied at only one pole, or as is shown in FIG. 12C, pulses may be repetitiously applied at both poles.

During the activation process, an electroconductive carbon film is deposited. The carbon film contains, for example, graphite (so-called HOPG), PG or GC. HOPG has a substantially complete graphite crystal structure; PG has a slightly distorted crystal structure and crystal particles of about 20 nm; and GC, which is amorphous carbon, has a crystal structure that is more distorted and crystal particles of approximately 2 nm (the term amorphous carbon is used either for amorphous carbon, or for a mixture of amorphous carbon and the fine graphite crystals). Preferably, the thickness of the carbon film is equal to or less than 50 nm, but more preferably it is equal to or less than 30 nm.

(Second Mode)

A second mode of the present invention will now be described. In the second mode, the shapes of the electrodes are substantially the same as those in the first mode, but only one side gap 6 is formed.

Figure 13A:
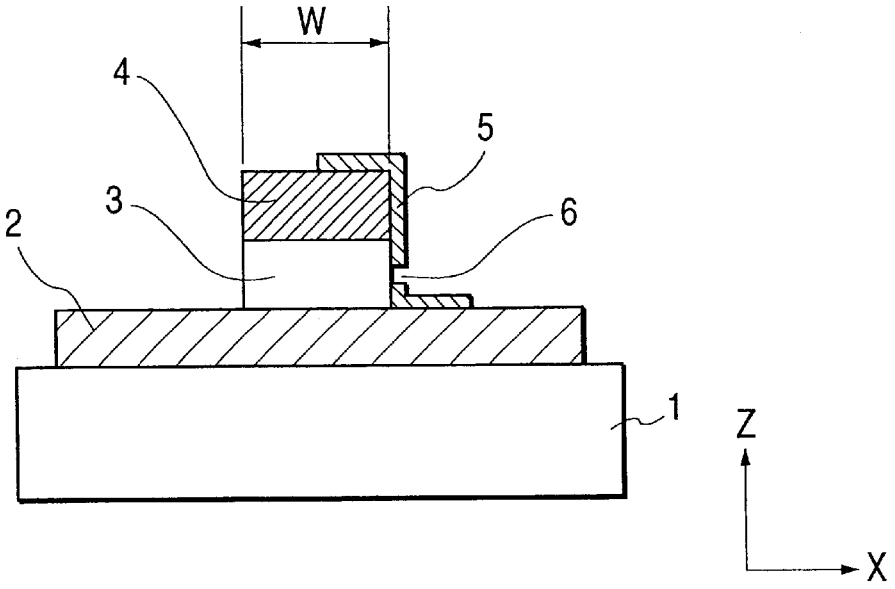
FIGS. 13A and 13B are diagram showing a basic electron-emitting device according to a second mode of the present invention.
Figure 13B:
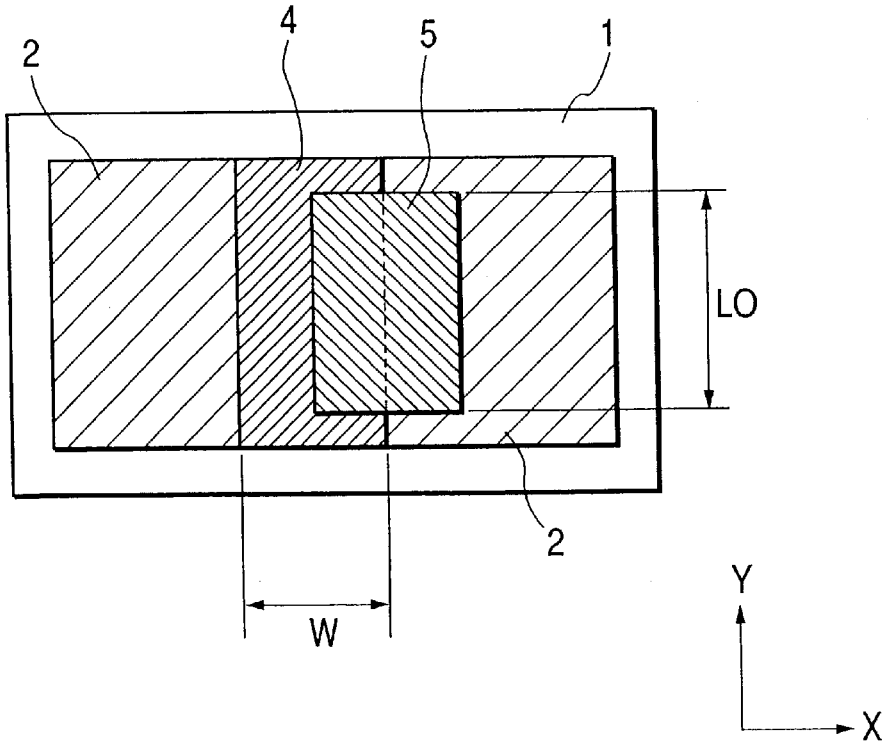
Figure 16:
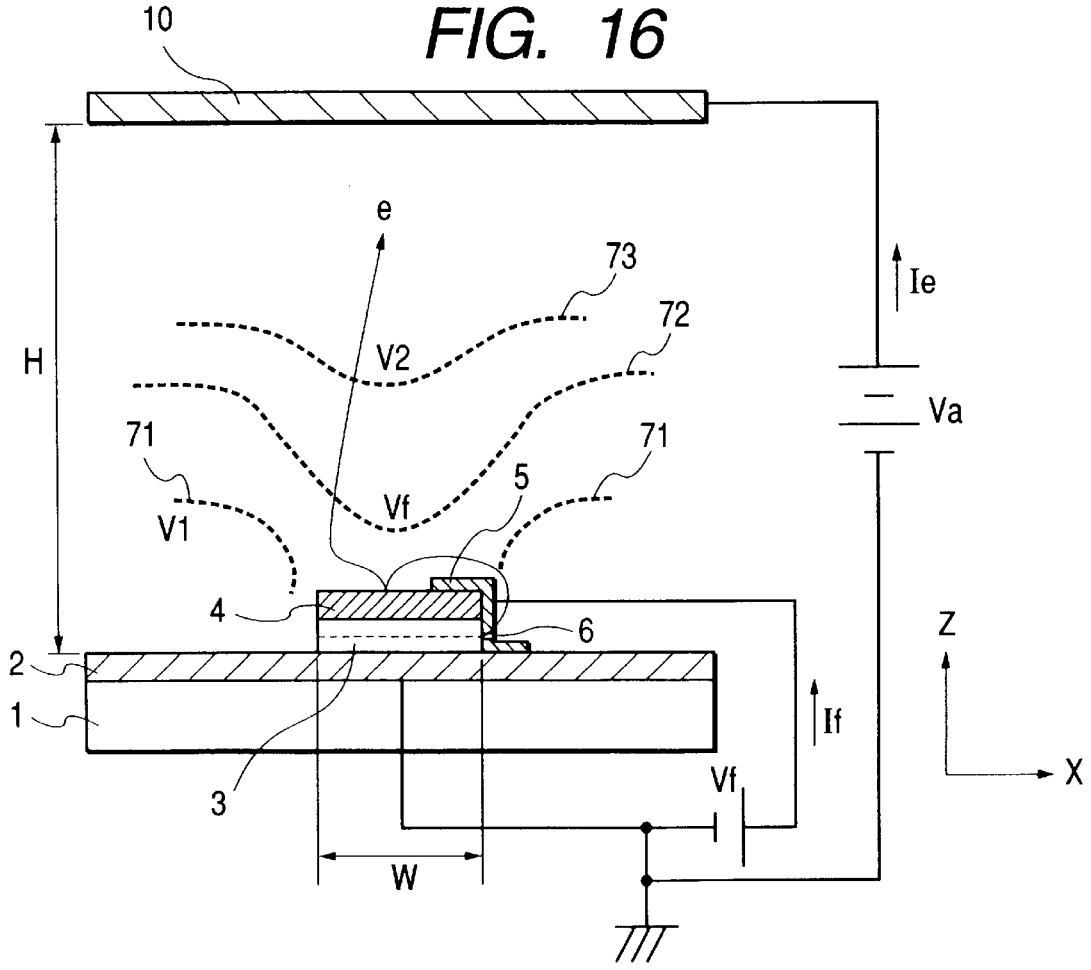
FIG. 16 is a diagram showing a electric field of the electron-emitting device according to the second mode of the present invention.

FIGS. 13A and 13B are a cross-sectional view and a top view of an electron-emitting device according to the second mode. The electron-emitting device comprises: a substrate 1; a low-potential side electrode 2; an insulating layer 3; a high-potential side electrode 4; an electroconductive film 5; and a gap 6. FIG. 16 is a specific diagram illustrating the state wherein the electron-emitting device in this mode is driven. In FIG. 16, the same reference numerals and symbols as are used in FIG. 13A and 13B are used to denote corresponding members. In addition, in FIG. 16 a positive electrode (anode) 10 is provided.

FIGS. 14A to 14D are diagrams showing a method for fabricating the electron-emitting device according to the second mode of the invention. Except for the gap forming process, this method is substantially the same as that in the first mode.

To selectively form a gap only on one side, the electroconductive film 5 is deposited only on a desired area, whereafter the forming process and the activation process described above are performed. The electroconductive film 5 is selectively formed using photolithography or orthogonal vacuum evaporation.

For the electron-emitting device of the second mode, either the activation process may be performed, or instead, special control may be exercised for maintaining a viable height for the insulating layer 3 between the low-potential side electrode 2 and the high-potential side electrode 4, and for shaping the gap 6.

The operation of the second mode of the invention will now be described.

Figure 15:
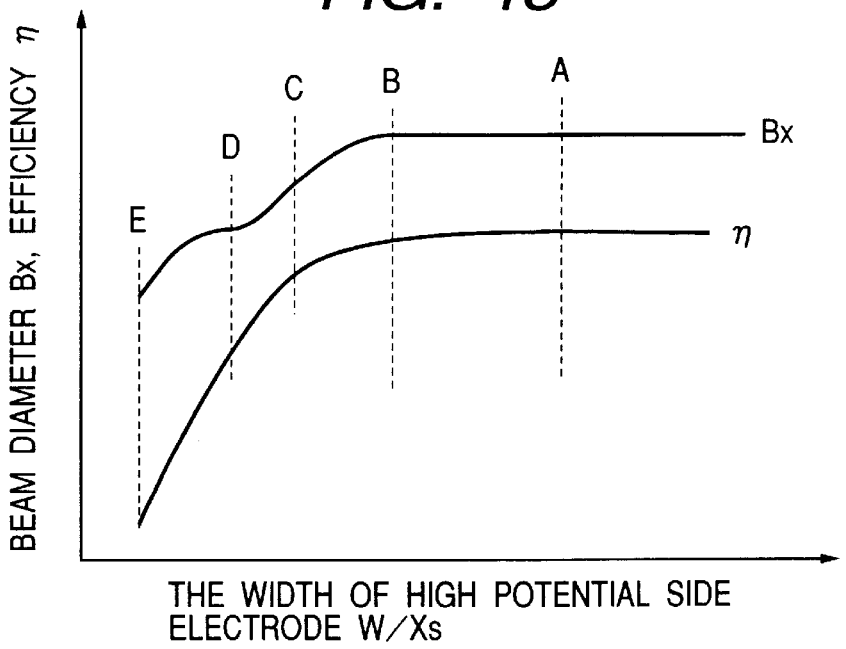
FIG. 15 is a diagram showing the relationship of the width w, of the high-potential side electrode of the basic electron-emitting device of the second mode of the present invention, to the diameter of a beam spot and the efficiency.

In FIG. 15 is shown the relationship existing among the width W of the high-potential side electrode, the electron emission efficiency $\eta$, and the diameter of beam spot Bx when the electron-emitting device of the second mode is driven as is shown in FIG. 16.

In the second mode, as in the first mode, the efficiency and the beam diameter can be regulated by using the distance Xs. Therefore, the horizontal axis represents the width W that is regulated by using the distance Xs.

When the width W of the high-potential side electrode is reduced, at point B the diameter of the beam spot and the efficiency begin to be reduced. Since the width W in the area following point B is satisfactorily small, the electrons begin to be affected by a negative potential 71 (see FIG. 16) that is lower than that of the high-potential side electrode 4. As a result, the trajectories of the electrons are curved, and the electron distribution on the positive electrode 10 is narrowed. The width W at point B is 15 times the distance Xs.

When the width W is further reduced at point C, the beam diameter is also reduced. The width W in the vicinity of point C is the most preferable for the second mode of this invention. The width W set at point C for the high-potential side electrode ranges from 2 to 12 times the distance Xs.

At point C, when the reduction of the width W is continued, the beam diameter is reduced; however, at point D there is only a small reduction in the diameter of the beam spot.

An explanation of why the beam diameter is not reduced very much at point D will be given while referring to FIG. 16.

In FIG. 16, an equipotential line 71 has a negative potential lower than that of the high-potential side electrode 4; an equipotential line 72 has the same potential as the high-potential side electrode 4; and an equipotential line 73 has a positive potential that is higher than the high-potential side electrode 4.

The trajectories of electrons that are emitted from the gap 6 are deflected toward the high-potential side electrode 4, and are affected by the equipotential line 71, which has a negative potential lower than that of the high-potential side electrode 4. As a result, the arrived position on the positive electrode (anode) 10 whereat the electrons is moved toward the electron-emitting region. However, as is shown in FIG. 16, at the equipotential line 71, the trajectory of a part of the electrons is sharply changed in the opposite direction, and as a result, some electrons overshoot the point immediately above the electron-emitting region. The effects of the reduction in the beam diameter do not substantially appear for the width W of the high-potential side electrode when such electrons are present.

At point E, whereat the width W is further reduced, deterioration of the electron emission efficiency occurs. This is because, since the width W is too small, the equipotential line 71, which has a lower potential than has the high-potential side electrode 4, blocks the trajectories of electrons, and the number of the electrons that reach the positive electrode 10 is reduced. In this case, the electrons that pass the equipotential line 71 reach substantially a single point immediately above the electron-emitting region, and form a small beam spot. The width W of the high-potential side electrode whereat almost no electrons are observed is equal to or smaller than 0.5 times the distance Xs.

The same effects as are described above are obtained by regulating the distance H, and the voltages Va and Vf. For the electron-emitting device of this invention, while taking into account the fact that the scattering of electrons occurs as part of the same phenomenon, the voltage Vf is set so it is equal to or smaller than 30 V, the distance H is not particularly specified, and the voltage Va is set at several hundred V to several tens of kV.

The ridge-shaped structure in FIGS. 13A and 13B has been employed for the second mode. But other structures that can be used are the plane type arrangement in FIGS. 17A and 17B, for which the high-potential side electrode 4 and the low-potential side electrode 2 are arranged on the same plane, and the step type arrangement in FIGS. 18A and 18B, for which the high-potential side electrode 4, the insulating layer 3 and the low-potential side electrode 2 are laminated together in order to form a rectangular slit. With the latter arrangement, a necessary beam diameter is obtained when the width of the high-potential side electrode 4, which is exposed to the low-potential side electrode 2, is set equal to or greater than 0.5 times and equal to or smaller than 15 times the distance Xs that is represented by equation (1).

The same electron-emission efficiency as in the first mode can be applied for the second mode. That is, while efficiency is improved for the ridge-shaped structure, there is no improvement in efficiency for the plane type or slit type. Therefore, electron-emission efficiency can not be employed as a criterion for selecting an optimal arrangement.

(Third Mode)

A third mode of the present invention will now be described.

Whereas the first and the second modes employ an arrangement whereby the high-potential side electrode having the width W is sandwiched by the low-potential side electrode, the third mode employs an arrangement whereby a high-potential side electrode, which has a maximum width Wmax and a minimum width Wmin, is enclosed by a low-potential side electrode in the directions X and Y.

Figure 19A:
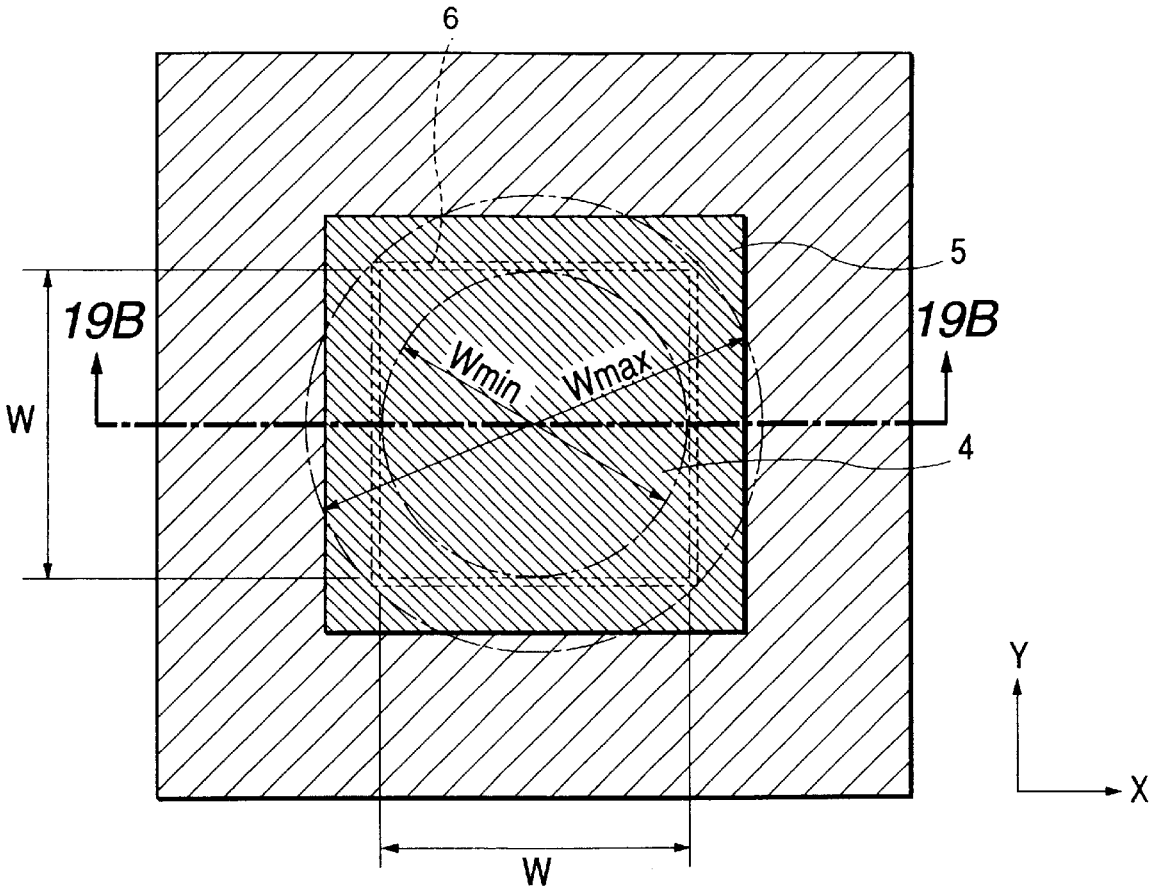
FIGS. 19A and 19B are diagrams showing a basic electron-emitting device according to a third mode of the present invention.
Figure 19B:
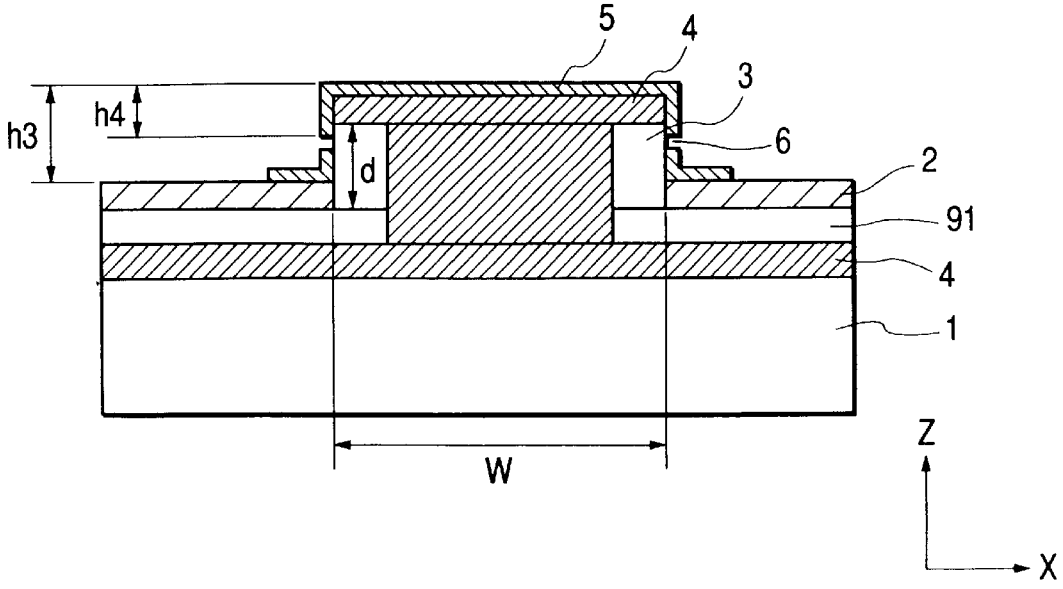

FIG. 19A is a diagram showing an electron-emitting device according to the third mode as viewed from an anode. FIG. 19B is a specific cross-sectional view taken along line 19B—19B in FIG. 19A. The electron-emitting device comprises: a substrate 1, a low-potential side electrode 2, an insulating layer 3, a high-potential side electrode 4, an electroconductive film 5, and a gap 6.

An insulating inter-layer 91 is deposited between the low-potential side electrode 2 and the high-potential side electrode 4. The insulating layer 3 and the insulating inter-layer 91 are partially removed, and the high-potential side electrode 4 is embedded therein. For this mode, the arrangement includes a convex shape centrally positioned in a square.

The maximum width Wmax is the diameter of the smallest circumscribed circle that can include all of the area enclosed by the gap 6, as viewed from the anode. The minimum width Wmin is the diameter of the largest circle that can be inscribed in the area enclosed by the gap 6.

FIGS. 20A to 20H are diagrams showing an example method for fabricating the electron-emitting device according to the third mode of the invention.

Figure 20A:
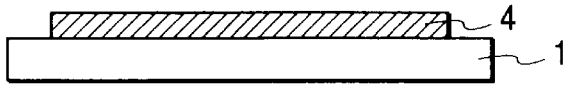
FIGS. 20A, 20B, 20C, 20D, 20E, 20F, 20G and 20H are diagrams showing an example method for fabricating the electron-emitting device according to the third mode of the present invention.

One part of the high-potential side electrode 4 is formed on the first major surface of the insulating substrate 1 (FIG. 20A).

The insulating substrate 1 can be composed of: silica glass, the surface of which is well washed; glass, for which the impurity content, such as Na, is reduced and is partially replaced by K; soda-lime glass or a silicon substrate on which $SiO_2$ is laminated by sputtering; or an insulating substrate made of ceramics, such as alumina.

The device electrode is generally electroconductive, and is formed using a common vacuum film formation technique, such as vacuum evaporation or sputtering, or using photolithography. The material for the device electrode is selected from among metals or alloys, such as Be, Mg, Ti, Zr, Hf, V, Nb, Ta, Mo, W, Al, Cu, Ni, Cr, Au, Pt and Pd. The thickness set for the electrode ranges from several tens of nm to several mm, while the thickness set for the electrode ranges from several nm to several hundreds of $\mu$m, but preferably ranges from several tens of nm to several hundred nm.

Figure 20B:
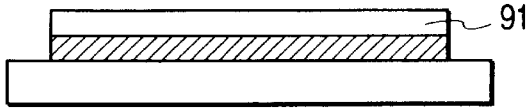

The insulating inter-layer 91 is then deposited (FIG. 20B).

The insulating inter-layer 91 is formed using a common vacuum film formation technique, such as sputtering, a thermal oxidation method, or an anodic oxidation method. The thickness set for the insulating inter-layer 91 ranges from several nm to several tens of $\mu$m. A preferable material is an oxide material, such as $SiO_2$ or $Al_2)_3$, a nitride, such as SiN, or another insulating material.

Figure 20C:
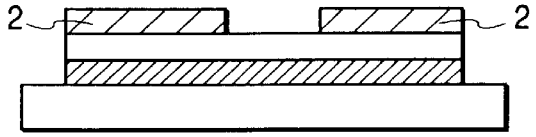

Thereafter, the low-potential side electrode 2 is deposited and patterned (FIG. 20C).

Figure 20D:
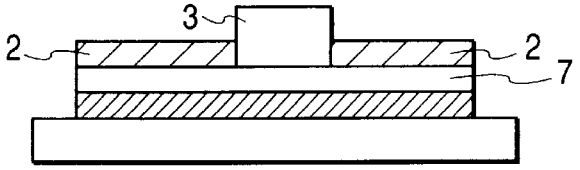

Then, the insulating layer 3 is deposited and patterned (FIG. 20D).

Figure 20E:
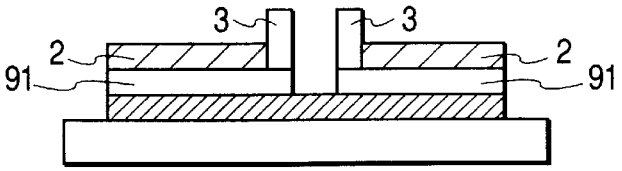

The insulating layer 3 is formed using a common vacuum film formation technique, such as sputtering, a thermal oxidation method, or an anodic oxidation method. The thickness set for insulating layer 3 ranges from several nm to several tens of $\mu$m, but preferably ranges from several tens of nm to several $\mu$m. A preferable material is one such as $SiO_2$, SiN, $Al_2O_3$ or CaF that exhibits a high resistance in a high-voltage electric field, A contact hole is formed to expose the low-potential side electrode 2 to one part of the insulating layer 3A (FIG. 20E).

Photolithography and the etching method are then employed to form the contact hole.

Figure 20F:
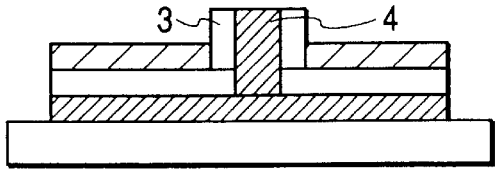

Following this, the high-potential side electrode 4 is partially embedded in the contact hole (FIG. 20F).

Figure 20G:
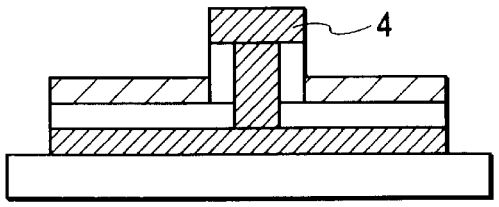

Subsequently, the high-potential side electrode 4 is deposited on the contact hole and the insulating layer 3 (FIG. 20G).

The high-potential side electrode 4 can be made of the same material as the low-potential side electrode 2, or it can be made of a different material, but preferably, it is made of a heat-resistant material. The thickness set for the high-potential side electrode 4 ranges from several nm to several $\mu$m, but preferably ranges from several nm to several hundred nm.

Next, the electroconductive film 7 is formed (FIG. 20H), and the gap 6 is defined during the forming process described above.

The succeeding process is the same as in the first mode.

According to the third mode of the invention, since the high-potential side electrode is enclosed in two dimensions, i.e., in the directions X and Y, the extraction of the high-potential side electrode must be considered. Therefore, the contact hole shown in FIGS. 20A to 20H may be employed, or a part of the high-potential side electrode may have an extended portion that is externally connected.

The operation performed in the third mode will now be described.

Figure 21A:
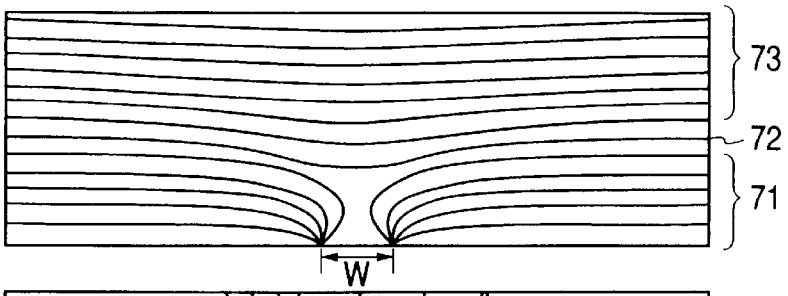
FIGS. 21A, 21A', 21B, 21B', 21C, and 21C' are diagrams showing the equipotential line of the electron-emitting device according to the third mode of the present invention.
Figure 21A:
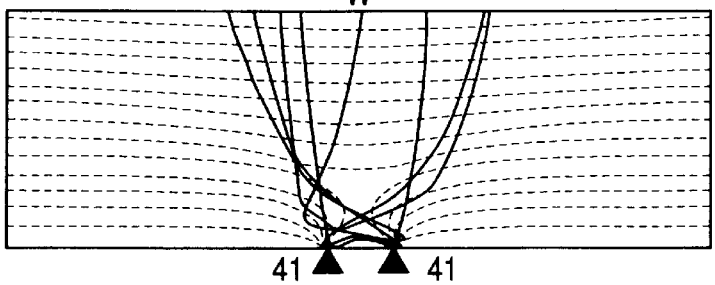
Figure 21B:
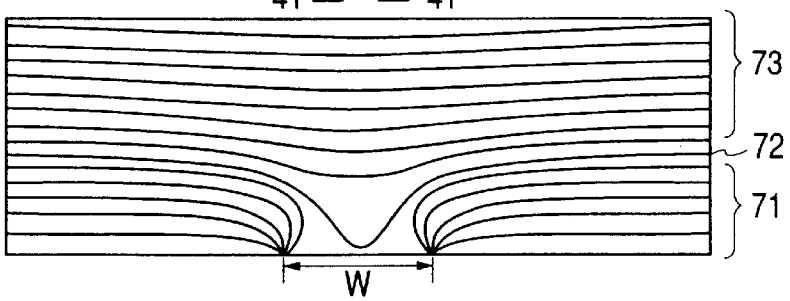
Figure 21B:
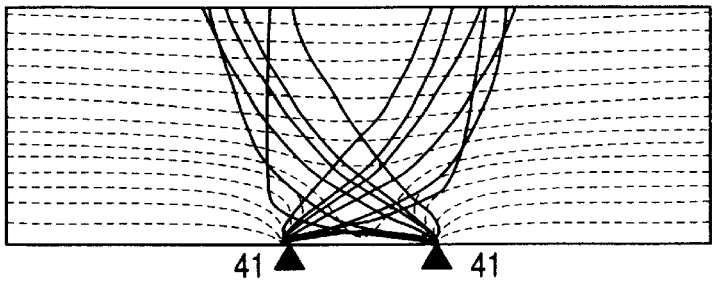
Figure 21C:
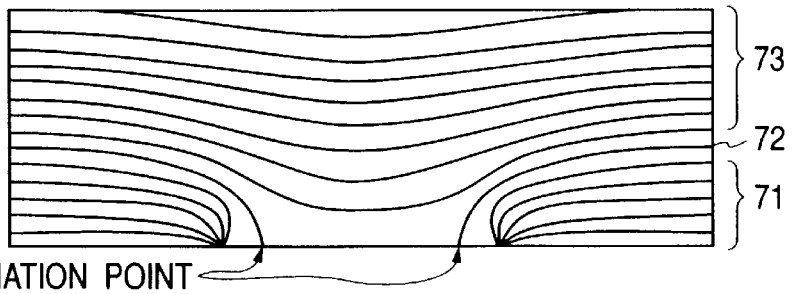
Figure 21C:
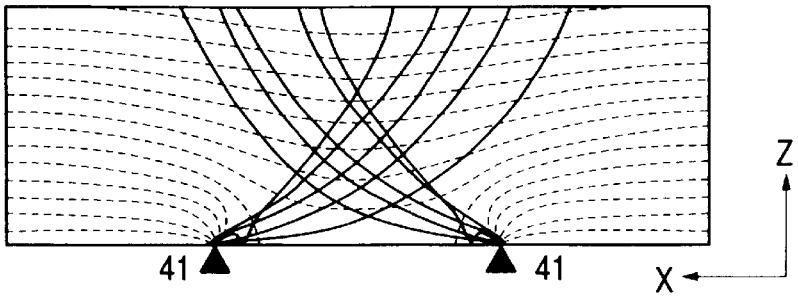

The equipotential line of the third mode in FIGS. 19A and 19B is shown in FIGS. 21A to 21C'. FIGS. 21A, 21B and 21C are diagrams showing changes in the equipotential line when the width W of the high-potential side electrode 4 is altered. FIGS. 21A', 21B' and 21C' are diagrams showing changes in the trajectories of electron beams. A point 41 corresponds to an electron emission point (gap 6).

Figure 26A:
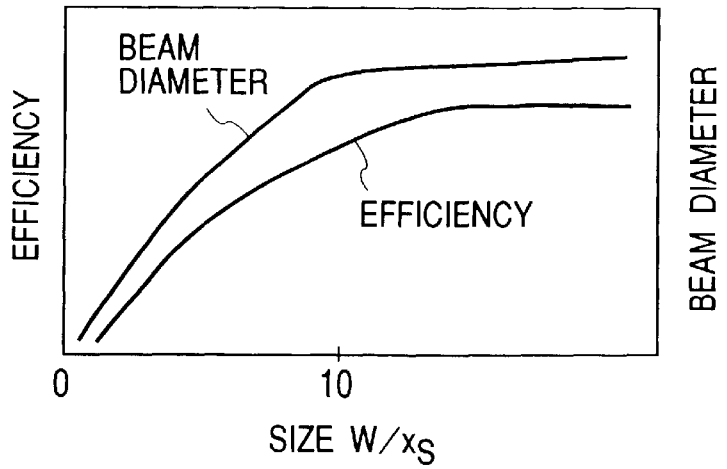
FIGS. 26A, 26B and 26C are diagrams showing the relationship of the width w, of the high-potential side electrode of the basic electron-emitting device of the third mode of the present invention, to the diameter of a beam spot and the efficiency.

As in the first mode, the effect produced by a reduction in the beam diameter is obtained in accordance with the width W of the high-potential side electrode 4. In the third mode, the high-potential side electrode 4 is enclosed by the low-potential side electrode 2 not only in the direction X but also in the direction Y, so that the diameter of the beam spot can be reduced in both directions, X and Y. For the device of this mode, the reduction in the beam diameter is the same as the change in the electron beam spot in the first mode, and in addition, a change in efficiency that is the same as in the first mode is confirmed. This characteristic is illustrated in FIG. 26A. With the square arrangement used in this mode, while taking into account the fact that a phenomenon similar to one in the first mode has appeared, the width set for the high-potential side electrode occupies the same range as the one used for the first mode, while different lengths are employed for the sides of the quadrilateral.

In other words, when the width W is equal to or smaller than 15 times the distance Xs, the effects produced by the reduction in the beam diameter are obtained. Further, when the width W is equal to or smaller than ½ the distance Xs, the efficiency is reduced and no electron beam can be observed.

The shape of the structure viewed from the top of the device (from the anode) is a square, but it may be a circle, an oblong or a rectangle.

According to this invention, when the diameter of the smallest circumscribed circle is defined as Wmax, and the diameter of the largest inscribed circle is defined as Wmin, a range can be employed that is specified in accordance with the distance Xs.

That is, to obtain the effects provided by a reduction in the beam diameter, which determines the upper limit of the range, the diameter Wmax must simply be replaced by the width W, and to obtain the effects provided by a reduction in the efficiency, which determines the lower limit, the diameter Wmin must simply be replaced by the width W.

In FIGS. 19A and 19B, the definitions are provided for Wmax and Wmin for a square device. The length W of each side of the square is defined between Wmin and Wmax.

Figure 22A:
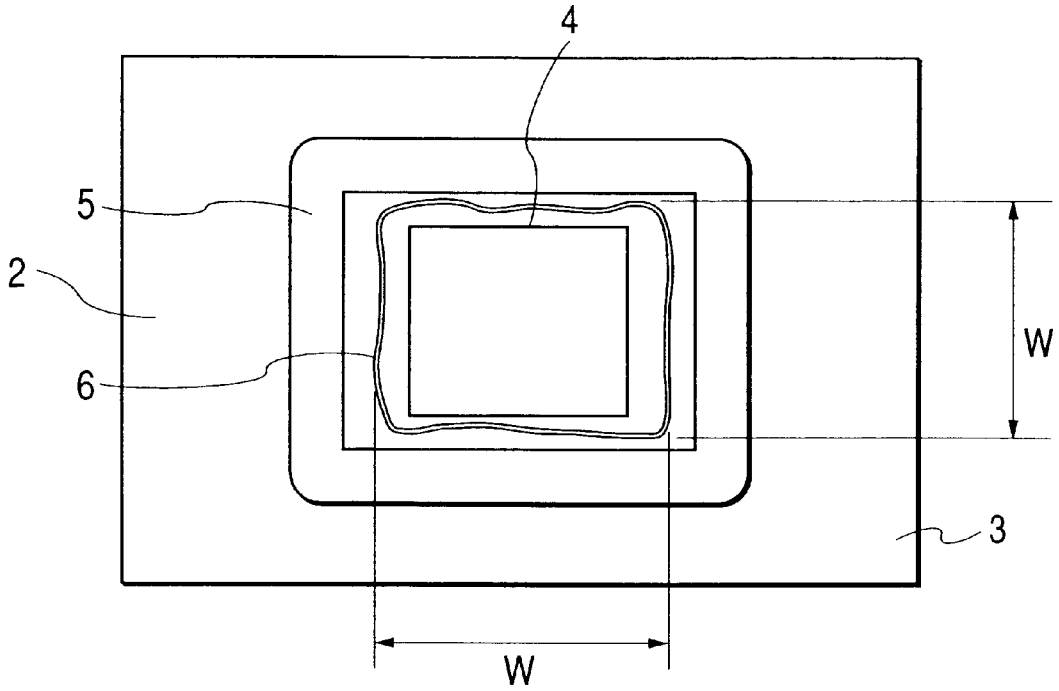
FIGS. 22A and 22B are diagrams showing another example of the electron-emitting device according to the third mode of the present invention.
Figure 22B:
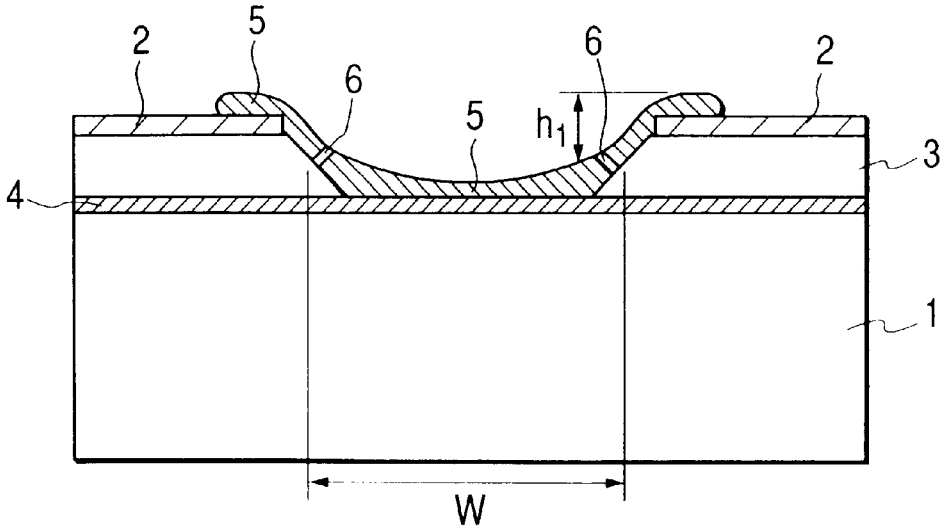
Figure 24A:
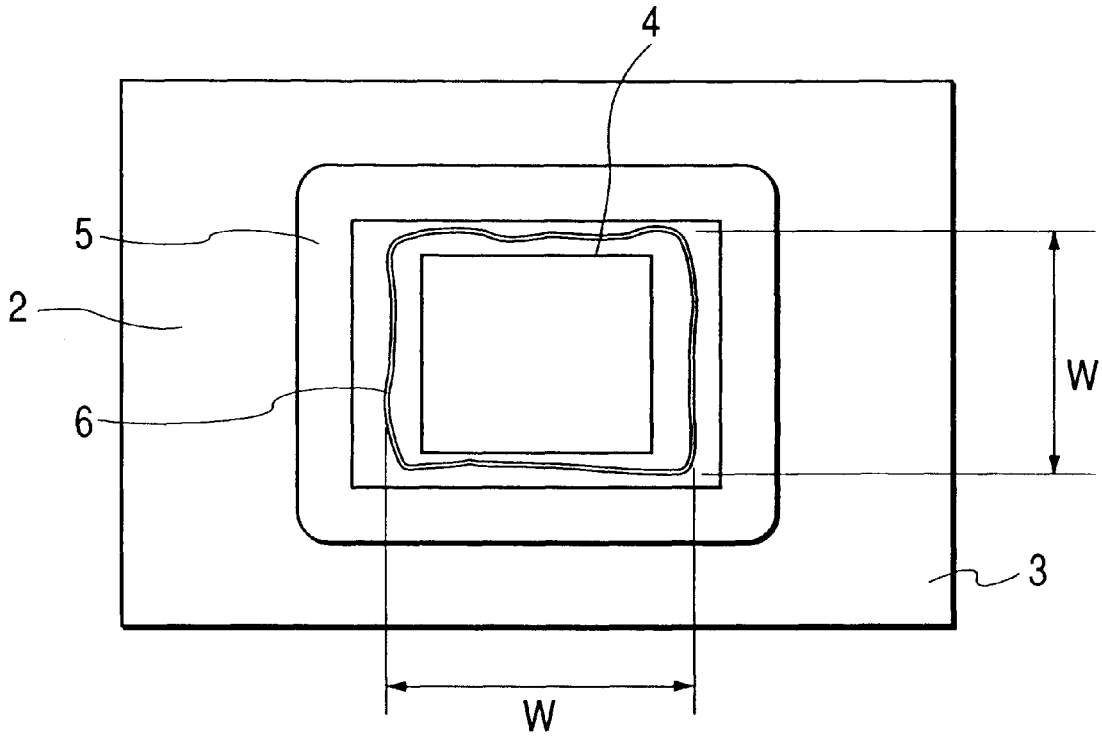
FIGS. 24A and 24B are diagrams showing an additional example of the electron-emitting device according to the third mode of the present invention.
Figure 24B:
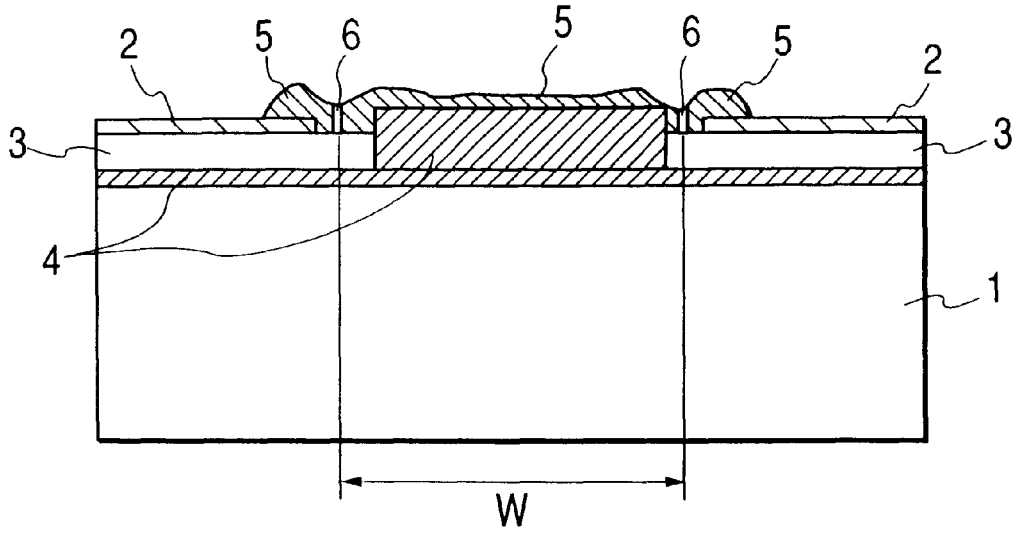

Furthermore, in order to obtain the effects provided by a reduction in the beam diameter, another example can be the step type arrangement shown in FIGS. 22A and 22B, wherein the high-potential side electrode 4, the insulating layer 3 and the low-potential side electrode 2 are laminated together in order to form a recessed structure having a two-dimensional shape, or the step type arrangement in FIGS. 24A and 24B. In this arrangement, when the electrode structure is viewed from the positive electrode (anode) above (in direction Z), the high-potential side electrode appears to be enclosed by the low-potential side electrode.

FIGS. 23A to 23D are diagrams showing a method for fabricating the recessed structure having a two-dimensional shape shown in FIGS. 22A and 22B. FIGS. 25A to 25E are diagrams showing a method for fabricating the plane type structure shown in FIGS. 24A and 24B.

A contact hole is not required for the recessed structure in FIGS. 22A and 22B; this simplifies the fabrication process so that it is similar to that in the first mode. The number of procedures required to fabricate the plane type structure in FIGS. 24A and 24B can also be reduced, when compared with the fabrication procedures for the convex type.

Figure 26B:
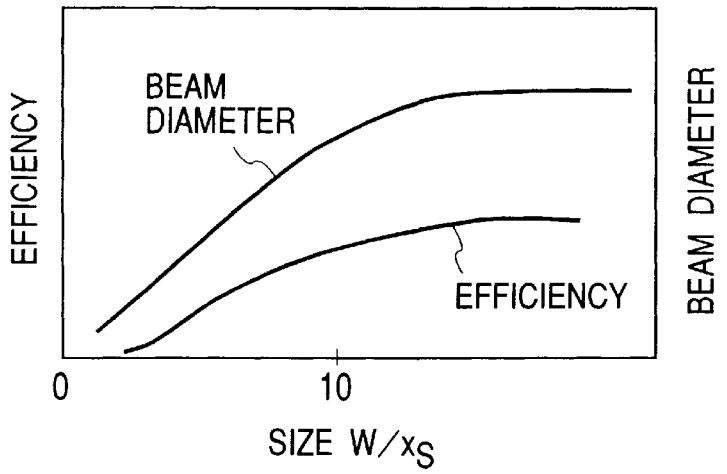
Figure 26C:
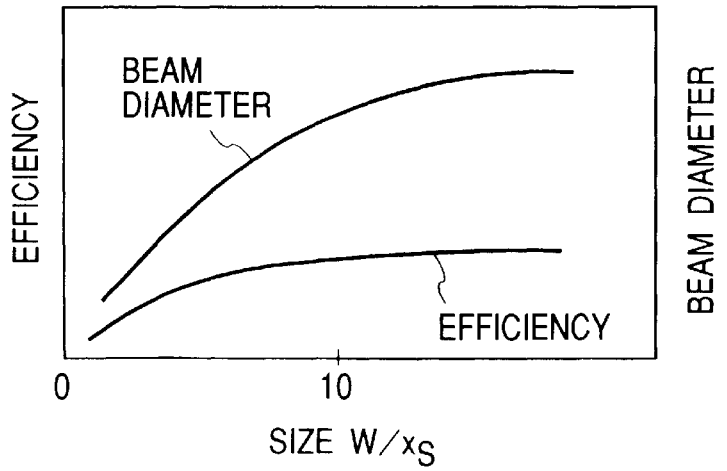

FIGS. 26A to 26C are graphs showing the relationship between the efficiency and the beam diameter for the convex structure in FIGS. 19A and 19B, the plane structure in FIGS. 24A and 24B, and the recessed structure in FIGS. 22A and 22B.

The relationship between the efficiency and the beam diameter for the convex structure is shown in FIG. 26A; the relationship for the plane structure is shown in FIG. 26B; and the relationship for the recessed structure is shown in FIG. 26C.

Since in the third mode the efficiency for the convex structure, as well as the beam diameter, is the highest, that structure is the preferable one.

An explanation will now be given for an example that provides new effects for the third mode.

Figure 27A:
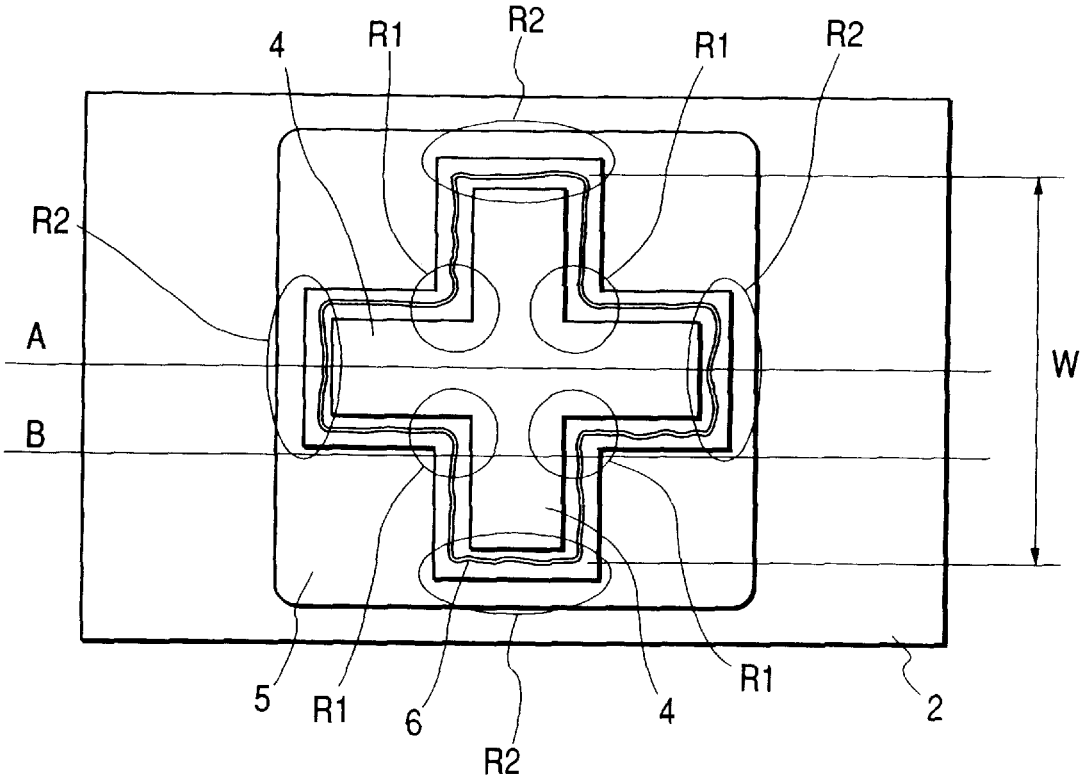
FIGS. 27A and 27B are diagrams showing a further example of the electron-emitting device according to the third mode of the present invention.
Figure 27B:
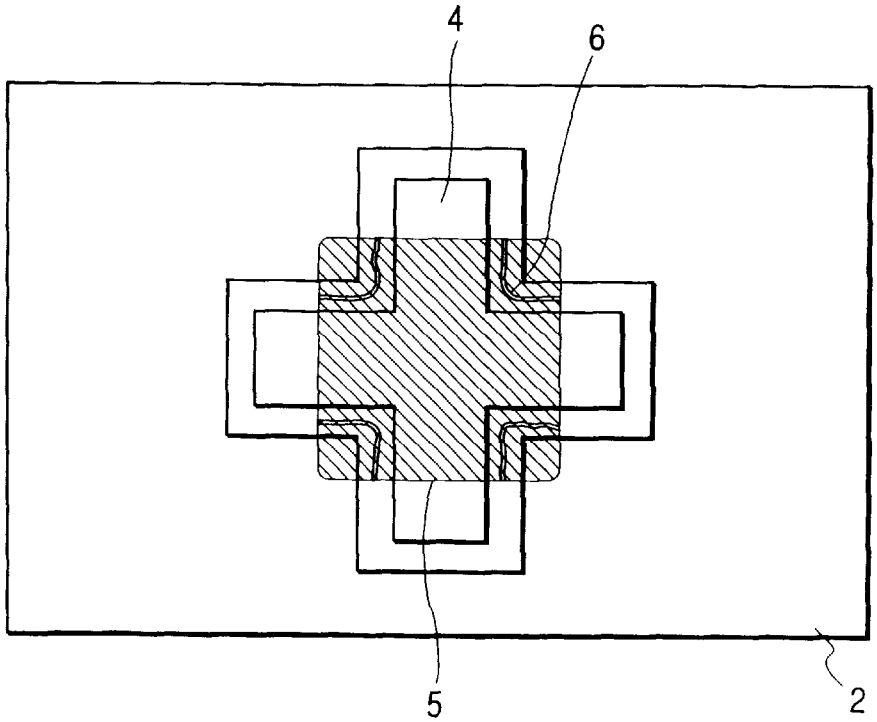

FIGS. 27A and 27B are diagrams showing a high-potential side electrode that has a cross shape when viewed from the anode. In FIG. 27A, a gap 6 is formed around the entire cross-shaped area, whereas in FIG. 27B, gaps 6 are formed inside right angles formed by the straight lines describing the cross-shaped area and within an area that is raised so that it is nearer the high-potential side electrode.

For the first, the second and the third modes of the invention, the "diagram as viewed from the anode" can be a cross-sectional view or a plan view of a face substantially parallel to the first major surface of the substrate 1.

Figure 28A:
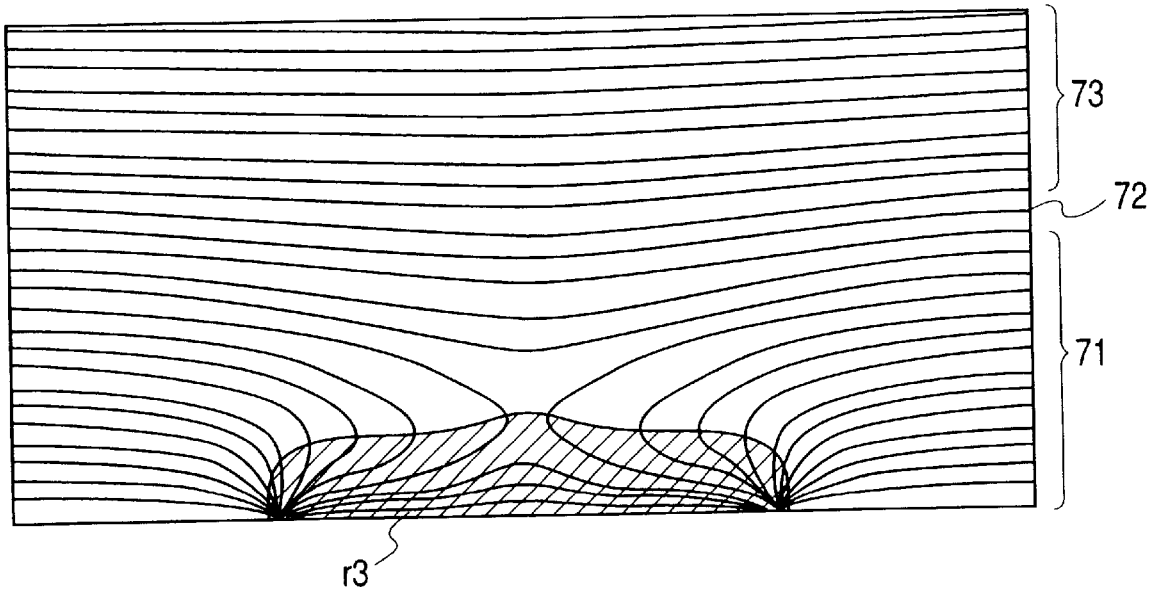
FIGS. 28A and 28B are diagrams showing the equipotential line of the electron-emitting device according to the third mode of the present invention.
Figure 28B:
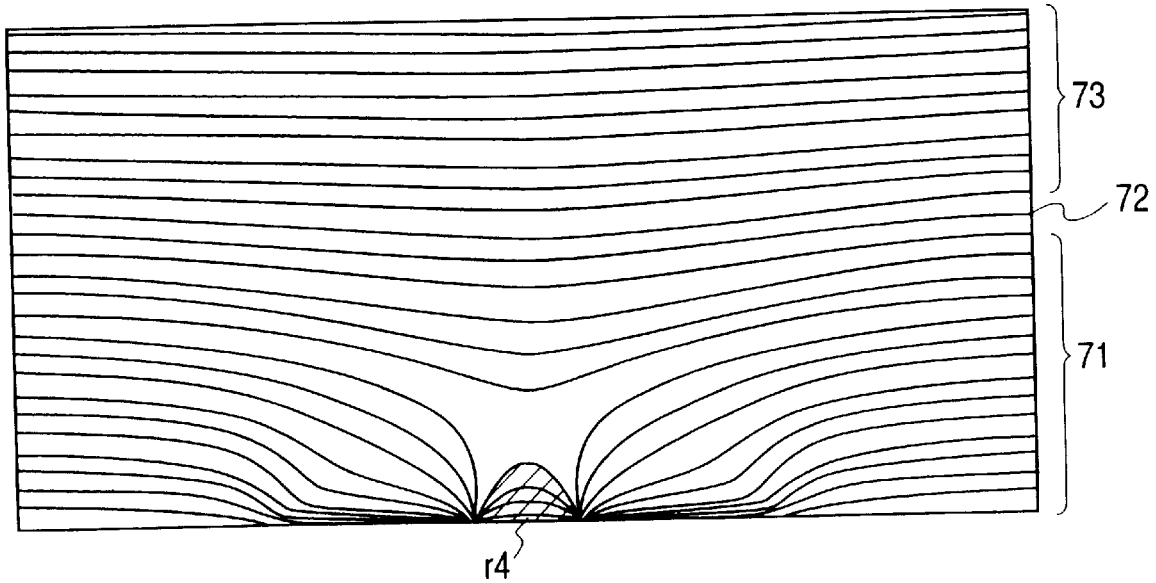

FIGS. 28A and 28B are diagrams showing equipotential lines in cross sections A and B. FIG. 28A corresponds to cross section A, and FIG. 28B corresponds to cross section B. The shaded regions r3 and r4 are those that are affected by the equipotential lines 71, which have a negative potential that is lower than that of the high-potential side electrode. In these regions, a force is exerted on the electrons that moves them toward the high-potential side electrode (negative inclination regions).

As is apparent from FIGS. 28A and 28B, when electrons are emitted in a region (R1 in FIG. 27A) that is raised toward the high-potential side electrode, the equipotential line of the high-potential side electrode is distorted up to a height equivalent to the distance Xs, and the negative gradient region (r4 in FIG. 28B) is deflected and reduced. As a result, it is found that the efficiency is improved. When the equipotential line is distorted, and equals or exceeds a height equivalent to the distance Xs, the electron trajectory is curved, as it is for the square structure in FIGS. 19A and 19B, and as a result, the electrons converge. In the region (R2 in FIG. 27A) that is raised toward the low-potential electrode, the negative gradient region (r3 in FIG. 28A) is expanded, and electrons do not reach the positive electrode 10. Therefore, the affect produced by the beam diameter in the raised region can be ignored.

In addition, in the cross-shaped structure in FIG. 27A, the length of the gap 6, which is a region whereat electrons are emitted, is substantially increased, and the number of electrons that reach the positive electrode 10 is increased. Therefore, it is predicted that the emission current Ie will be increased until it exceeds the current for the square-shaped structure in FIGS. 19A and 19B.

Further, when the gap portion is limited by restricting the region of the electroconductive film 5 in FIG. 27B, the electrons can be emitted only at a region whereat the efficiency is high. It is therefore apparent that the field distribution phenomenon in this case will be the same as the phenomenon described above, so long as the range employed for the width W of the high-potential side electrode corresponds to that which is used in this invention. As a result, when the diameter of the beam is reduced, there will be little deterioration of the efficiency.

As is described above, according to the first, the second and the third modes of the invention, the high-potential side electrode is sandwiched or enclosed by the low-potential side electrode, and the width set for the high-potential side electrode will neither fall short of nor exceed the range proposed by the invention. Thus, any effect produced by the reduction of the beam diameter can be anticipated.

Furthermore, since the high-potential side electrode is positioned higher than the low-potential side electrode (nearer the positive electrode), efficiency can be improved, and the availability of both high resolution and high efficiency can be anticipated.

Examples for which the electron-emitting devices of the first to the third modes can be applied will be described below. Note also that when a plurality of the electron-emitting devices of this invention are arranged on a substrate, an electron source or an image-forming apparatus can be provided.

Various arrangements can be employed for the electron-emitting devices.

As an example arrangement, a number of electron-emitting devices that are arranged in parallel are connected at either end to form multiple arrays of electron-emitting devices in the direction of rows (hereinafter referred to as the row direction), and control electrodes (also called grids) are positioned above the electron-emitting devices, in the direction perpendicular to the wiring (hereinafter referred to as the columnar direction), and control the electrons emitted by the devices. This is called a ladder-shaped arrangement. As another example, electron-emitting devices are arranged as a matrix in directions X and Y, and each, with other electron-emitting devices in the same row, is commonly connected at one electrode to wiring in direction X and, with other electron-emitting devices in the same column, is commonly connected at the other electrode to wiring in direction Y. This is a so-called simple matrix arrangement. The simple matrix arrangement will now be described in detail.

Figure 29:
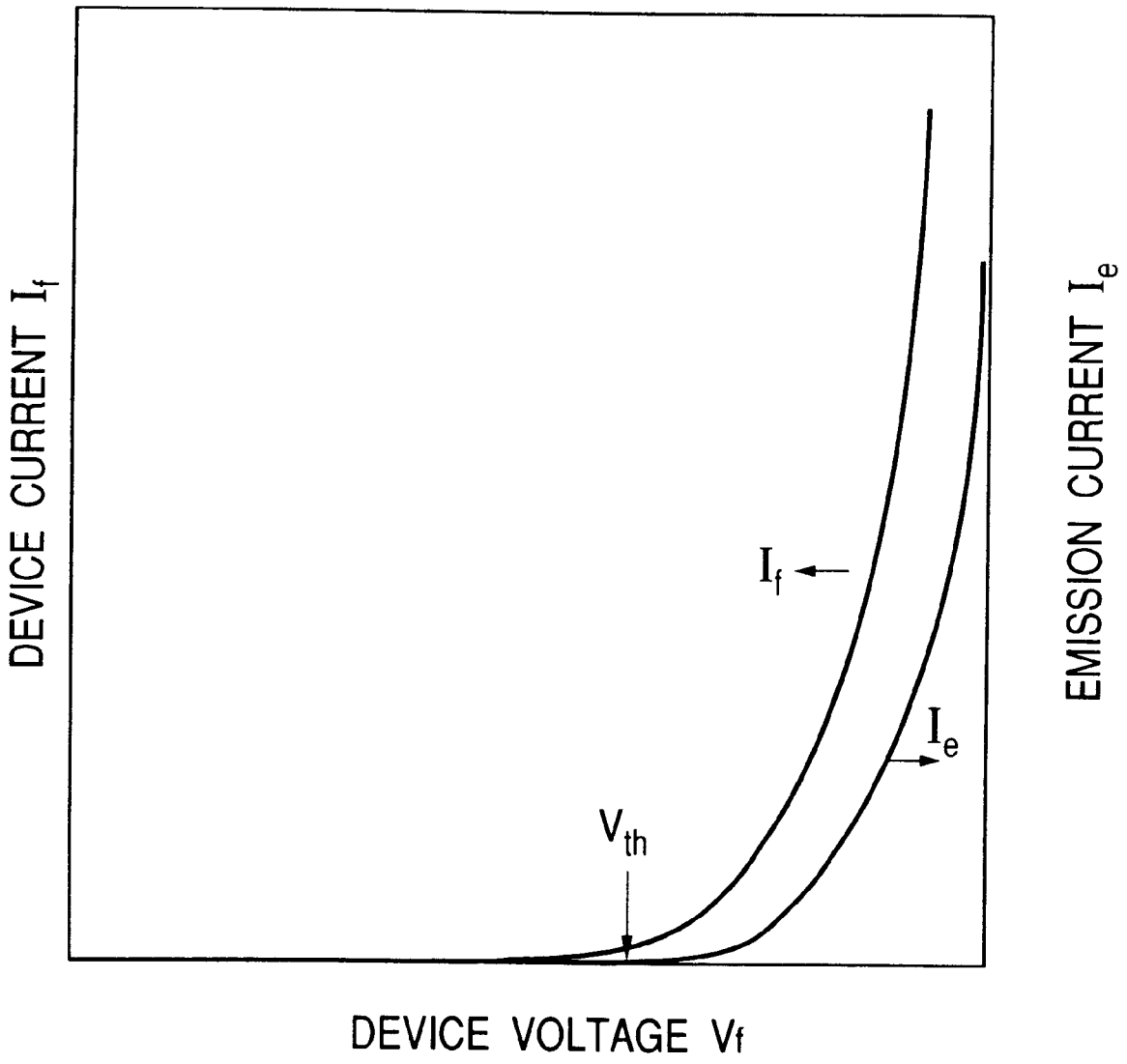
FIG. 29 is a graph showing the VI characteristic of the electron-emitting device according to the present invention.

FIG. 29 is a graph showing the basic characteristic of an electron-emitting devices (the first to the third mode) of the present invention.

At a voltage level equal to or higher than a threshold voltage Vth, electrons are emitted by electron-emitting devices and can be controlled by the pitch value and the width of a pulse voltage that is applied to the device electrodes that are positioned opposite each other. When the voltage level falls below the threshold voltage Vth, however, almost no electrons are emitted. In order to control the volume of the electrons that are emitted, in consonance with the device characteristic, when a pulse voltage is applied as needed to individual electron-emitting devices, a surface conduction electron-emitting device can be selected in accordance with an input signal.

Figure 30:
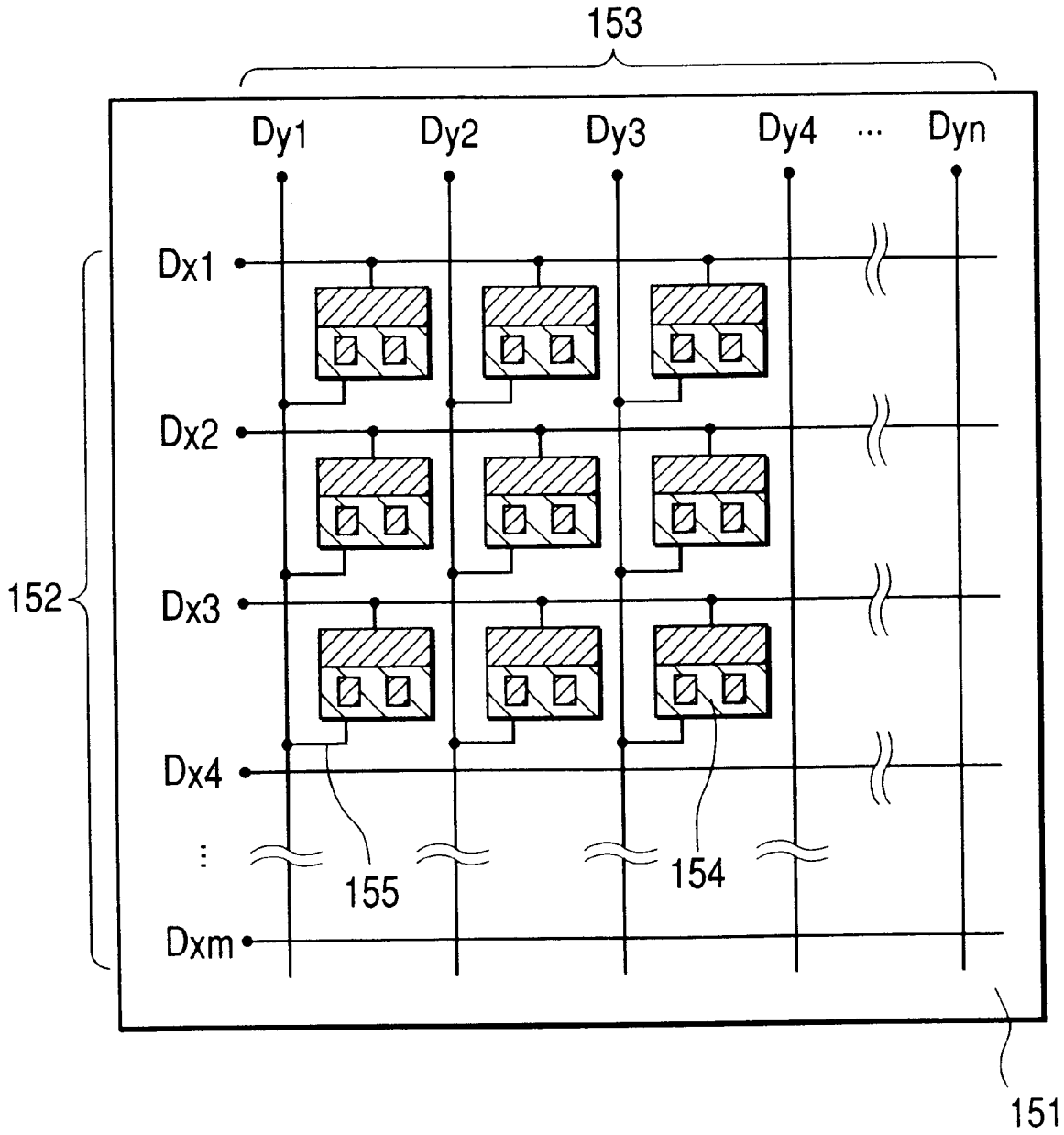
FIG. 30 is a diagram showing the matrix arrangement of an electron source according to the present invention.

Based on this principle, an explanation will now be given, while referring to FIG. 30, for an image-forming apparatus that employs as an electron source an arrangement comprising multiple electron-emitting devices of this invention. In FIG. 30, the electron source comprises an electron source substrate 151, X-directional lines 152, Y-directional lines, electron-emitting devices 154 according to the invention, and connection lines 155.

To form the m X-directional lines 152, DX1 to DXm, an electroconductive metal is deposited by vacuum evaporation, printing or sputtering. The material used, and the thickness and the width of the lines can be arbitrarily selected. The n Y-directional lines 153, DY1 to DYn, are formed in the same manner as the m X-directional lines 152 (both m and n are positive integers), and to electrically separate the lines an insulating inter-layer 91 is formed between them.

The insulating inter-layer 91, composed of $SiO_2$, is deposited by vacuum evaporation, printing or sputtering. The film thickness, and the material and the deposition method that are used can be arbitrarily selected, and the layer 91 may be shaped as desired, covering all or only part of the substrate 151 on which the X-directional lines 152 are mounted, just so long as it can, in particular, resist the potential differences encountered at the intersections of the X-directional lines 152 and the Y-directional lines 153. One end of each of the X-directional lines 152 and of each of the Y-directional lines 153 is extended outward and terminates at an external terminal.

For each surface conduction electron-emitting device 154, a pair of electrodes (not shown) are electrically connected to an X-directional line 152 and to a Y-directional line 153 by connection lines 155 that are formed of electroconductive metal.

As for the material used for the lines 152 and 153, the material used for the connection lines 155, and the material used for the pairs of electrodes, a part or all of the elements of the material may be the same or they may all be different. These materials are selected from among those previously described for the electrodes. When the same material is employed for the electrodes and the lines, a line connected to an electrode can also be called a device electrode.

The X-directional lines 152 are connected to scan signal transmission means (not shown), which transmits a scan signal to select a row of the surface conduction electron-emitting devices 154 that are arranged in the direction X. The Y-directional lines 153 are connected to modulation signal generation means (not shown), which modulates, in accordance with an input signal, the columns of the surface conduction electron-emitting devices 154 that are arranged in the direction Y. A drive voltage that is to be applied to each electron-emitting device 154 is the difference in the voltages of the modulation signal and the scan signal that are transmitted to the pertinent device 154.

With this arrangement, simple matrix wiring is employed to select individual electron-emitting devices and to drive them independently.

Figure 31:
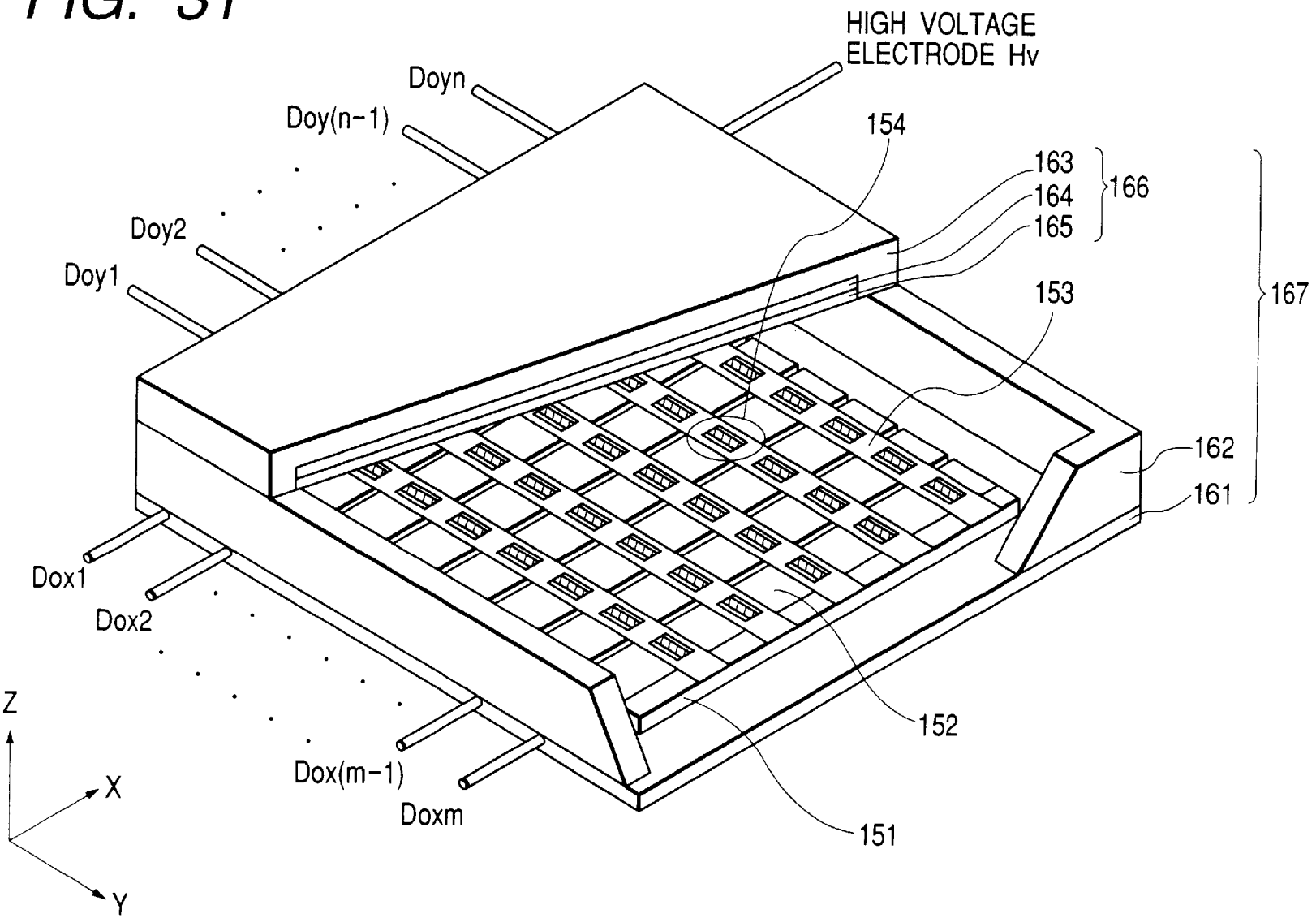
FIG. 31 is a schematic diagram showing the arrangement of the display panel of an image-forming apparatus.

An explanation will now be given, while referring to FIG. 31, for an image-forming apparatus that employs an electron source having the above described simple matrix arrangement. FIG. 31 is a specific diagram depicting an example image forming apparatus. The image-forming apparatus in FIG. 31 comprises: an electron source substrate 151, on which multiple electron-emitting devices are mounted; a rear plate 161, to which the electron source substrate 151 is fixed; and a face plate 166, for which a phosphor film 164 and a metal back 165 are formed on the interior wall of a glass substrate 163. Frit glass is used to connect a support frame 162 to the rear plate 161 and the face plate 166, and a container 167 is sealed and made airtight by annealing it in a nitrogen atmosphere, for example, at a temperature of 400 to 500° C. for at least ten minutes.

Devices 154 correspond to the electron-emitting devices according to the present invention. And pairs of device electrodes mounted on the individual electron-emitting devices 154 are connected to the X-directional lines 152 and the Y-directional lines 153.

As is described above, the airtight container 167 is constituted by the face plate 166, the support frame 162 and the rear plate 161. Since the rear plate 161 is provided mainly for reinforcing the substrate 151, it may not be required if the substrate 151 is strong enough. That is, the substrate 151 may be directly affixed to the support frame 162, so that the airtight container 167 is constituted by the face plate 166, the support frame 162 and the substrate 151. A support member called a spacer (not shown) may also be located between the face plate 166 and the rear plate 161, so that an airtight container 167 can be provided that is strong enough to withstand atmospheric pressure.

Figure 33:
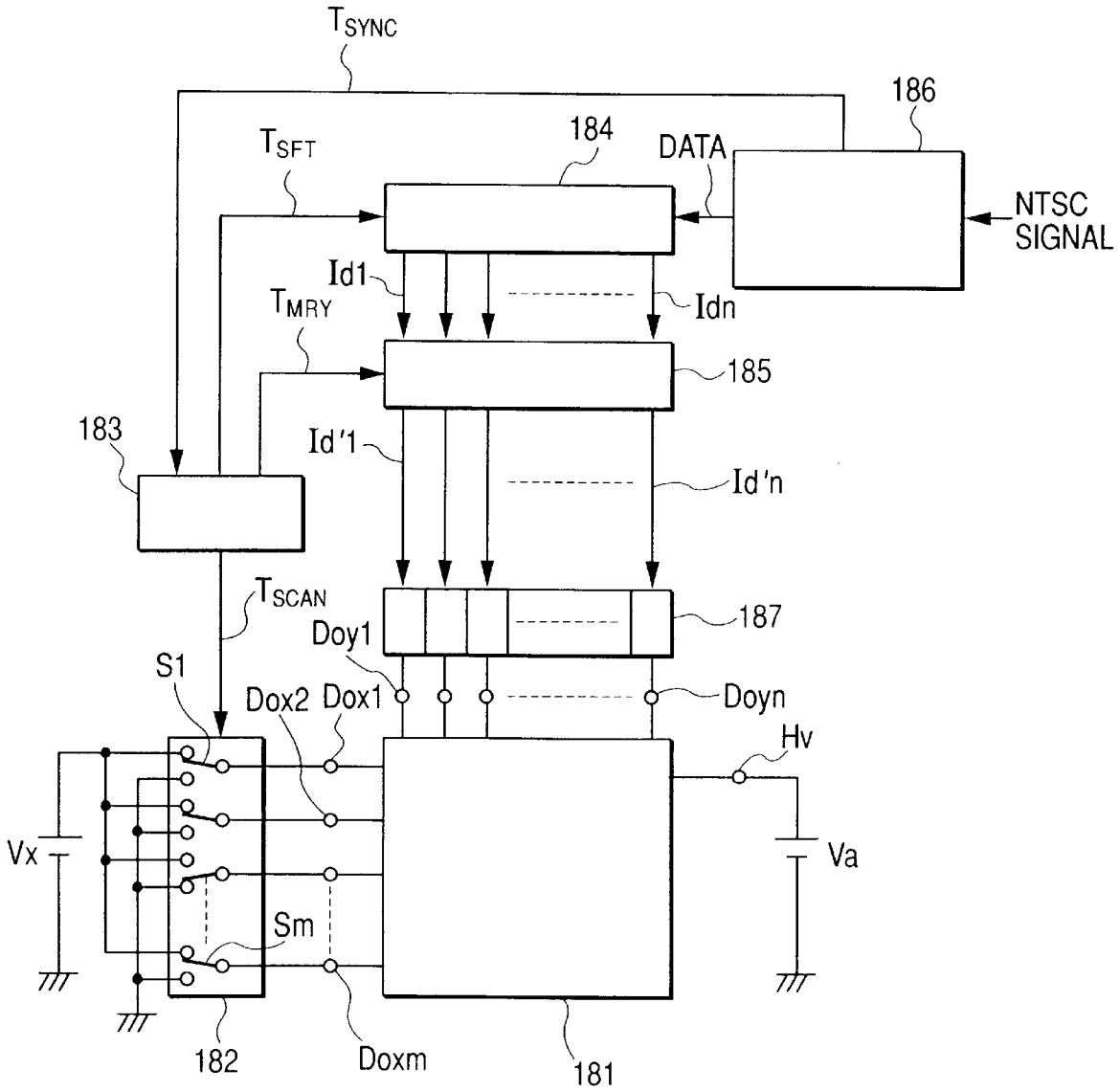
FIG. 33 is a schematic diagram showing the arrangement of the drive circuit in the image-forming apparatus.

An explanation will now be given, while referring to FIG. 33, for the structure of a drive circuit that provides a television display, in accordance with an NTSC television signal, on a display panel (corresponds to the airtight container 167) that is constituted by the electron source having the simple matrix arrangement. In FIG. 33, the drive circuit comprises: an image display panel (the airtight container 167); a scan circuit 182; a controller 183; a shift register 184; a line memory 185; a sync signal separator 186; a modulation signal generator 187; and direct-current voltage sources Vx and Va.

The display panel 181 is connected to an external electric circuit via terminals Dox1 to Doxm, terminals Doy1 and Doyn, and a high-voltage terminal Hv. A scan signal is transmitted to the terminals Dox1 to Doxm to drive the electron source that is provided in the display panel, i.e., each row (N devices) of surface conduction electron-emitting devices that are arranged in a matrix-wired design of M rows by N columns.

A modulation signal is transmitted to the terminals Doy1 to Doyn, to control an electron beam that is output by each of the surface conduction electron-emitting devices in a row that is selected by the scan signal, and a direct-current voltage of 10 K[V] is supplied by the direct-current voltage source Va to the high-voltage terminal Hv. This voltage is an acceleration voltage that provides, for an electron beam that is emitted by a surface conduction electron-emitting device, the energy required to excite a phosphor.

The scan circuit 182 will now be described. The scan circuit 182 includes M switching devices (S1 to Sm in FIG. 33). The switching devices S1 to Sm select either the output voltage supplied by the direct-current voltage source or 0 [V] (ground level), and are electrically connected to the terminals Dx1 to Dxm of the display panel 181. Each of the switching devices S1 to Sm is so designed that it is activated upon receiving a control signal Tscan from the controller 183, and can be constituted by a combination of switching devices, such as FEs.

In accordance with the characteristic (electron emission threshold voltage) of the surface conduction electron-emitting device, the direct-current voltage source Vx in this mode outputs a constant voltage, so that the drive voltage that is supplied to a surface conduction electron-emitting device that is not scanned is equal to or lower than the electron-emission threshold voltage.

The controller 183 adjusts the operations of the individual sections, so that based on an input image signal an appropriate display can be provided. The controller 183 receives a sync signal Tsync from the sync signal separator 186, and generates control signals Tscan, Tsft and Tmry for the individual sections.

The sync signal separator 186 is a circuit for separating into a sync signal element and a luminance signal element an NTSC television signal that is input, and can be constituted by a common frequency separator (filter). The sync signal obtained by the sync signal separator 186 consists of a vertical sync signal and a horizontal sync signal. However, for convenience sake, in this mode a Tsync signal is used in FIG. 33 to represent the sync signal, and a DATA signal, which is transmitted to the shift register 184, is used to represent the luminance signal element obtained by separating the television signal.

The shift register 184 receives the DATA signal in the time series, and performs a serial/parallel conversion of the DATA signal for each line of an image. The shift register 184 begins its operation upon receiving the control signal Tsft from the controller 183 (i.e., the control signal Tsft can be defined as a shift clock for the shift register 184). The data for one image line (corresponds to the data for driving N electron-emitting devices) that are obtained by the serial/parallel conversion are output as N parallel signals Id1 to Idn by the shift register 184.

The line memory 185 is a storage device for storing the data for one image line for a required period of time. In accordance with the control signal Tmry received from the controller 183, the data Id1 to Idn are stored in the line memory 185. The stored contents are thereafter output as data I'd1 to I'dn, and are transmitted to the modulation signal generator 187.

The modulation signal generator 187 is a signal source for appropriately driving the surface conduction electron-emitting devices in accordance with the image data I'd1 to I'dn, and its output signal is transmitted via the terminals Doy1 to Doyn to the devices in the display panel 181.

As is described above, the electron-emitting device of this invention has the following characteristic relative to the emission current Ie.

A specific threshold value Vth is set for electron emission and electrons are emitted only upon the application of a voltage Vth or higher. For the voltage that is equal to or higher than the electron emission threshold voltage, an emission current is varied in accordance with a change in the applied voltage. Therefore, when a pulse voltage smaller than the electron emission threshold value is applied to the electron-emitting device, no electron emission occurs, and when a pulse voltage equal to or higher than the electron emission threshold value is applied to the electron-emitting device, an electron beam is output. At this time, the strength of the electron beam can be controlled by changing the pitch value Vm of the pulse. In addition, the total amount of the charges for the electron beam can be controlled by changing the pulse width Pw.

Therefore, a voltage modulation method or a pulse width modulation method can be employed as the method for modulating an electron-emitting device in accordance with an input signal. When the voltage modulation method is employed, the modulation signal generator 187 can be a voltage modulation circuit that generates a voltage pulse having a constant length, and that modulates the pitch value of the pulse as needed in accordance with input data.

When the pulse width modulation method is employed, the modulation signal generator 187 can be a pulse width modulation circuit that generates a voltage pulse having a constant pitch value, and that modulates the width of a voltage pulse as needed in accordance with input data.

So long as the serial/parallel conversion of an image signal and the storage of data can be performed at a predetermined speed, a shift register 184 and a line memory 185 of either a digital signal type or an analog signal type can be employed.

When the digital signal type register or memory is employed, the signal DATA output by the sync signal separator 186 must be digitized. To cope with this, all that is necessary is for an A/D converter to be provided on the output side of the separator 186. Further, the circuit used for the modulation signal generator 187 is slightly changed, depending on whether the output signal of the line memory 185 is a digital signal or analog signal. Specifically, according to the voltage modulation method for which a digital signal is used, a D/A converter is employed as the modulation signal generator 187, and an amplifier is additionally provided as needed. According to the pulse width modulation method, the modulation signal generator 187 is a circuit that is constituted, for example, by a high-speed oscillator, a counter, for counting the number of waves output by the oscillator, and a comparator, for comparing the output value of the counter with the output value held in the memory. If necessary, an amplifier can be additionally provided to amplify the voltage of a signal acquired using pulse width modulation and output by the comparator, to obtain a drive voltage for the surface conduction electron-emitting device.

According to the voltage modulation method for which an analog signal is used, an amplification circuit that employs an operating amplifier can be used as the modulation signal generator 187, and as needed, a level shift circuit can be additionally provided. According to the pulse width modulation method, for example, a voltage-controlled oscillator (VCO) can be employed, and if necessary, an amplifier can be additionally provided to amplify the voltage and obtain a drive voltage for the electron-emitting device.

In the image-forming apparatus (FIG. 31) that can apply the above described arrangement of the invention, electron emission occurs when a voltage is applied to the individual electron-emitting devices via the terminals Dox1 to Doxm and Doy1 to Doyn on the exterior of the container 181. In this fashion a high voltage can be applied via the high-voltage terminal Hv to a metal back 165 or a transparent electrode (not shown) to accelerate an electron beam, and when the accelerated electrons collide with a phosphor film 164, light is emitted and an image is formed.

The above described arrangement of the image-forming apparatus is merely one example for which the present invention can be applied, and can be variously modified based on the technical idea of the invention. The signal that can be input is not limited to an NTSC television signal; a PAL signal, an SECAM signal, or a TV signal, consisting of multiple scan lines (e.g., a high quality TV signal that includes an MUSE signal) can be employed.

The image-forming apparatus of the invention can be employed as a television broadcasting display apparatus; a display apparatus, such as is used for a television conference system or for computer; or as an optical printer for an image-forming apparatus that includes a photosensitive drum.

The preferred embodiments of the present invention will now be described in detail.

[Embodiment 1]

Figure 34A:
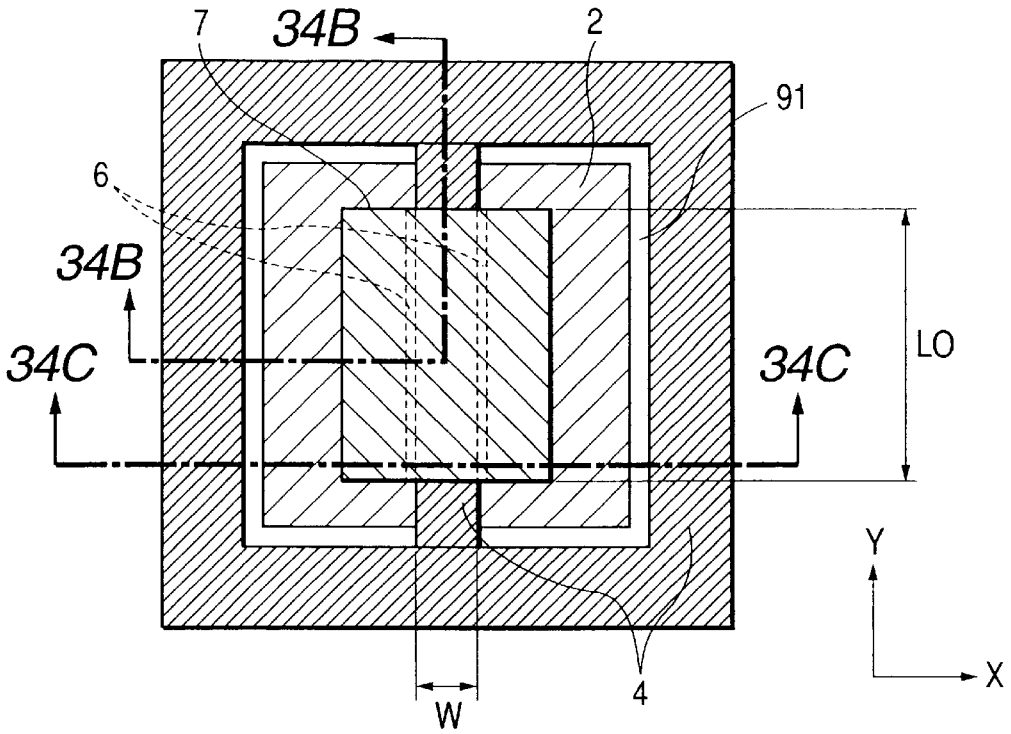
FIGS. 34A, 34B and 34C are a top view and cross-sectional views of an electron-emitting device according to the first embodiment of the present invention.
Figure 34B:
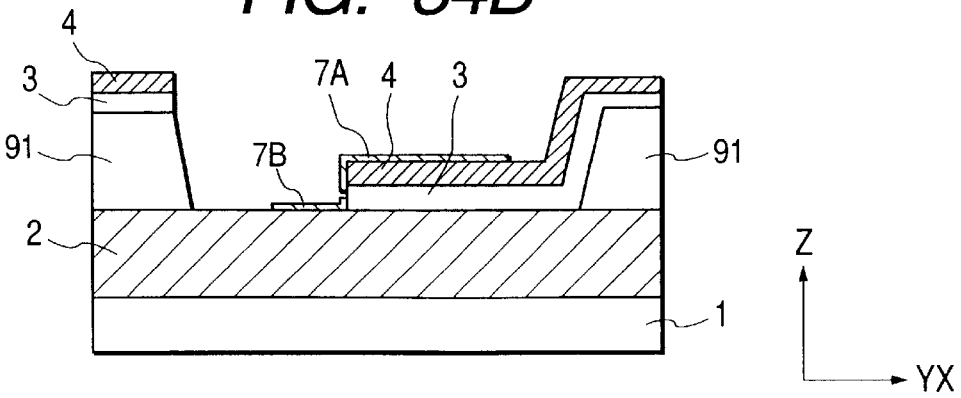
Figure 34C:
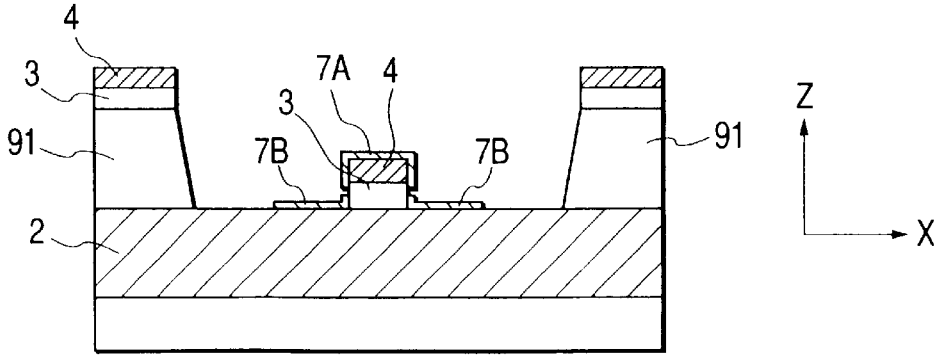

FIG. 34A is a top view (as viewed from an anode) of a ridge-shaped electron-emitting device that is fabricated for a first embodiment. FIG. 34B is a cross-sectional view of the electron-emitting device taken along line 34B—34B in FIG. 34A, and FIG. 34C is a cross-sectional view of the electron-emitting device taken along line 34C—34C in FIG. 34A.

FIGS. 35A to 35E are cross-sectional views, taken along line 34B—34B in FIG. 34A, of an example method for fabricating the electron-emitting device of this embodiment. The structure is constituted by a substrate 1, a low-potential side electrode 2, an insulating layer 3, a high-potential side electrode 4, an electroconductive film 5, and an insulating inter-layer 91 that separates the low-potential side electrode 2 from the high-potential side electrode 4.

The processing steps for fabricating the electron-emitting device in this embodiment will be described in detail while referring to FIGS. 35A to 35E.

(Step 1)

A silica glass substrate was employed as the substrate 1, and was well washed. Then, sputtering was used to form a 300 nm thick electrode layer of Ta, which later served as the low-potential side electrode 2.

Thereafter, photolithography was employed to fashion a resist pattern from a positive photoresist (AZ1500 produced by Clariant (Japan) K.K.).

Figure 35A:
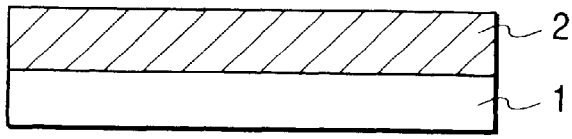
FIGS. 35A, 35B, 35C, 35D and 35E are diagrams showing a fabrication method according to the first embodiment of the present invention.

And then, while using the photoresist pattern as a mask, a $CF_4$ gas was employed to dry etch the Ta layer and to form the low-potential side electrode 2 (FIG. 35A).

(Step 2)

For the insulating inter-layer 91, RF sputtering was used to deposit a 500 nm thick layer of $SiO_2$.

Photolithography was again employed to fashion a resist pattern from a positive photoresist (AZ1500 produced by Clariant (Japan) K.K.).

Figure 35B:
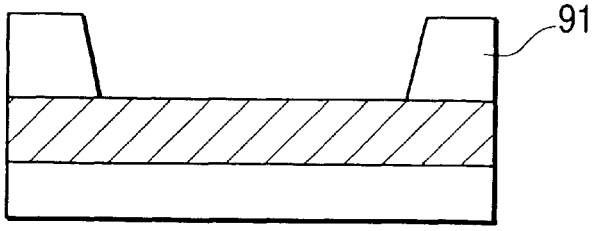

Then, while using the photoresist pattern as a mask, fluorine wet etching of the insulating inter-layer 91 was performed until the low-potential side electrode 2 was exposed (FIG. 35B). At this step, since the oblique cross-sectional shape that is formed by etching is important, it is preferable that an appropriate etching method be selected so that a gradual inclination can be obtained.

(Step 3)

A 50 nm thick layer of $SiO_2$ was deposited as the insulating layer 3, and Ta layer of about 20 nm was deposited as the high-potential side electrode 4.

It should be noted that an appropriate method, such as photolithography, is used to etch the insulating layer 3 and the high-potential side electrode 4 to produce a preferable shape, and that the low-potential side electrode 2 is again exposed to form the ridge. As one method used for forming such a ridge, the photo resist pattern is spin-coated, the mask pattern is exposed and developed, and either wet or dry etching is used to remove a portion of the insulating layer 3 and the high-potential side electrode 4. It is preferable that the etching face be smooth and vertical, and that an appropriate etching method be selected in accordance with the materials used for the electrodes and the insulating layer.

In this embodiment, in the photolithography process, the resist pattern was fashioned by using a positive photoresist (AZ1500 produced by Clariant (Japan) K.K.).

Figure 35C:
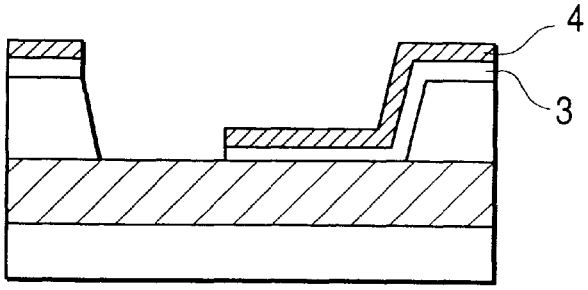
Figure 35D:
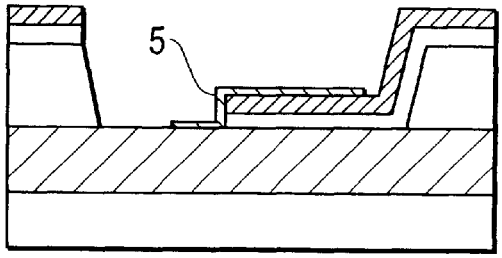
Figure 35E:
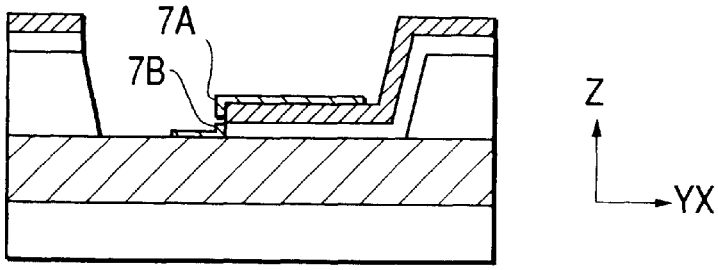

Then, while using the photoresist pattern as a mask, RIE was used to etch the insulating layer 3 and the high-potential side electrode 4. $Cl_2$ gas was selected as the etching gas for the high-potential side electrode 4, and $CHF_3$ gas was selected as the etching gas for the insulating layer 3. While other dry etching conditions vary depending on the size and the arrangement of an apparatus and the size of a substrate, in this embodiment, a pressure of 2.7 Pa and a discharge power of 1000 W (for a substrate size of 300 mm×300 mm) were employed. Since the etching selection ratio of the insulating layer 3 to the low-potential side electrode 2 was equal to or greater than 2, etching was halted when the low-potential side electrode 2 was exposed (FIG. 35C).

(Step 4)

A square opening of 50 $\mu$m in FIG. 34A was formed in the photoresist using photolithography.

Then, a 4 nm thick Pt—Pd film was deposited as the electroconductive film 6. The photoresist was then lifted off and the film 5 in FIG. 34A was formed on the device (lift-off method). Following this, a pulse voltage of 15 V (ON time: 1 msec, and OFF time: 9 msec) was applied to the low-potential side electrode 2 and the high-potential side electrode 4 in the air (this process is called a forming process).

The forming process was terminated when the resistances of both electrodes were 10 MΩ.

Through the forming process, the Pt—Pd film was separated into a film 7B, which is electrically connected to the low-potential side electrode 2, and a film 7A, which is electrically connected to the high-potential side electrode 4. More specifically, through the forming process, a gap 6 was formed in a part of the electroconductive film 5.

When the gap 6 was formed during the forming process, a sheet resistance of $10^3$ to $10^7$ Ω/□ was selected for the electroconductive film 5.

(Step 5)

Figure 11:
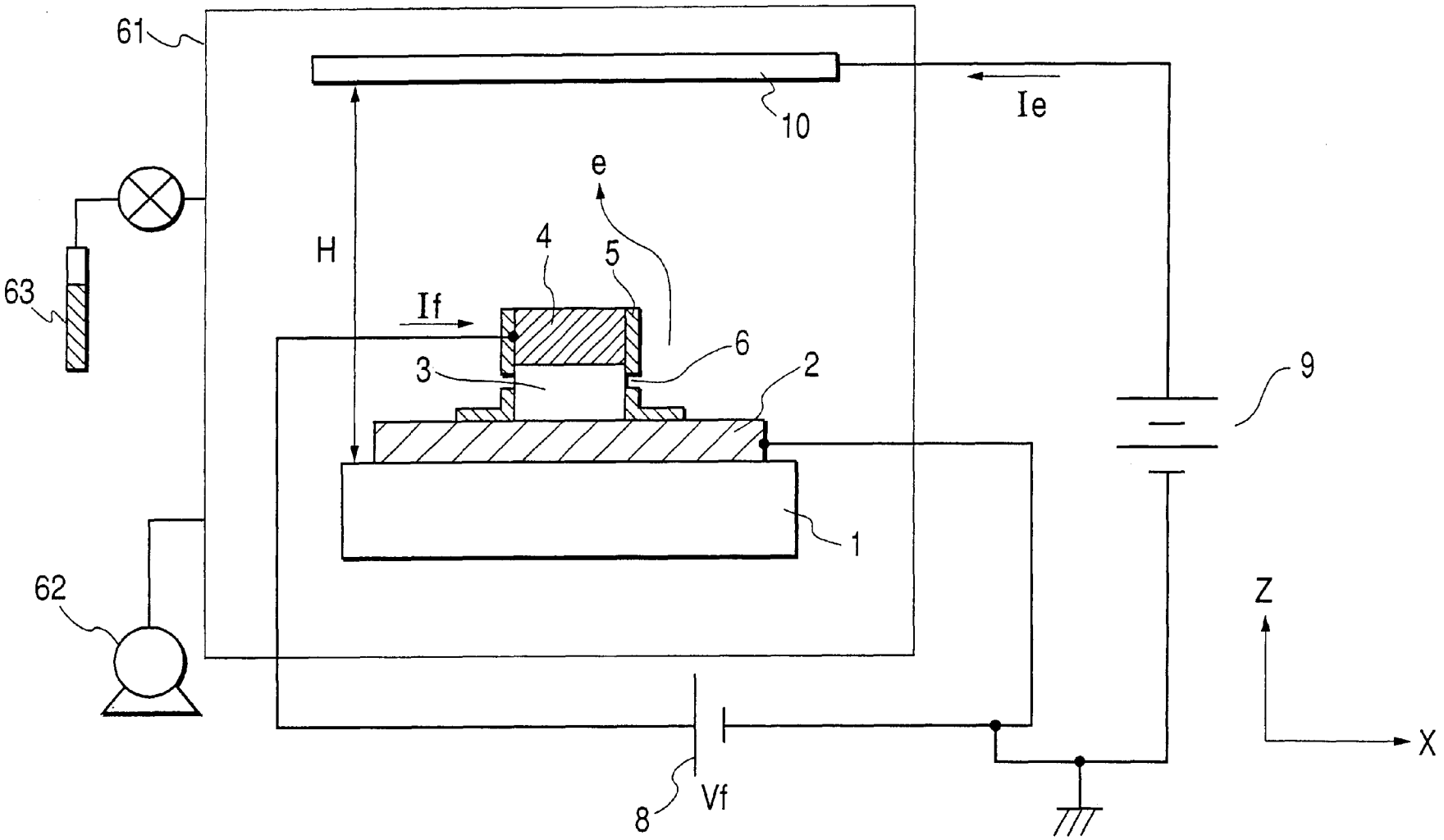
FIG. 11 is a diagram showing an example apparatus and an example process for fabricating the electron-emitting device according to the present invention.

The thus obtained electron-emitting device was placed in the vacuum container 61 in FIG. 11, and air in the container 61 was fully discharged by the vacuum discharge device 62, down to $2\times10^{-6}$ Pa.

Then, as the organic gas 53, BN (benzonitrile) was introduced into the vacuum container 61 until it reached $1\times10^{-4}$ Pa, and in the organic gas atmosphere, a pulse voltage was applied to the low-potential side electrode 2 and the high-potential side electrode 4 and a carbon film was formed around the periphery of the gap 6 (this is called an activation process).

The activation process was terminated when the device current flowing across the low-potential side electrode 2 and the high-potential side electrode 4 became saturated.

As is described above, the activation process, as well as the energization forming, can be performed by repeating the application of a pulse voltage in an atmosphere containing an organic gas. This atmosphere can be obtained by using an organic gas that remains when the air in a vacuum container has been exhausted using an oil diffusion pump or a rotary pump. Further, the atmosphere can also be acquired by introducing an appropriate organic gas into a vacuum container from which air has been satisfactorily exhausted using an ion pump. Since the gas pressure of the organic material varies depending on the application mode, the shape of the container and the type of organic material, an appropriate gas pressure must be set each time. During the activation operation, the organic material that is present in the atmosphere is deposited as carbon film on the device, and the device current If and the emission current Ie are drastically changed.

An appropriate organic material can be: aliphatic hydrocarbon, such as alkane, alkene or alkyne; alcohol; aldehyde; ketone; amine; nitrile; or an organic acid, such as phenol, carvone or sulfonic acid. Specifically, an organic material that can be used is: a saturated hydrocarbon such as methane, ethane or propane, which is represented by $C_nH2n+2$; an unsaturated hydrocarbon such as ethylene or propylene, which is represented by a composition such as GnH2n; benzene; toluene; methanol; ethanol; formaldehyde; acetaldehyde; acetone; methyl ethyl ketone; methyl amine; ethyl amine; phenol; benzonitrile; acetonitrile; formic acid; acetic acid; or propionic acid.

After the vacuum container was fully exhausted and the atmosphere reached $2\times10^{-6}$ Pa again, as is shown in FIG. 2, the high-potential side source 9 was employed to apply the high voltage Va to the positive electrode (anode) 10, and the pulse voltage, which is the drive voltage Vf=15 V, was applied to the device. Then, the drive current If and the electron emission current Ie were measured.

Table 1 shows the beam diameter when the voltage Va=10 kV was applied to the positive electrode (anode) 10 that was located at a distance H=2 mm from the device.

A conventional example is a plane type shown in FIGS. 50A and 50B, and the width W of the high-potential side electrode 4 corresponds to 150 times the characteristic distance Xs.

TABLE 1

| Width W = Xs*n | Beam diameter Bx (μm) | Beam diameter By (μm) |
|---|---|---|
| n = 0.5 | — | — |
| n = 2 | 110 | 300 |
| n = 3 | 220 | 350 |
| n = 7 | 280 | 450 |
| n = 15 | 300 | 500 |
| Conventional example | 300 | 500 |

As is described above, when the width W of the high-potential side electrode was only 0.5 times the distance Xs, an electron beam did not reach the positive electrode (anode) 10 and substantially could not be measured. When the width W was set to 2, 3, 7 or 15 times Xs, the beam diameter was increased.

In FIG. 7, the beam diameter and the efficiency are plotted when the width W of the high-potential side electrode is changed under the above described conditions. It was found that the beam diameter was reduced when the width W was approximately 15 times the distance Xs. Thus, the focusing action was estimated to fall within the range of 0.5 to 15 times the distance Xs. When the width W was 15 times Xs, the efficiency began to be reduced as focus of the beam was changed, and reached substantially 0 when the width W was 0.5 times Xs.

When the width W of the high-potential side electrode of the device was twice the distance Xs, at least three times the efficiency was obtained, compared with the conventional surface conduction electron-emitting device of a plane type (efficiency of about 1%).

In this embodiment Pt—Pd electroconductive film is employed. However, this film is not always required, and may not be deposited in the arrangement.

In this embodiment, the insulating inter-layer is formed on both sides of the essential portion of the electron-emitting device and encloses the portion. However, the insulating inter-layer may be formed on only one side.

[Embodiment 2]

Figure 36:
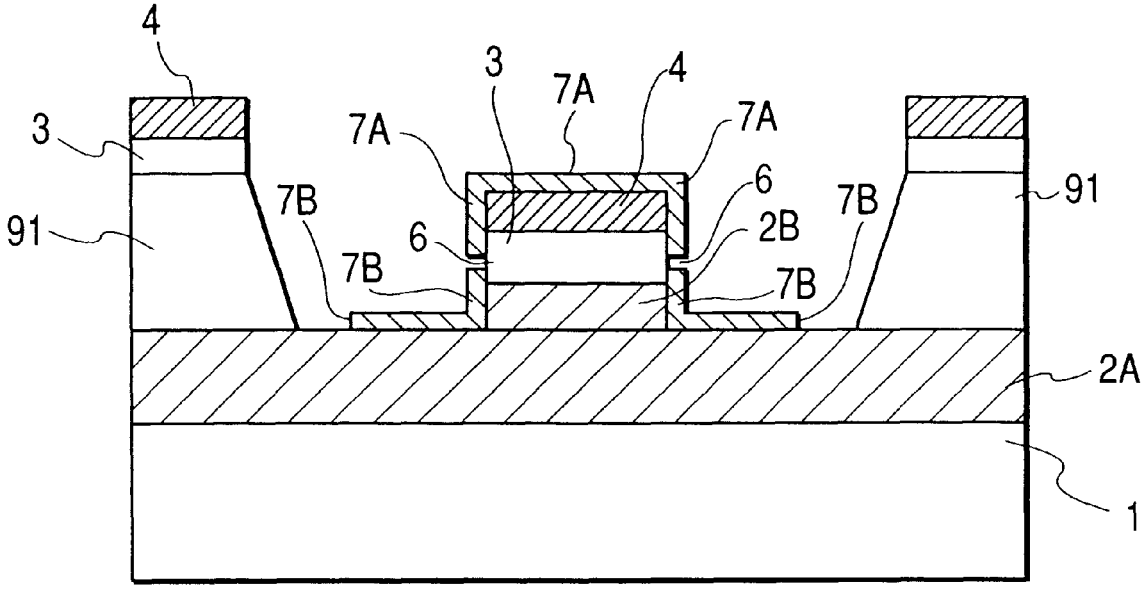
FIG. 36 is a cross-sectional view of an electron-emitting device according to the second embodiment of the present invention.

For a second embodiment, the top view of the electron-emitting device in FIG. 34A is also applied, but an arrangement having a different cross section taken along line 34C—34C is shown in FIG. 36.

Since fabrication processing steps 2, 4 and 5 in this embodiment are the same as those in the first embodiment and only steps 1 and 3 differ, only the steps that differ will now be described.

(Step 1)

A silica glass substrate was employed as a substrate 1, and was well washed. Then, sputtering was used to form a 300 nm thick first low-potential side electrode layer 2A made of Al.

Following this, photolithography was used to fashion a resist from a positive photoresist (AZ1500 produced by Clariant (Japan) K.K.).

Then, while using the photoresist pattern as a mask, wet etching was performed using a phosphoric Al etching liquid to form the first low-potential side electrode 2A.

(Step 3)

A second, 40 nm thick low-potential side electrode 2B made of Ta, a 50 nm thick insulating layer 3, and a 20 nm thick high-potential side electrode layer 4 made of Ta thick were sequentially deposited.

Then, while using the photoresist pattern as a mask, dry etching using a $CF_4$ etching gas was performed for the high-potential side electrode layer 4, the insulating layer 3 and the second low-potential side electrode 2B. The etching was stopped at the first low-potential side electrode 2A by employing a difference between the materials of the first and the second low-potential side electrodes 2A and 2B, i.e., a difference between the selection ratio of Al to the etching gas and the selection ratio of Ta to the etching gas. As a result, the ridge-shaped structure was obtained.

Thereafter, the electron-emitting device was fabricated in the same manner as in the first embodiment.

As well as in the first embodiment, after the air was completely exhausted, the device was driven at a voltage Vf=15 V, and a voltage Va=10 kV was applied to a positive electrode 10 that was located at a distance H=2 mm from the device. Then, the device was evaluated. As a result, compared with the device in the first embodiment, the efficiency was increased by 1.1 to 1.5 times for the devices having the individual widths W. Further, 50 of the devices in the first embodiment and 50 of the devices in the second embodiment were employed, and the variances in the efficiencies were compared. As a result, while the variance in the efficiency was 15% in the first embodiment, the variance for the second embodiment was reduced to 12%.

These results were obtained because of the effect produced by the distance T2 in the cross-sectional view in FIG. 6. That is, since when a large distance T2 is set, the electric field around the periphery of the gap 6 is changed, and the force fall electrons onto the side wall is reduced. Thus, the scattering of electrons on the side wall is reduced, and the efficiency is improved.

It is assumed that a change in the position of the gap along the length of the device, i.e., in the direction Y, is one cause of the variance in the efficiency among electrons. In the second embodiment, since the height of the ridge-shaped structure is greater than that of the first embodiment, the manufacturing variance seems to be small, and accordingly, the variance in the efficiency is also small.

[Embodiment 3]

Figure 37:
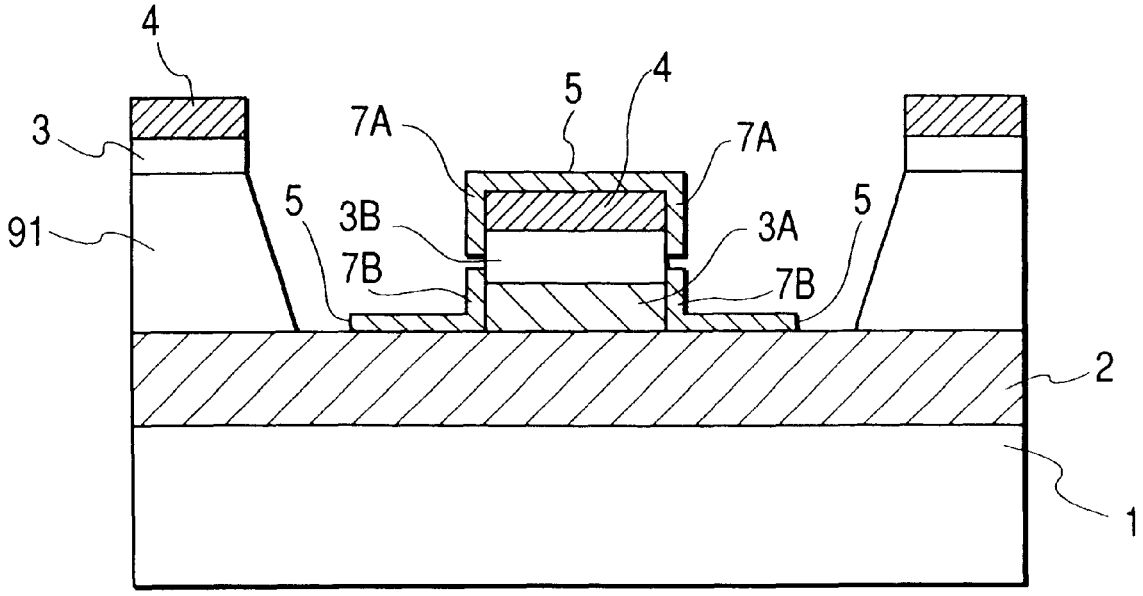
FIG. 37 is a cross-sectional view of an electron-emitting device according to the third embodiment of the present invention.

For a third embodiment, the top view of an electron-emitting device in FIG. 34A is also applied, and an arrangement for which the cross section taken along line 34C—34C is different is shown in FIG. 37.

The fabrication processing is the same as that for the first embodiment, except for step 3.

Since steps 1, 2, 4 and 5 are the same as those for the first embodiment, only step 3 will be explained.

(Step 3)

A first, 50 nm insulating layer 3A made of SiN, a second, 10 nm insulating layer 3B made of $SiO_2$, and a 20 nm high-potential side electrode 4 made of Ta were sequentially deposited.

Then, a positive resist layer (AZ1500 produced by Clariant (Japan) K.K.) was spin-coated, and photolithography was used to expose and develop a photomask pattern and to fashion a resist pattern. Thereafter, while using the photoresist pattern as a mask, RIE was used to sequentially etch the high-potential side electrode 4, the second insulating layer 3B and the first insulating layer 3A. A $Cl_2$ gas was selected as the etching gas for the high-potential side electrode 4; a CHF3 gas was selected as the etching gas for the second insulating layer 3B; and an $SF_6$ gas was selected as the etching gas for the second insulating layer 3A. The RIE condition varies, depending on the size and the arrangement of an apparatus and the size of a substrate, and in this embodiment, a pressure of 5.32 Pa and a discharge current of 1500 W were employed (the size of the substrate was 300 mm×300 mm). The etching was stopped at the low-potential side electrode 2 by making use of the fact that the etching selection ratio of the first insulating layer 3A to the low-potential side electrode 2 was is equal to or greater than three times. As a result, the ridge-shaped structure in FIG. 37 was obtained.

The processes at steps 4 and 5 were performed under the same conditions as in the first embodiment, and a gap 6 was formed in a region near the second insulating layer 3B in the cross section of the ridge, rather than near the first insulating layer 3A, i.e., in a region nearer the high-potential side electrode 4.

The thus obtained electron-emitting device was driven by a voltage Vf=15 V, as in the first and the second embodiments, and a voltage Va=10 kV was applied to the positive electrode 10 that was located at a distance H=2 mm from the device. In the third embodiment, compared with the first embodiment, the efficiency of the device was improved 1.5 to 2 times, and the efficiency variance between the devices was reduced by about 3%.

These results were obtained because the cross-sectional shape of the device differs from that of the first embodiment. That is, in this embodiment, the distance T1 is reduced and the distance T2 is increased.

In the third embodiment, it is not obvious why the gap 6 is selectively formed in the second insulating layer 3B in the forming process. However, the permittivity of the material, the thermal conductivity and other factors can account for it.

To form the first insulating layer 3A in this embodiment, $Al_2O_3$, $Ta_2O_5$ or $TiO_2$ can be employed.

Also in this embodiment, the thickness of the first insulating layer 3A is 50 nm, and the thickness of the second insulating layer 3B is 10 nm. However, the film thicknesses are not limited to these two.

[Embodiment 4]

Figure 38:
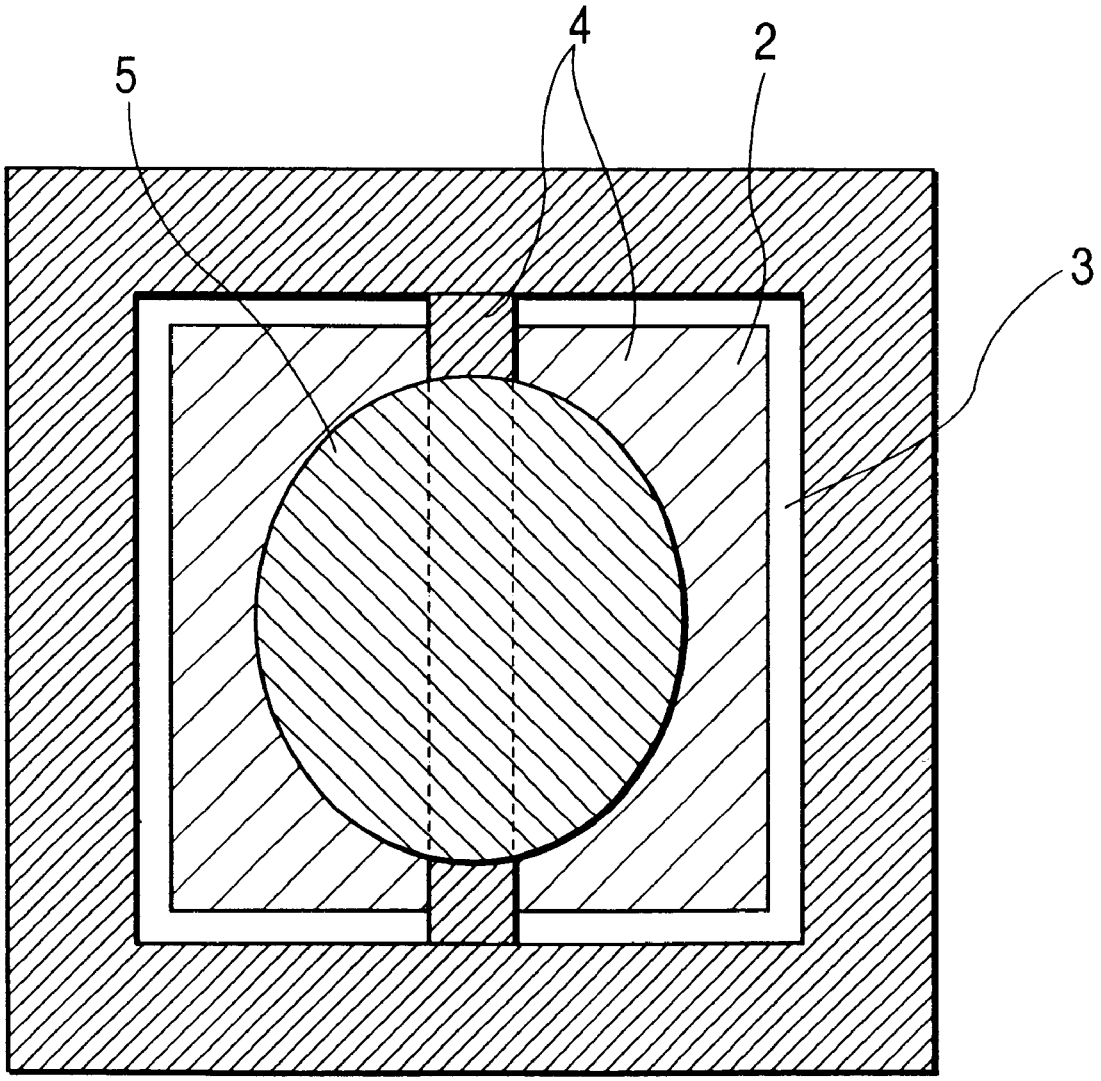
FIG. 38 is a top view of an electron-emitting device according to a fourth embodiment of the present invention.

In the processing for fabricating an electron-emitting device according to a fourth embodiment, step 4 differs from that in the first embodiment. FIG. 38 is a specific plan view of the electron-emitting device for this embodiment.

Since steps 1, 2 and 3 are the same as those in the first embodiment, only step 4 will now be explained. Since the cross-sectional shape is the same as that for the first embodiment, only the plan view is shown.

(Step 4)

Using an ink-jet ejection device, a palladium acetate solution of 0.1 wt % was selectively ejected as droplets onto a portion indicated in FIG. 38. Then, a palladium oxide (PdO) film 5 was formed by heating in the atmosphere at a temperature of 350° C. for ten minutes. The sheet resistance of the film 5 was $10^3$ to $10^5$ Ω/□.

Following this, air in the electron-emitting device was exhausted until a reading was obtained that was equal to or lower than $1\times10^{-3}$ Pa, and a pulse voltage of 7 V in FIG. 12A (ON time: 1 msec, and OFF time: 9 msec) was applied to the low-potential side electrode 2 and the high-potential side electrode 4 in an atmosphere comprising a gas mixture of 98% $N_2$ and 2% $H_2$. A current was supplied to the PdO film 5, and the gap 6 was formed (this is called a forming process). The forming process was terminated when the resistance between the electrodes 2 and 4 was 10 MΩ.

The thus obtained device was driven at a voltage Vf=15 V, as in the first embodiment, and a voltage Va=10 kV was applied to the positive electrode 10 that was located at a distance H=2 mm from the device. In this embodiment, the same efficiency and beam diameter were acquired as were obtained in the first embodiment.

[Embodiment 5]

FIGS. 13A and 13B are a cross-sectional view and a plan view of an electron-emitting device according to a fifth embodiment of the invention. FIGS. 14A to 14D are diagrams showing a method for fabricating the electron-emitting device of this embodiment. The processing for fabricating the electron-emitting device of this embodiment will now be described in detail.

(Step B1)

Figure 14A:
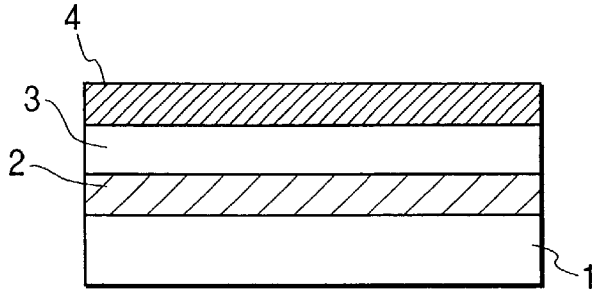
FIGS. 14A, 14B, 14C and 14D are diagrams showing an example method for fabricating the electron-emitting device according to the second mode of the present invention.
Figure 14B:
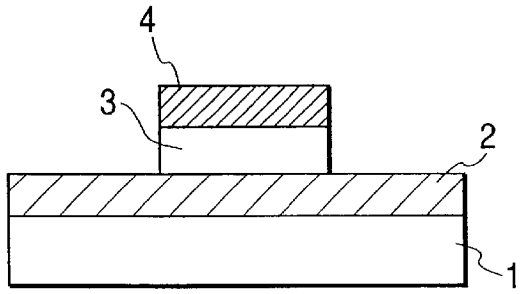

A substrate 1 was made of silica glass and was well washed. By sputtering, a 300 nm thick layer of Ta was deposited as a low-potential side electrode 2, a 50 nm thick layer of $SiO_2$ was deposited as an insulating layer 3, and a 25 nm thick layer of Ta was deposited as a high-potential side electrode 4 (FIG. 14A). Then, using a photolithographic process, a positive photo resist (AZ 1500 produced by Clariant (Japan) K.K.) was spin-coated, a photomask pattern was exposed and developed, and a mask pattern was transferred. Next, while using the photoresist pattern as a mask, dry etching using a $CF_4$ gas was performed for the insulating layer 3 and the high-potential side electrode 4. The etching was stopped at the low-potential side electrode 2, so that a high-potential side electrode 4 having a width W of 5 $\mu$m was formed (FIG. 14B).

(Step B2)

Figure 14C:
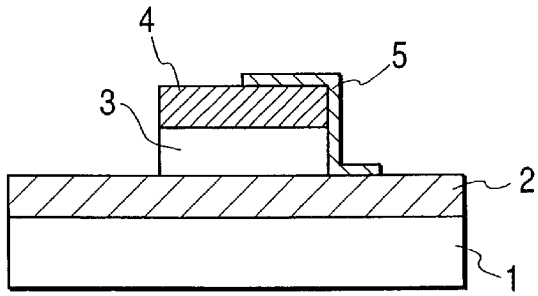

As is shown in FIG. 14C, a 2 nm thick Pt—Pd electroconductive thin film 5 was deposited on the high-potential side electrode 4, the insulating layer 3 and the low-potential side electrode 2. At this time, the length L0 of the deposited Pt—Pd film was 30 $\mu$m. In this case, photolithography was employed to fashion a photoresist, and the Pt—Pd electroconductive film 5 was selectively deposited by ion-sputtering, while one side of the high-potential side electrode was masked by the photoresist.

(Step B3)

Figure 14D:
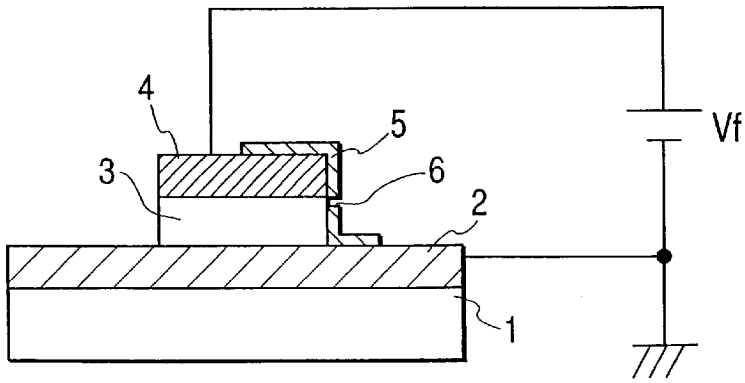

Following this, a pulse voltage (ON time: 1 msec, and OFF time: 9 msec), which had the waveform in FIG. 12B and whose maximum value was 15 V, was applied to the low-potential side electrode 2 and the high-potential side electrode 4 (forming process). During this process, a gap 6 was formed (FIG. 14D). The forming process was terminated when the resistance between the electrodes 2 and 4 was 10 MΩ.

(Step B4)

The electron-emitting device was placed in the vacuum container 61 in FIG. 12, and the air inside was exhausted using the vacuum pump 62. Then, a pulse voltage (ON time: 1 msec, and OFF time: 9 msec) in FIG. 12C was applied to the low-potential side electrode 2 and the high-potential side electrode 4 in an atmosphere of $2.7\times10^{-4}$ Pa wherein BN (benzonitrile) was contained as the organic material 63. A carbon film was therefore formed around the periphery of the gap (activation process). This activation operation was terminated when the device current flowing between the electrodes 2 and 4 became saturated. As a result, an electron-emitting region was formed only on the one side across which the Pt—Pd film 5 was deposited.

The thus obtained electron-emitting device was placed in the vacuum container in FIG. 2, and was driven. The drive voltages were Vf=15 V and Va=10 KV, and the distance H between the electron-emitting device and the positive electrode 10 was H=2 mm. An electrode that had been coated with a phosphor was employed as the positive electrode 10, and the diameter of the electron beam was observed. As a result, a converged electron beam having a diameter of 15 $\mu$m was obtained. The efficiency Ie/If was 2.0%, which is device current If that flows between the high-potential side electrode and the low-potential side electrode of the emission current Ie of an electron that has reached the positive electrode at the top of the device. The drive condition of this embodiment corresponds to region D in FIG. 7, and an efficient electron emitting-device having a small beam diameter could be provided.

When the same device structure was used and the width W of the high-potential side electrode was 8 $\mu$m, the beam diameter was 125 $\mu$m, and the efficiency was 2.5%. The drive condition of this embodiment corresponds to point C in FIG. 7, and an efficient electron-emitting device could be provided, even though the beam diameter is larger than the previously described device.

[Embodiment 6]

A sixth embodiment will now be described as an embodiment for the second mode.

Using the same processing as in the fifth embodiment, a low-potential side electrode 2, an insulating layer 3 and a high-potential side electrode 4 were formed to constitute a ridge-shaped structure. Then, as is shown in FIG. 40, while a metal mask having an opening of 30 $\mu$m was placed obliquely above, a 2 nm thick Pt—Pd electroconductive film 5 was deposited on the side wall in which a gap 6 was to be formed.

Next, the forming process and the activation process were performed in the same manner as in the fifth embodiment.

When the obtained electron-emitting device was driven under the same conditions as in the fifth embodiment, the same beam diameter and the same efficiency were obtained.

According to the method of this embodiment, the photolithographic process is not required to form the electroconductive film 5, and the device in the second mode can be easily manufactured.

[Embodiment 7]

The ridge-shaped structure was formed in the same manner as in the fifth embodiment. Then, a Pt—Pd electroconductive film 5 was deposited on both side walls of the ridge-shaped structure by using a metal mask that had a desired opening. The Pt—Pd electroconductive film 5 formed on one side wall was irradiated with ion beam using the FIB method, and was removed. Following this, the forming precess and the activation process were performed in the same manner as in the fifth embodiment. As a result, as in the fifth embodiment, a gap 6 was formed only in one side wall.

When the electron-emitting device was driven under the same conditions as in the fifth embodiment, the same electron emission function was obtained.

The method used in this embodiment does not require precise alignment in order to deposit the Pt—Pd electroconductive film 5 on one side wall. And even when the width W of the high-potential side electrode is small, the gap 6 can be formed in one side wall, as in the fifth embodiment.

[Embodiment 8]

FIGS. 41A to 41D are diagrams showing an electron-emitting device according to this embodiment and its fabrication method.

(Step B1')

Figure 41A:
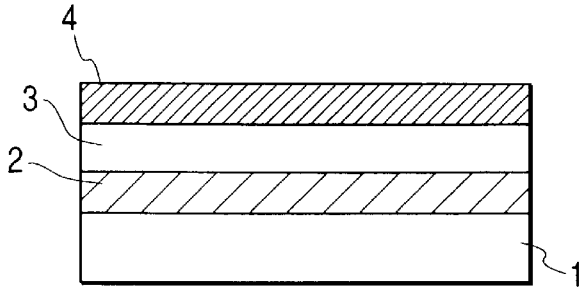
FIGS. 41A, 41B, 41C and 41D are cross-sectional views of an electron-emitting device according to an eighth embodiment of the present invention.
Figure 41B:
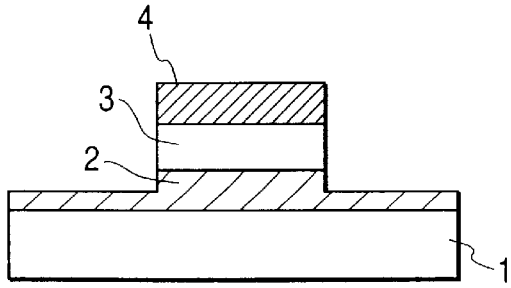
Figure 41C:
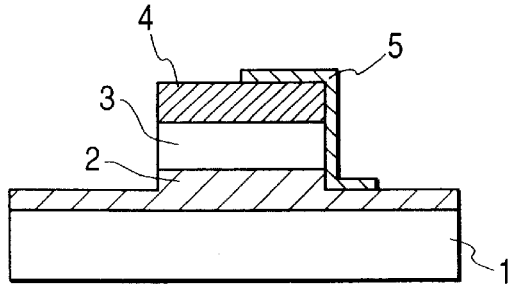

A ridge-shaped structure having a high-potential side electrode width W of 5 $\mu$m was formed in the same manner as in the fifth embodiment (FIGS. 41A and 41B). In this embodiment, in the process for dry etching the $SiO_2$ high-potential electrode 4 and the insulating layer 3, the etching was stopped when the 300 nm thick low-potential electrode 2 had been removed to a depth of 50 nm.

(Step B2)

Figure 41D:
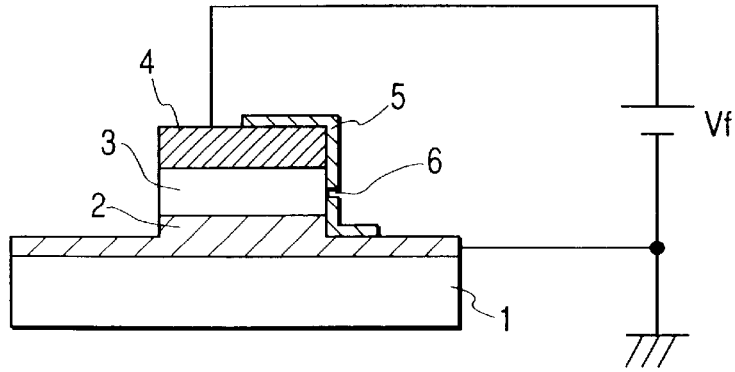

An electroconductive film 5 was formed in the same manner as in the fifth embodiment (FIG. 41C), and the forming process and the activation process were performed to form a gap 6 in only one side wall (FIG. 41D).

When the electron-emitting device was driven in the same manner as in the fifth embodiment, the distance T2 was increased, and the efficiency was improved to 2.5%.

[Embodiment 9]

Figure 42:
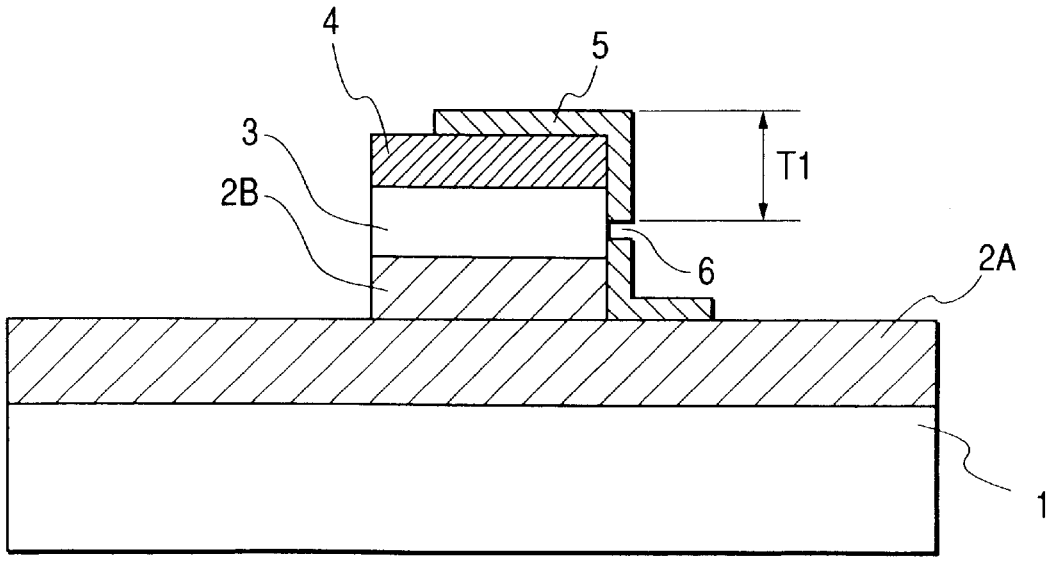
FIG. 42 is a cross-sectional view of an electron-emitting device according to a ninth embodiment of the present invention.

FIG. 42 is a diagram showing an electron-emitting device according to a ninth embodiment, and FIGS. 43A to 43D are diagrams showing its fabrication method.

(Step 1B)

Figure 43A:
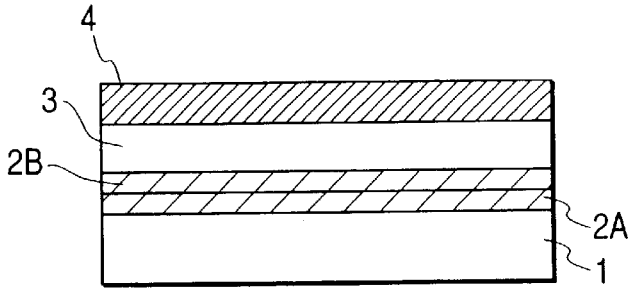
FIGS. 43A, 43B, 43C and 43D are cross-sectional views of a fabrication method according to the ninth embodiment of the present invention.

A first, 300 nm thick low-potential side electrode 2A made of Al was deposited by vacuum evaporation on a silica glass substrate 1 that was well washed. Then, a second, 300 nm thick low-potential side electrode 2B made of Ta was deposited by sputtering. In addition, a 30 nm thick insulating layer 3 made of $SiO_2$ was deposited by sputtering, and a 20 nm thick high-potential side electrode 4 made of Ta was deposited thereon (FIG. 43A).

Figure 43B:
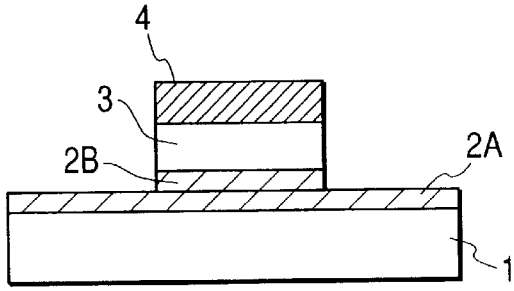
Figure 43C:
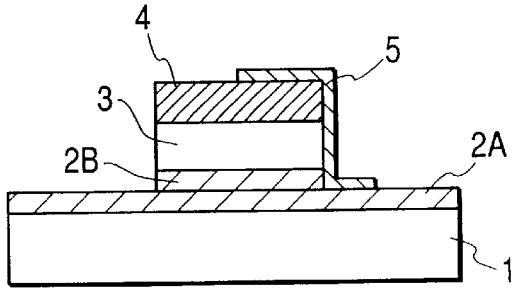
Figure 43D:
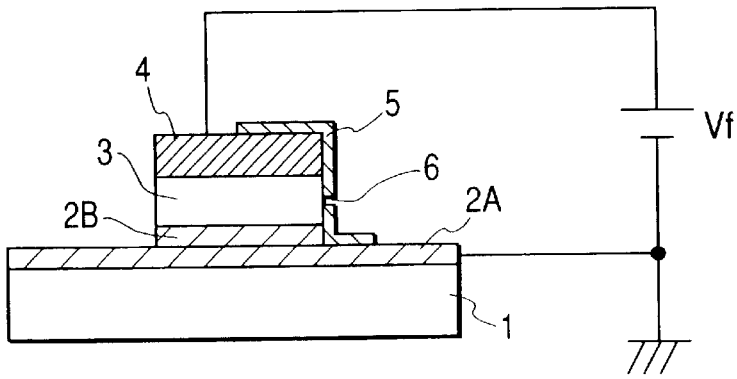

As a result, by employing the photolithographic process used in the fifth embodiment, a ridge-shaped structure having a high-potential side electrode width W=5 $\mu$m was provided (FIG. 43B).

In this embodiment, etching of the second low-potential side electrode 2B made of Ta was continued until the first low-potential side electrode 2A was exposed.

(Step 2B)

Since the same processing was performed after an electroconductive film 5 was formed (FIGS. 43C and 43D), no further explanation will be given for this process.

The thus obtained electron-emitting device was driven under the same conditions as in the fifth embodiment. As a result, the distance T2 was increased, as in the eighth embodiment, and efficiency was improved even more than it was for the device in the fifth embodiment. Further, while the distance T2 was determined by controlling the etching time in the eighth embodiment, the distance T2 in this embodiment was determined by the thickness of the second low-potential side electrode 2B that was laminated. Therefore, the reproductivity of the distance T2 is improved.

[Embodiment 10]

Figure 44:
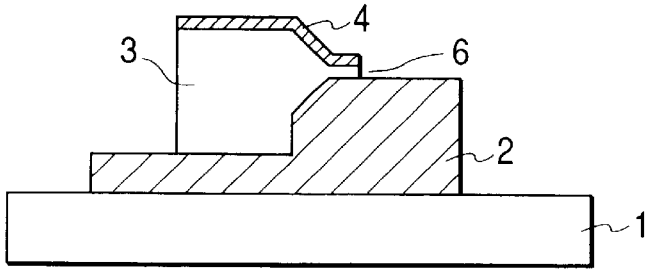
FIG. 44 is a cross-sectional view of an electron-emitting device according to a tenth embodiment of the present invention.

FIG. 44 is a diagram illustrating an electron-emitting device according to a tenth embodiment, and FIGS. 45A to 45D are diagrams showing its fabrication processing.

(Step 1)

Figure 45A:
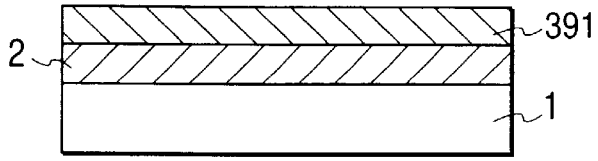
FIGS. 45A, 45B, 45C and 45D are cross-sectional views of a fabrication method according to the tenth embodiment of the present invention.

A substrate 1 made of silica glass was well washed, and a 300 nm thick polycrystal silicon layer 2 and a 300 nm thick silicon nitride film 391 were deposited using the CVD method (FIG. 45A). Since the polycrystal silicon layer 2 is used as a low-potential electrode 2, $P^+$ ions of $2\times10^{16}$ ions/cms were introduced into the structure by ion injection and the structure was electrically activated using a thermal process performed at a temperature of 800° C.

(Step 2)

Figure 45B:
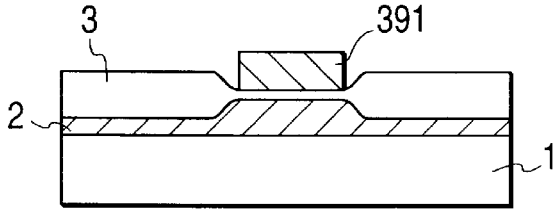

Using lithography, a pattern having a width of 5 $\mu$m was transferred to the silicon nitride film 391 and thermal oxidization was then performed. For this process, the silicon nitride film 391 served as a mask, and in a region where the silicon nitride film 391 was not deposited, a thick oxide film was formed, as an insulating layer 3, on the polycrystal silicon layer 2, while in the area where the silicon nitride film 391 was deposited, a thin oxide film was formed as an insulating layer 3 (LOCOS method) (FIG. 45B).

(Step 3)

Figure 45C:
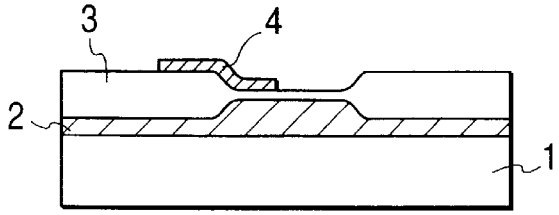
Figure 45D:
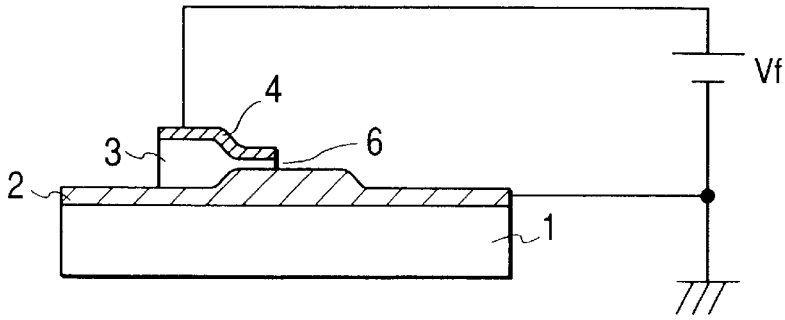

The silicon nitride film 391 was removed, and Ta having a width of 5 $\mu$m and a thickness of 25 nm was deposited as a high-potential side electrode 4 by sputtering (FIG. 45C). And while using the high-potential side electrode 4 made of Ta as a mask, dry etching of the thermal oxide film insulating layer 3 was performed (FIG. 45D).

(Step 4)

The activation process performed at step 4B in the fifth embodiment was performed, and a gap 6 was selectively formed only in the side wall of the thin insulating oxide layer of the ridge-shaped structure. In this embodiment, the deposition process for the electroconductive film 5 and the forming process are not required.

In addition, in this embodiment, when the thickness of the thin oxide film is controlled, the gap 6 can be formed without the activation process at step 4 being performed.

Of course, as in the fifth embodiment, the electroconductive film 5 can be formed on only one side wall, and the gap 6 can be formed by using the forming and activation operations.

[Embodiment 11]

An eleventh embodiment for the second mode of the present invention will now be described.

Figure 17A:
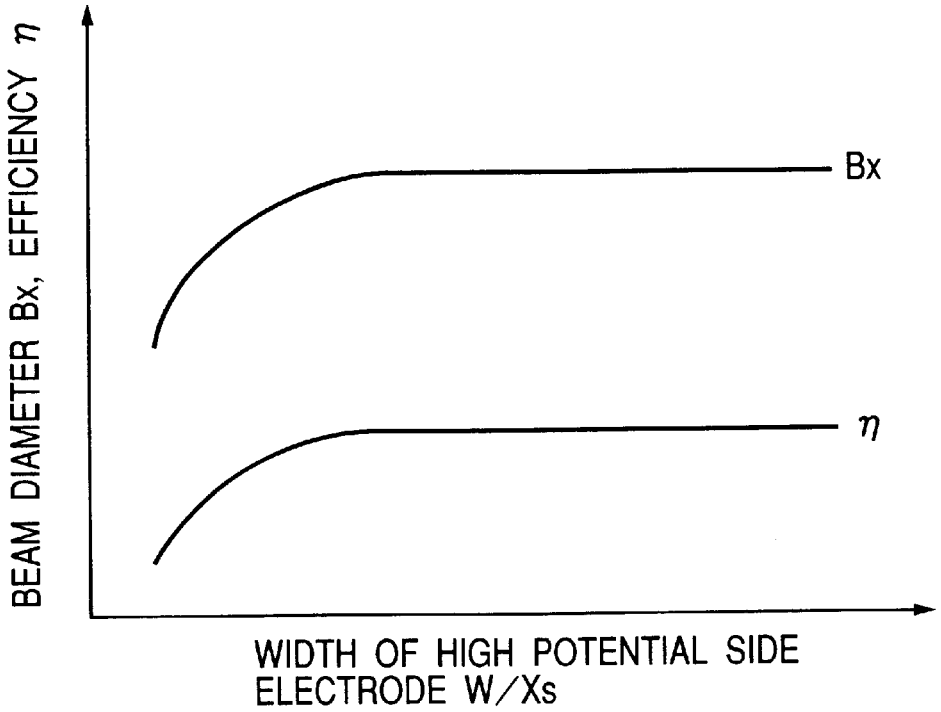
FIGS. 17A and 17B are diagrams showing another example of the electron-emitting device according to the second mode of the present invention.
Figure 17B:
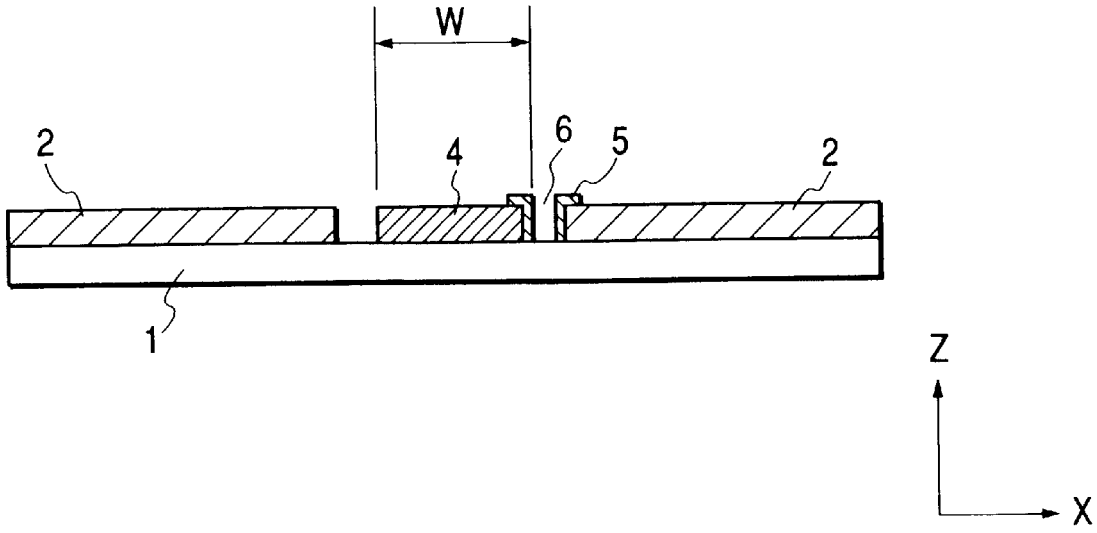
Figure 18A:
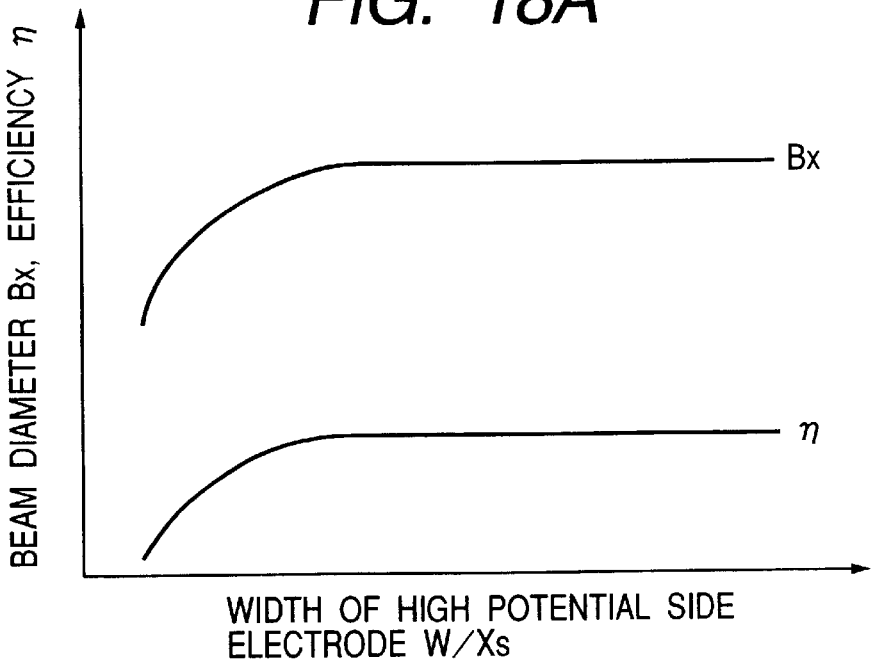
FIGS. 18A and 18B are diagrams showing an additional example of the electron-emitting device according to the second mode of the present invention.
Figure 18B:
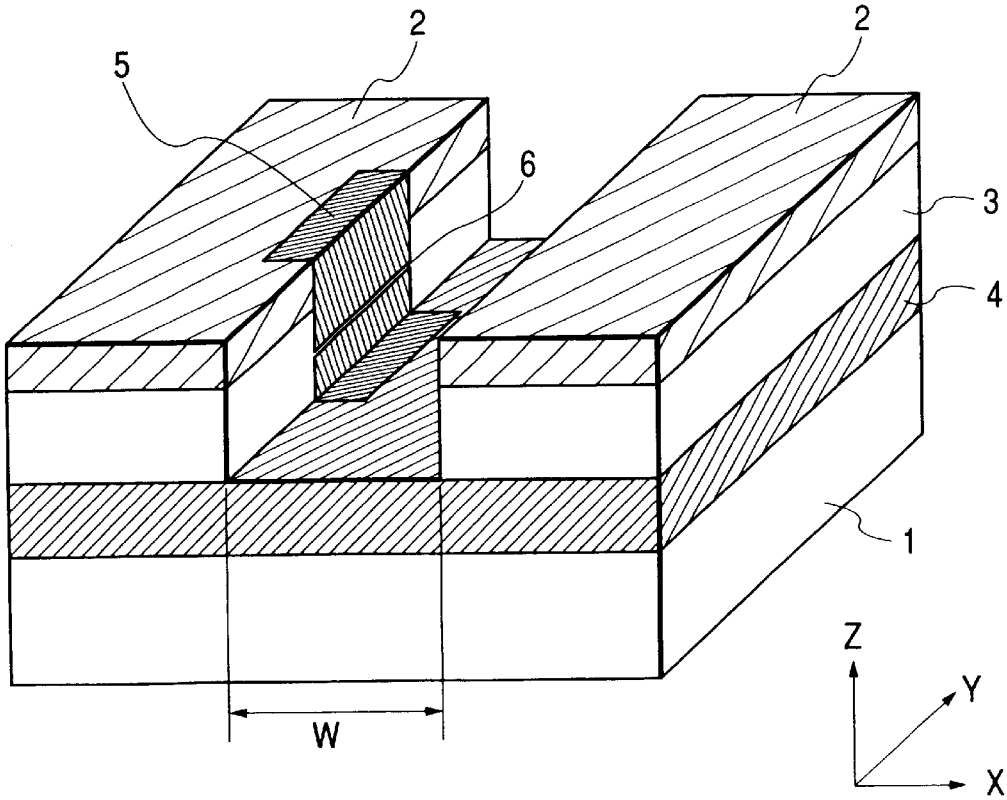

FIGS. 17A and 17B are a graph showing the characteristic of a plane type electron-emitting device, and a diagram showing the plane type structure; and FIGS. 18A and 18B are a graph showing the characteristic of a slit type electron-emitting device, and a diagram showing the slit type structure.

Since the method for manufacturing a slit type structure is substantially the same, except for an etching pattern, as the one used in the fifth embodiment, no explanation for it will be given. Only the method for manufacturing a plane type structure will be briefly described.

(Step 1)

A 300 nm thick layer of Ta was deposited by sputtering on a silica glass substrate 1 that was well washed. Then, using lithography and etching, part of the Ta was removed, and a high-potential side electrode 4 and two low-potential side electrodes 2 were formed at the same time. The high-potential side electrode 4 was sandwiched by the two low-potential side electrodes 2, and the distance between the high-potential side electrode 4, which had a width of 5 $\mu$m, and each of the two low-potential side electrodes 2 was 100 nm.

(Step 2)

Then, a Pt—Pd electroconductive film 5 was formed so that it connected the high-potential side electrode 4 with one of the low-potential side electrodes 2.

Subsequently, the forming process and the activation process in the fifth embodiment were performed to form a gap 6.

When the electron-emitting device was driven under the same conditions as in the fifth embodiment, a beam diameter of 140 $\mu$m and an efficiency of 0.6% were obtained for the plane type structure, and a beam diameter of 140 $\mu$m and an efficiency of 0.45% were obtained for the slit type structure.

The characteristics shown in FIG. 17A and 18A were acquired for the width of the high-potential side electrode. The relationship of the size of the beam diameter and the width W was unchanged for the plane type, the slit type, and the ridge type. The size of the beam was gradually reduced after the width W was reduced until it was equal to or smaller than 15 times the distance Xs. Further, the relationship of the efficiency for the plane type and for the slit type does not differ from that for the ridge type, and the efficiency was reduced after the width W was reduced until it was equal to or smaller than 15 times the distance Xs.

It should be noted that for the plane type and the slit type, compared with the ridge type, the beam diameter was increased and the efficiency was deteriorated.

[Embodiment 12]

FIGS. 19A and 19B, and FIGS. 20A to 20H are diagrams showing a twelfth embodiment for the third mode of the present invention.

The twelfth embodiment employs a convex structure wherein a high-potential side electrode 4 is located higher than a low-potential side electrode 2. FIG. 19A is a top plan view (as viewed from an anode) of an electron-emitting device, and FIG. 19B is a side cross-sectional view of the center portion of the device.

A difference h3 from the top of the high-potential side electrode 4 to the top of the low-potential side electrode 2 was defined as 300 nm. The distance h4 (=T1) from a gap 6 to the top of the high-potential side electrode 4 was set at approximately 200 nm.

FIGS. 20A to 20H are diagrams showing a method for fabricating an electron-emitting device according to this embodiment.

In FIG. 20A, a silica glass substrate 1 was well washed, and a 300 nm thick thin film made of Ta was deposited thereon as one part of the high-potential side electrode 4. Then, the structure was patterned using photolithography to form a resist pattern, and dry etching was performed to obtain a part of the high-potential side electrode 4 having a desired shape.

In FIG. 20B, the structure was patterned using photolithography to form a resist pattern, and 100 nm of $SiO_2$ was deposited as an insulating inter-layer 91.

In FIG. 20C, the structure was patterned using photolithography to form a resist pattern, and 100 nm of Ta was deposited as the low-potential side electrode 2.

In FIG. 20D, the structure was patterned using photolithography to form a resist pattern, and 300 nm of $SiO_2$ was deposited as the insulating layer 3.

In FIG. 20E, the structure was patterned using photolithography to form a resist pattern, and the insulating layer 3 was partially removed by dry etching .

In FIG. 20F, a hole was formed in the structure, and Ta was laminated in the hole, so that the high-potential side electrode 4 that would be formed later could be connected to an underlayer.

In FIG. 20G, the structure was patterned by the photolithography to form a resist pattern, and the 100 nm high-potential side electrode 4 of was laminated to bury the hole.

Figure 20H:
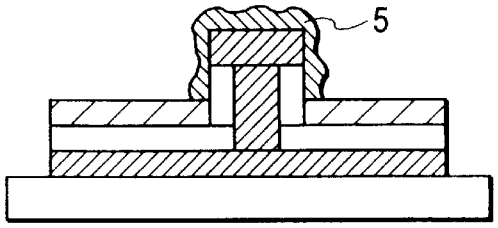

In FIG. 20H, the structure was patterned using photolithography, and a 4 nm thick Pt—Pd electroconductive film 5 of was deposited. Thereafter, the photoresist was removed.

Following this, the forming process and the activation process, as in the first embodiment, were performed, and a gap 6 was formed in a part of the Pt—Pd electroconductive film 5.

In this embodiment, as well as in the first embodiment, the high-potential side electrode 4 and low potential side electrode 2 was employed to apply a pulse drive voltage Vf=15 V to the electron-emitting device, and to apply a high voltage Va=10 kV to the positive electrode 10 that was located at a distance H=2 mm from the device. Also the dence current If that was supplied and the electron emission current Ie were measured. Furthermore, phosphor was employed as the positive electrode 10 in order to measure the beam diameter.

As for the beam spot shape, the luminance pattern was formed immediately above the electron-emitting device, and the center of the pattern substantially matched the center of the electron-emitting device. In this embodiment, the luminance pattern is substantially shaped like a circle.

In the graph in FIG. 26A, the horizontal axis represents the length W of one side of the high-potential side electrode 4 in a substantially square shape that constitutes the electron-emitting device for this embodiment. The length W is standardized by using the distance Xs, and the vertical axis represents the beam diameter. As is apparent from this graph, the convergence effects can be obtained when the width W is set equal to or smaller than 15 times the distance Xs.

Table 2 shows the beam diameter of the conventional electron-emitting device shown in FIGS. 50A and 50B, and the beam diameter of the electron-emitting device in this embodiment when the width of the high-potential side electrode (the length of one side of a square in this embodiment) is 1 $\mu$m, 2 $\mu$m and 6 $\mu$m. It is apparent from table 2 that the beam diameter becomes small as the width W becomes small. In other words, as the width W becomes small, the beam resolution becomes high.

TABLE 2

| | Beam diameter By | Beam diameter Bx |
|---|---|---|
| Conventional electron source | 0.4 mm | 0.16 mm |
| Electron source in this embodiment (W = 1 $\mu$m) | 0.10 mm | 0.11 mm |
| Electron source in this embodiment (W = 2 $\mu$m) | 0.13 mm | 0.13 mm |
| Electron source in this embodiment (W = 6 $\mu$m) | 0.27 mm | 0.26 mm |

When the width W is reduced, the efficiency is extremely low, and electrons may not reach the positive electrode (anode). Therefore, it is requested that the width W be larger than ½ the distance Xs.

Generally, it is apparent that, when, as in the embodiment, the high-potential side electrode 2 is located near the positive electrode 10 rather than near the low-potential side electrode 2, the efficiency is improved and is 2 to 10 times higher than the conventional example.

Furthermore, it was found that as the height h4 (=T1) from the gap 6 to the high-potential side electrode 4 in FIGS. 19A and 19B becomes smaller, the rate whereat the electrons reached the positive electrode 10 is increased. Therefore, a small height h4 is preferable.

Figure 48A:
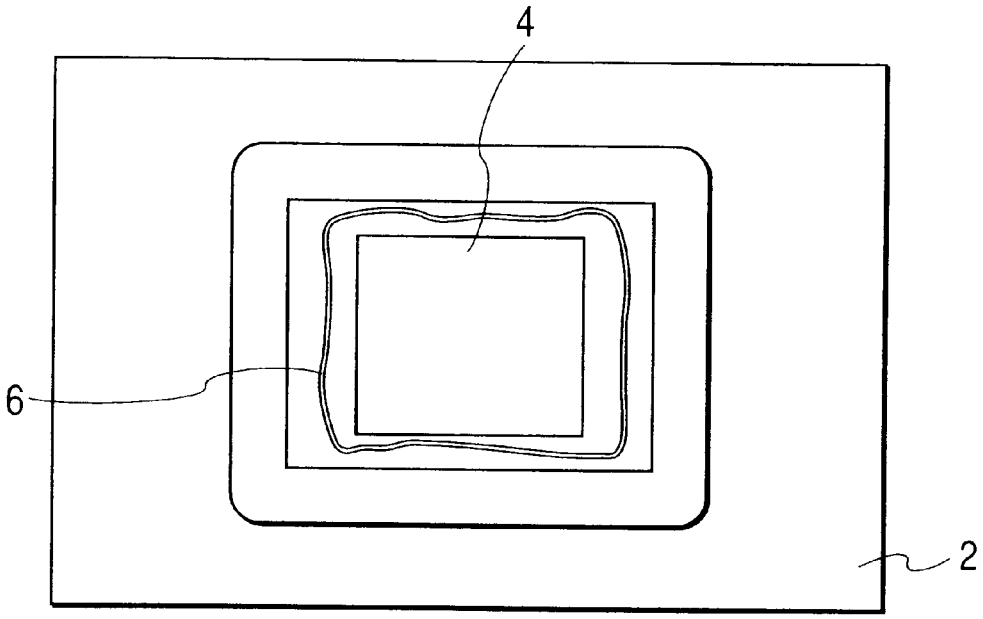
FIGS. 48A and 48B are a top view and a cross-sectional view of an electron-emitting device according to a fifteenth embodiment of the present invention.
Figure 48B:
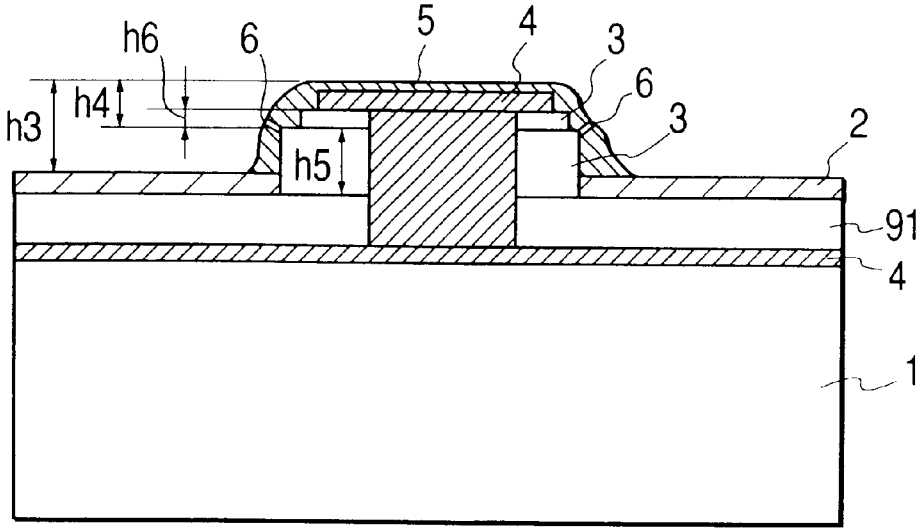

In addition, as is shown in FIGS. 48A and 48B, in addition of the double insulating layers 3, the thickness of the laminated Pt—Pd electroconductive film can be controlled to adjust the position whereat the gap 6 is formed. FIG. 48A is a plan view (as viewed from an anode) of the electron-emitting device, and FIG. 48B is a side cross-sectional view. The structure wherein the layers having thicknesses equivalent to h3 and h4 were laminated, so that the height h4 was substantially 60 nm and the height h3 was approximately 300 nm, was compared with the structure wherein the layers having thicknesses equivalent to h5 and h6 were laminated, so that the height h4 was substantially 200 nm and the height h3 was approximately 300 nm. As a result of the comparison, it was found that the efficiency for the first structure was about 5 times that for the second structure.

Therefore, it is preferable that $h4<h3/2$.

In this embodiment, when the insulating layer in FIGS. 48A and 48B having a thickness equivalent to h5 was formed thin and the Pt—Pd electroconductive film 5 was not formed, and the structure was placed in the vacuum container in FIG. 2 and the voltages Vf and Va were applied, the currents Ie and If flew across the structure, and the luminance pattern was as small as that for the above described device. As is described above, the present invention can be established, regardless of how the electron-emitting device is fabricated.

[Embodiment 13]

FIGS. 22A and 22B are diagrams showing a thirteenth embodiment for the third mode of the invention, and FIGS. 23A to 23D are diagrams showing its fabrication method.

In this embodiment, a high-potential side electrode 4, an insulating layer 3 and a low-potential side electrode 2 are laminated in the named order to form a two-dimensional recessed structure.

FIG. 22A is a top plan view of the electron-emitting deice, and FIG. 22t is a side cross-sectional view of the center portion of the device.

In this embodiment, in the top view, the potentials are the same as those in the twelfth embodiment, and in the cross section, the position of the high-potential side electrode 4 is lower then the low-potential side electrode 2. In this embodiment, a difference h1 in the heights of the two electrodes is 200 nm.

FIGS. 23A to 23D are diagrams showing a method for fabricating an electron-emitting device according to this embodiment.

Figure 23A:
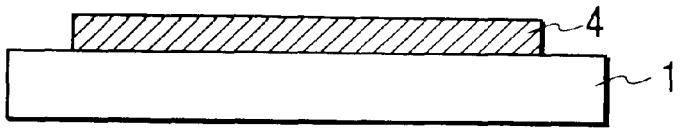
FIGS. 23A, 23B, 23C and 23D are diagrams showing another example method for fabricating the electron-emitting device according to the third mode of the present invention.

In FIG. 23A, a silica glass substrate 1 was well washed, and a 300 nm thick thin film made of Ta was deposited thereon as the high-potential side electrode 4. Then, the structure was patterned using photolithography to form a resist pattern, and dry etching was performed to obtain a part of the high-potential side electrode 4 having a desired shape.

Figure 23B:
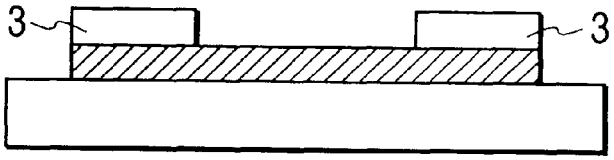

In FIG. 23B, the structure was patterned using photolithography to form a resist pattern, and 100 nm of $SiO_2$ was deposited as an insulating layer 3.

Figure 23C:
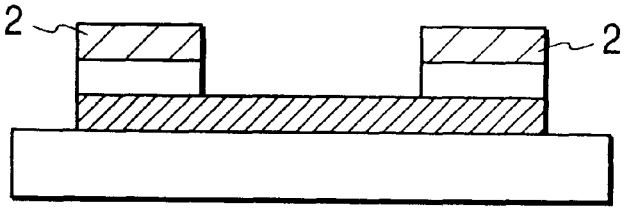

In FIG. 23C, the structure was patterned using photolithography to form a resist pattern, and 100 nm of Ta was deposited as the low-potential side electrode 2.

Figure 23D:
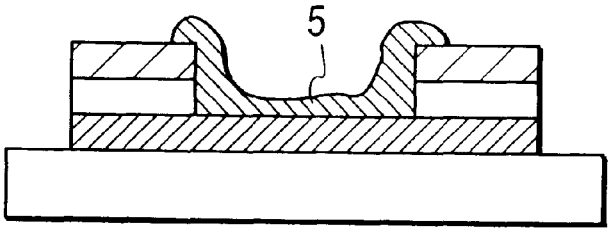

In FIG. 23D, the structure was patterned using photolithography, and a 4 nm Pt—Pd electroconductive film 5 was deposited. The photoresist was thereafter removed.

The forming process and the activation process as in the twelfth embodiment were performed to form a gap in a part of the Pt—Pd electroconductive film 5.

With this arrangement in a two-dimensional shape, the low-potential side electrode 2 can be easily extracted, so that a hole as in the twelfth embodiment need not be formed. As a result, the fabrication process is simplified.

Table 3 shows the beam diameters of the electron sources in this embodiment and the conventional example.

TABLE 3

| | Beam diameter By | Beam diameter Bx |
|---|---|---|
| Electron source in this embodiment W = 1 $\mu$m) | 0.10 mm | 0.10 mm |
| Electron source in this embodiment (W = 2 $\mu$m) | 0.13 mm | 0.13 mm |
| Electron source in this embodiment (W = 6 $\mu$m) | 0.27 mm | 0.27 mm |
| Conventional electron source | 0.4 mm | 0.16 mm |

In the graph in FIG. 26C, the horizontal axis represents the length W of one side of the high-potential side electrode 4 in a substantially square shape that constitutes the electron-emitting device for this embodiment. The length W is standardized by using the distance Xs. The vertical axis represents the beam diameter. As is apparent from this graph, the convergence effects can be obtained when the width W is set equal to or smaller than 15 times the distance Xs. When the width W is reduced, the efficiency is extremely low, and electrons may not reach the positive electrode. Therefore, it is requested that the width W be greater than ½ the distance Xs. Further, it is apparent that, although the change in the efficiency is the same as for the convex structure in the twelfth embodiment, the relative value is overall smaller than that of the convex structure in the twelfth embodiment.

[Embodiment 14]

A fourteenth embodiment for the third mode of the present invention is shown in FIGS. 24A and 24B.

FIG. 24A is a top view of an electron-emitting device and FIG. 24B is a side cross-sectional view of the center portion of the device.

This embodiment employs a plane type arrangement wherein, in the top view, the potentials are the same as those in the twelfth embodiment, and in the cross section, the high-potential side electrode 4 is positioned at the same height as the low-potential side electrode 2.

The sizes of the electrodes and the interval between them are so designed that the center portions of the low-electrode 2 and the high-electrode 4 are substantially equal to the width W of a high-potential side electrode of 1 $\mu$m, 2 $\mu$m or 6 $\mu$m.

FIGS. 25A to 25E are diagrams showing the method for fabricating the electron-emitting device for this embodiment.

Figure 25A:
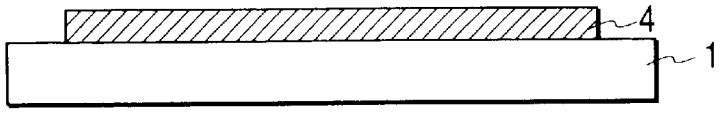
FIGS. 25A, 25B, 25C, 25D and 25E are diagrams showing an additional example method for fabricating the electron-emitting device according to the third mode of the present invention.

In FIG. 25A, a substrate 1 made of silica glass was well washed, and one part of the 300 nm thick high-potential side electrode 4 made of Ta was deposited thereon by sputtering. Then, the structure was patterned using photolithography to form a resist pattern, and dry etching was performed to obtain the high-potential side electrode 4 having a desired shape.

Figure 25B:
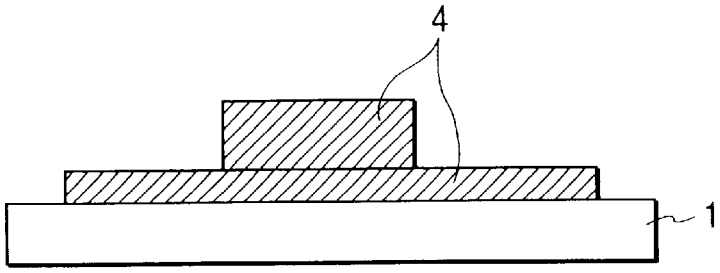

In FIG. 25B, the structure was patterned using photolithography to form a resist pattern, and a 200 nm thick layer of Ta was deposited to form the upper portion of the high-potential side electrode 4.

Figure 25C:
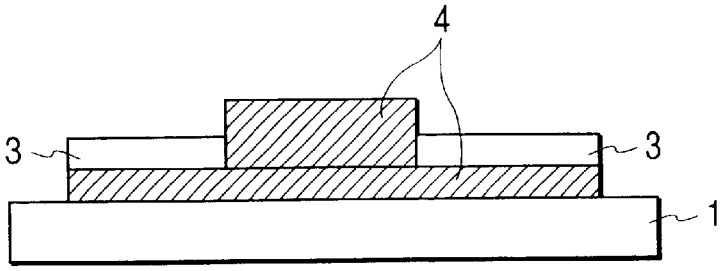

In FIG. 25C, the structure was patterned using photolithography to form a photoresist pattern, and a 200 nm thick layer of $SiO_2$ was deposited as an insulating layer 3.

Figure 25D:
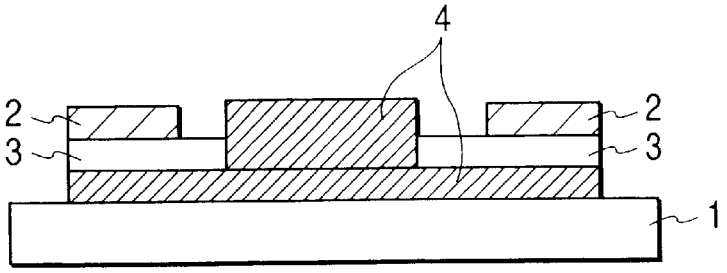

In FIG. 25D, the structure was patterned using photolithography, and the low-potential side electrode 2 was deposited.

Figure 25E:
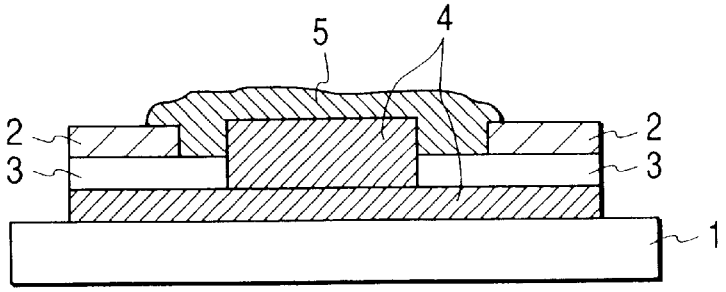

In FIG. 25E, the structure was patterned using photolithography, and a 4 nm thick Pt—Pd electroconductive film 5 was deposited. Thereafter, the photoresist was removed.

Following this, the forming process and the activation process as in the twelfth embodiment were performed to form a gap in a part of the Pt—Pd electroconductive film 5, so that electrons were emitted through the gap.

The electron-emitting device was driven under the same conditions as in the twelfth embodiment, and the characteristics of the device were measured.

The beam diameters for the embodiment and the conventional example are shown in Table 4.

TABLE 4

| | Beam diameter By | Beam diameter Bx |
|---|---|---|
| Electron source in this embodiment W = 1 μm) | 0.09 mm | 0.09 mm |
| Electron source in this embodiment (W = 2 μm) | 0.13 mm | 0.13 mm |
| Electron source in this embodiment (W = 6 μm) | 0.26 mm | 0.26 mm |
| Conventional electron source | 0.4 mm | 0.16 mm |

In the graph in FIG. 26B, the horizontal axis represents the length W of one side of the high-potential side electrode 4 having a substantially square shape that constitutes the electron-emitting device for this embodiment. The length W is standardized by using the distance Xs. The vertical axis represents the beam diameter. As is apparent from this graph, the convergence effects can be obtained when the width W is set equal to or smaller than 15 times the distance Xs. When the width W is reduced, the efficiency is extremely low, and electrons may not reach the positive electrode. Therefore, it is preferable that the width W be greater than ½ the distance Xs.

Further, it is apparent that although the change in the efficiency is the same as that for the convex structure in the twelfth embodiment, the relative value overall is smaller than that of the convex structure in the twelfth embodiment.

[Embodiment 15]

An electron-emitting device obtained in a fifteenth embodiment is shown in FIGS. 27A and 27B.

In this embodiment, as is shown in FIG. 27B, an electron-emitting device in a cross shape was fabricated. The cross-sectional shape of this device corresponds to that shown for the fourteenth embodiment in FIGS. 24A and 24B, and the fabrication method corresponds to that shown in FIGS. 25A to 25E. While the position of a gap in FIG. 27A was employed as a reference, the size of the largest circumscribed circle of the cross was defined as W, and all the sides of the cross had the same length. It should be noted that 6 μm was set as the length W.

In FIG. 27A, since compared with the fourteenth embodiment the electron emission region was extended, the amount of electrons emitted and the emission current Ie were increased.

In FIG. 27B, since the electron emission region was limited to the center of the cross shape, compared with the fourteenth embodiment and the structure in FIG. 27A the beam diameter was slightly reduced, without any deterioration of the efficiency.

The electroconductive thin film 5 may be formed by using an ink-jet ejection device.

[Embodiment 16]

Figure 46A:
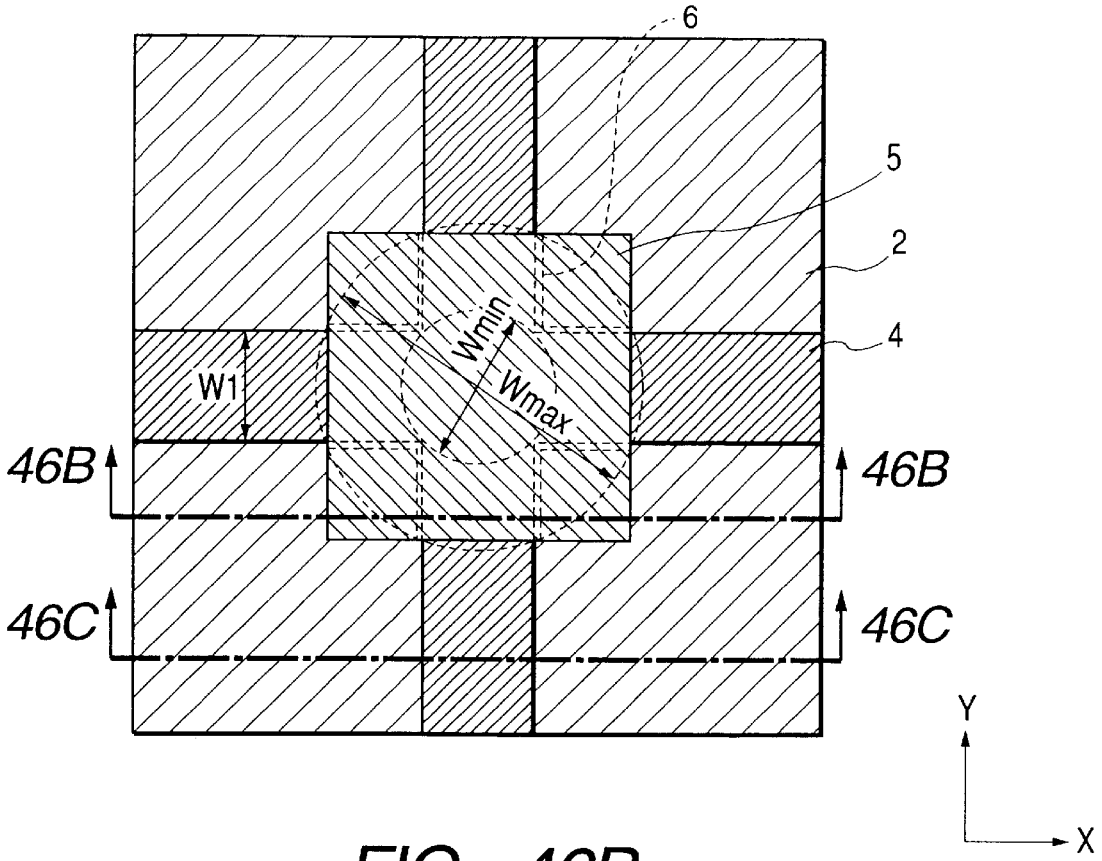
FIGS. 46A, 46B and 46C are a top view and cross-sectional views of an electron-emitting device according to a thirteenth embodiment of the present invention.
Figure 46B:
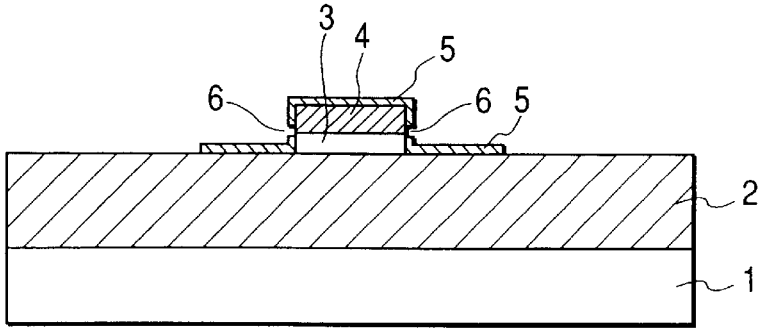
Figure 46C:
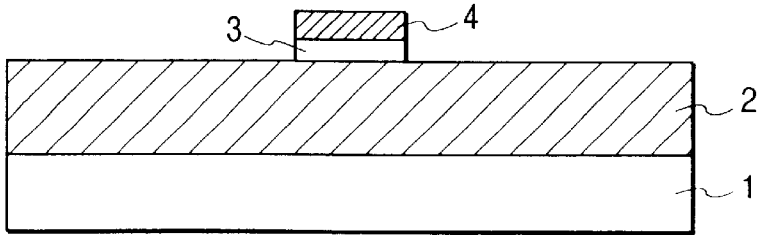
Figure 47A:
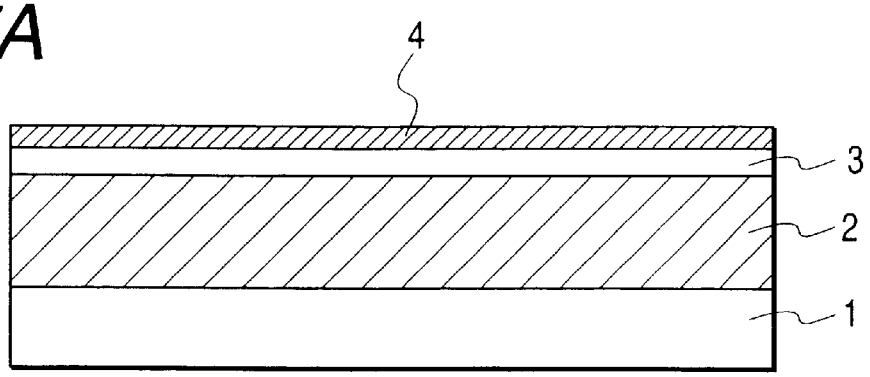
FIGS. 47A, 47B and 47C are cross-sectional views of a fabrication method according to the thirteenth embodiment of the present invention.
Figure 47B:
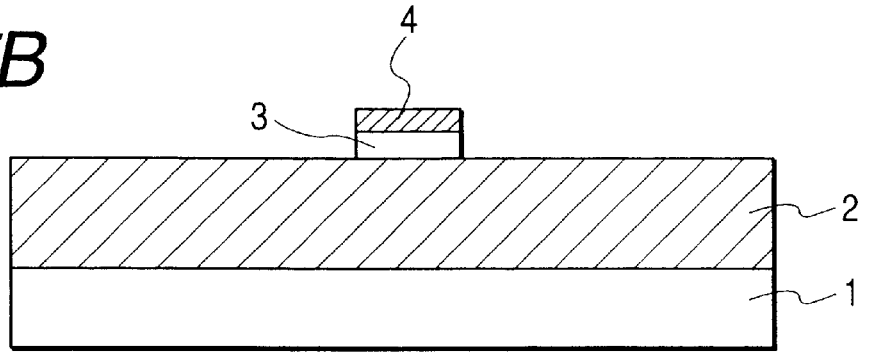
Figure 47C:
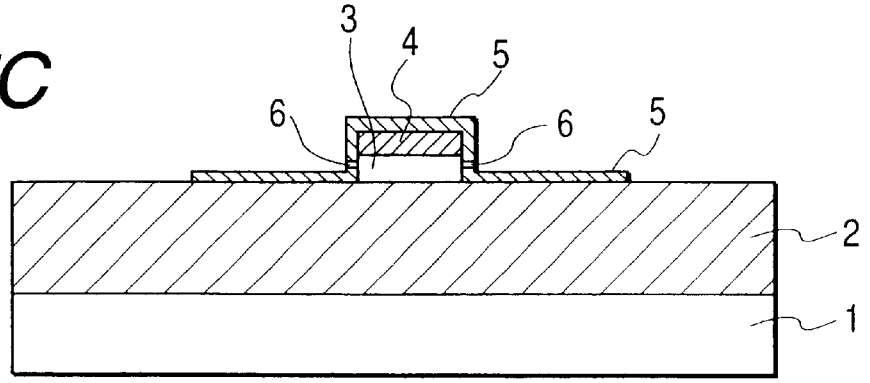

A sixteenth embodiment for the third mode of the present invention is shown in FIGS. 46A to 46C, and its fabrication method is shown in FIGS. 47A to 47C. FIG. 46A is a plan view, FIG. 46B is a cross-sectional view taken along line 46B—46B, and FIG. 46C is a cross-sectional view taken along line 46C—46C.

In this embodiment, the electron-emitting device provides substantially the same effect as that shown in FIG. 27B for the fifteenth embodiment.

The fabrication method for this embodiment will now be described while referring to FIGS. 47A to 47C.

(Step 1)

A substrate 1 made of silica glass was well washed, and a 300 nm thick layer of Al was deposited as a low-potential side electrode 2 by sputtering. Then, a 50 nm thick layer of $SiO_2$ and a 20 nm thick layer of Ta were respectively deposited as an insulating layer 3 and a high-potential side electrode 4.

(Step 2)

A cross-shaped resist pattern, as shown in FIG. 46A, was formed using photolithography. While using the pattern as a mask, the high-potential side electrode 4 and the insulating layer 3 were removed by dry etching, and a cross-shaped structure was obtained. The width W1 of the cross-shaped structure was set to 2 μm.

(Step 3)

A square, 6 μm opening in was formed in the center of the cross using photolithography, and a 4 nm thick Pt—Pd film was deposited therein. Then, the mask was removed.

Further, as is shown in FIG. 12B a pulse voltage having a pitch value of up to 15 V (ON time: 1 msec, and OFF time: 9 msec) was applied to the low-potential side electrode 23 and to the high-potential side electrode 4 to form a gap (forming process).

Then, an activation process, as in the first embodiment, was performed to form a gap 6.

The thus obtained electron-emitting device was driven at a voltage Vf=15 V, while the low-potential side electrode was set to 0 V and the high-potential side electrode was set to 15 V. The voltage Va=10 kV was also applied to anode that was located at a distance H=2 mm.

Since W1=3 μm in this embodiment, Wmin=3.6 μm, and since the electron emission region is limited to a 6 μm square, Wmax=8.49 μm.

Compared with the square in the twelfth embodiment, where W=6 μm, a slightly smaller beam diameter was observed.

Further, compared with the plane type in the fifth embodiment, the efficiency was improved, as it also was when compared to the convex structure for the twelfth embodiment.

In this embodiment, unlike the other embodiments for the third mode, the high-potential side electrode 4 is not completely enclosed by the low-potential side electrode 2. Instead, the arms are projected in all the directions emanating from the cross-shaped high-potential side electrode 4, and constitute the extension portion that separates the low-potential side electrode 2 and that is connected to the outside. However, the effects of beam convergence are obtained in this embodiment because the enclosing low-potential side electrode 2 is satisfactorily large, and because an electron emission region is not present in a region R2 that provides little effect for beam conversion and does not contribute to beam diameter, so that the voltage applied to the area where the gap 6 is formed is considered to be substantially the same as the voltage in the embodiment in FIG. 27B.

If the width of the region wherein the gap 6 is present exceeds the permitted range of the present invention, or if the width W1 of the cross-shaped portion is increased in a region other than the region wherein the gap 6 is present, and if the area of the low-potential side electrode 2 is reduced, the beam convergence effects that are important for the present invention can not be obtained with the cross-shaped structure.

In this embodiment, while the effects of beam convergence in the directions X and Y are obtained, a voltage can be easily applied to the high-potential side electrode because the electrode is not enclosed in two dimensions. Therefore, the multiple fabrication processes that are required for the twelfth embodiment to apply a voltage to the high-potential side electrode can be simplified.

In this embodiment, the high-potential side electrode is continued in all of the directions for the cross-shaped structure. The electrode may thus be attached in only one of the four directions, i.e., only one extension portion that separates the low-potential side electrode 2 need be formed.

Furthermore, it is apparent that an arbitrary shape can be employed for the high-potential side electrode 4 of the cross-shaped structure.

[Embodiment 17]

An explanation will now be given, while referring to FIG. 30, for an image-forming apparatus that employs an electron source on which a plurality of electron-emitting devices according to the invention are arranged.

In this embodiment, the electron-emitting device for the first embodiment in FIG. 34A to 34C was employed with W=2 $\mu$m.

In FIG. 30, the electron source comprises an electron source substrate 151, X-directional lines 152, Y-directional lines 153, electron-emitting devices 154 according to the invention, and connection lines 155.

When multiple electron-emitting devices are arranged as a matrix and the capacitances of the devices are increased, even if a short pulse that is obtained by pulse width modulation is applied to the matrix wiring in FIG. 30, a waveform will be distorted due to the capacitive element, and an expected tone can not be obtained. Therefore, in this embodiment, as well as in the first embodiment, while taking into account the fact that the electron emission characteristics, such as the efficiency and the beam diameter, are not greatly changed in one device, an insulating inter-layer (insulating inter-wire member) 91 in FIGS. 34A to 34C is formed beside the electron emission region, so that an increase in the capacitive element is suppressed in a region other than the electron emission region.

In FIG. 30, the m X-directional lines 152, DX1 to DXm, are formed of Ta by sputtering, and have a thickness of 0.3 $\mu$m and a width of 300 $\mu$m. In this embodiment, the X-directional lines serve as low-potential side electrodes. The material, the thickness and the width of the lines can be arbitrarily determined. The n Y-directional lines 153, DY1 to DYm, are formed of Ta and have a thickness of 0.05 $\mu$m and a width of 200 $\mu$m. In this embodiment, the Y-directional lines serve as the high-potential side electrodes. An insulating inter-layer 91 and an insulating layer are laminated between the m X-directional lines 152 and the n Y-directional lines 153 to electrically separate these lines (both m and n are positive integers).

Using sputtering, the insulating inter-layer 91 is formed of $SiO_2$, in thicknesses of 0.5 $\mu$m and 0.05 $\mu$m. Further, in this embodiment, the thickness of the insulating inter-layer 91 is determined so that the capacitance of each device is equal to or smaller than 1 pF and the device resistant voltage is 30 V. Thus, a layer 91 having a desired shape covers all or a part of the substrate 151 on which the X-directional lines 152 are mounted, and in particular, the layer 91 can resist the effects produced by the potential differences at the intersections of the X-directional lines 152 and the Y-directional lines 153. One end of each X-directional line 152 and each Y-directional line 153 is extended out as an external terminal.

The low-potential side electrode and the high-potential side electrode that constitute the electron-emitting device 154 are electrically connected to the X-directional lines 152 and the Y-directional lines 153 by the connection lines 155 that are formed of electroconductive metal.

The X-directional lines 152 are connected to scan signal transmission means (not shown), which transmits a scan signal to select a row of the surface conduction electron-emitting devices 154 that are arranged in the direction X. The Y-directional lines 153 are connected to modulation signal generation means (not shown), which modulates, in accordance with an input signal, the columns of the surface conduction electron-emitting devices 154 that are arranged in the direction Y. A drive voltage that is to be applied to each electron-emitting device 154 is a difference in the voltages of the modulation signal and the scan signal that is transmitted to a pertinent device 154. In this embodiment, the Y-directional lines are so connected that they serve as high-potential side electrodes, while the X-directional lines are so connected that they serve as low-potential side electrodes. Therefore, the Y-directional lines correspond to high voltage feeding lines, and the X-directional lines correspond to low voltage feeding lines. Since the lines are so connected, the beam convergence effect that is the feature of the invention can be obtained.

With this arrangement, simple matrix wiring is employed to select individual electron-emitting devices and to drive them independently.

An explanation will now be given, while referring to FIG. 31, for an image-forming apparatus that employs an electron source having the above described simple matrix arrangement. FIG. 31 is a diagram showing a display source for an image forming apparatus that employs soda lime glass as a glass substrate material.

The image-forming apparatus in FIG. 31 comprises: an electron source substrate, on which multiple electron-emitting devices are mounted; a rear plate 161, to which the electron source substrate 151 is fixed; and a face plate 166, wherein a phosphor film 164 (corresponding to an image forming member) and a metal back 165 are formed on the internal wall of a glass substrate 163. Frit glass is used to connect A support frame 162 to the rear plate 161 and to the face plate 166. An envelope container 167 is sealed by annealing it in vacuum at a temperature of 450 degrees for ten minutes.

Devices 154 correspond to the electron-emitting devices in FIGS. 34A to 34C. X-directional lines 152 and Y-directional lines 153 are connected to pairs of the device electrodes for the individual electron-emitting devices 154.

As is described above, the envelope container 167 is constituted by the face plate 166, the support frame 162 and the rear plate 161. A support member called a spacer (not shown) may be located between the face plate 166 and the rear plate 161, so that an air container 167 that is strong enough to resist atmospheric pressure can be provided.

Figure 32A:
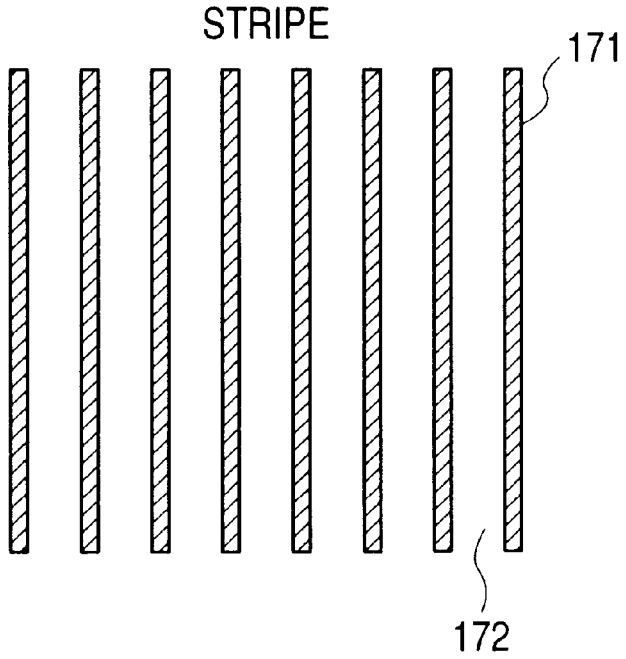
FIGS. 32A and 32B are diagrams showing an example phosphor layer.
Figure 32B:
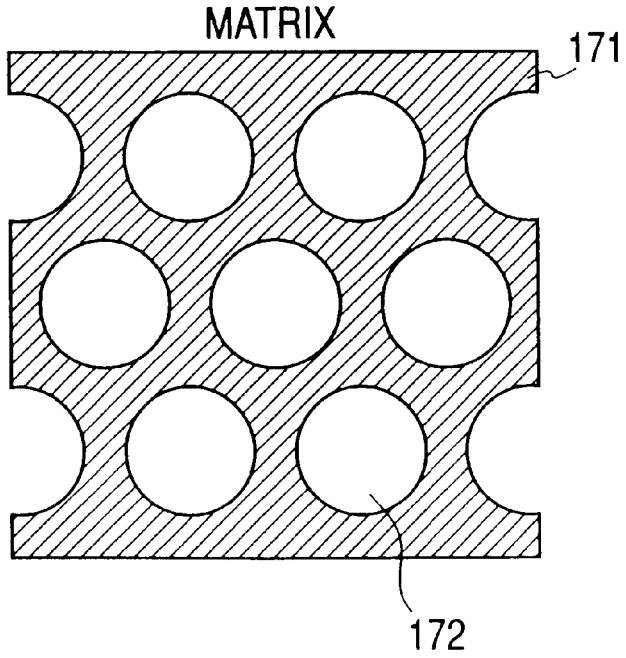

FIGS. 32A and 32B are specific diagrams showing a phosphor film that is employed for the display panel of this embodiment.

In accordance with the arrangement of the phosphors, a color phosphor film is formed of a phosphor 172 and a black electroconductive member 171, which is called a black stripe, as shown in FIG. 32A, or a black matrix, as shown in FIG. 32B.

The black stripe material in this embodiment contains as a primary element common black lead.

In FIG. 31, the metal back 165 is generally provided inside the phosphor film 164.

The metal back is formed by smoothing the internal surface of the phosphor film (generally called filming), and by depositing Al using vacuum evaporation.

In the phase plate 166, a transparent electrode (not shown) is provided on the external surface of the phase plate 166 in order to improve the conductivity of the phosphor film 164.

To seal the container 167, the positions of the color phosphors must be aligned with those of the electron-emitting devices. Thus, complete alignment is inevitable.

In this embodiment, the phosphors are located immediately above the corresponding devices.

An explanation will now be given, while referring to FIG. 33, for the structure of a drive circuit that provides a television display, in accordance with an NTSC television signal, on the thus arranged display panel 167. In FIG. 33, the drive circuit comprises: an image display panel (the airtight container 167); a scan circuit 182; a controller 183; a shift register 184; a line memory 185; a sync signal separator 186; a modulation signal generator 187; and direct-current voltage sources Vx and Va.

The scan circuit 182 will now be described. The scan circuit 182 includes M switching devices (S1 to Sm in FIG. 33). The switching devices S1 to Sm select either the output voltage for the direct-current voltage source or 0 [V] (ground level), and are electrically connected to the terminals Dx1 to Dxm of the display panel 181. Each of the switching devices S1 to Sm is so designed that it is activated upon receiving a control signal Tscan from the controller 183, and can be constituted by a combination of switching devices, such as an FE.

In accordance with the characteristic (electron emission threshold voltage) of the surface conduction electron-emitting device, the direct-current voltage source Vx in this mode outputs a constant voltage, so that the drive voltage that is applied to a surface conduction electron-emitting device that is not scanned is equal to or lower than the electron-emission threshold voltage.

The controller 183 adjusts the operations of the individual sections, so that an appropriate display can be provided based on an input image signal. The controller 183 receives a sync signal Tsync from the sync signal separator 186, and generates control signals Tscan, Tsft and Tmry for the individual sections.

The sync signal separator 186 is a circuit for separating an input NTSC television signal to provide a sync signal element and a luminance signal element, and can be constituted by a common frequency separator (filter). The sync signal obtained by the sync signal separator 186 consists of a vertical sync signal and a horizontal sync signal. In this mode, for convenience sake, the sync signal is represented as a Tsync signal in FIG. 33, and the luminance signal element which is separated from the television signal, is represented as a DATA signal. The DATA signal is transmitted to the shift register 184.

The shift register 184 receives the DATA signal in the time series, and performs serial/parallel conversion for the DATA signal for each line of an image. The shift register 184 begins to operate upon receiving the control signal Tsft from the controller 183 (i.e., the control signal Tsft can be defined as a shift clock for the shift register 184). The data for one image line (corresponds to data for driving N electron-emitting devices) that are obtained by the serial/parallel conversion are output as N parallel signals Id1 to Idn by the shift register 184.

The line memory 185 is a storage device for storing the data for one image line for a required period of time. In accordance with the control signal Tmry received from the controller 183, the data Id1 to Idn are stored in the line memory 185. The stored contents are output as data I'd1 to I'dn, and are transmitted to the modulation signal generator 187.

The modulation signal generator 187 is a signal source for appropriately driving the individual electron-emitting devices of this invention in accordance with the image data I'd1 to I'dn, and its output signal is transmitted via the terminals Doy1 to Doyn to the devices in the display panel 181.

As is described above, the electron-emitting device of this invention has the following characteristic relative to the emission current Ie. A specific threshold value Vth is set for electron emission, and electrons are emitted only upon application of a voltage Vth or higher. As for a voltage equal to or higher than the electron emission threshold voltage, an emission current is varied in accordance with changes in the applied voltage. Therefore, when a pulse voltage smaller than the electron emission threshold value is applied to an electron-emitting device, no electron emission occurs, and when a pulse voltage equal to or higher than the electron emission threshold value is applied to an electron-emitting device, an electron beam is output. At this time, the strength of the electron beam can be controlled by changing the pitch value Vm of the pulse. Further, the total amount of charges in the electron beam can be controlled by changing the pulse width Pw.

Therefore, a voltage modulation method or a pulse width modulation method can be employed as a method for modulating an electron-emitting device in accordance with an input signal. When the voltage modulation method is employed, the modulation signal generator 187 can be a voltage modulation circuit that generates a voltage pulse having a constant length, and that modulates the pitch value of the pulse as needed in accordance with input data.

When the pulse width modulation method is employed, the modulation signal generator 187 can be a pulse width modulation circuit that generates a voltage pulse having a constant pitch value, and that modulates the width of a voltage pulse as needed in accordance e with input data.

A shift register 184 and a line memory 185 of a digital type are employed.

In this embodiment, for example, a D/A converter is employed as the modulation signal generator 187, and if necessary, an amplifier is additionally provided. For the panel width modulation method, the modulation signal generator 187 is a circuit that is constituted by, for example, a high-speed oscillator, a counter, for counting the number of waves output by the oscillator, and a comparator, for comparing the output value of the counter with the output value held by the memory.

The above described arrangement of the image-forming apparatus is merely one example for which the present invention can be applied, and can be variously modified based on the technical idea of the invention. Input signals are not limited to NTSC television signals, and PAL signals, SECAM signals, or TV signals consisting of multiple scan lines (e.g., a high quality TV signal including an MUSE signal) can be employed.

[Embodiment 18]

Figure 39A:
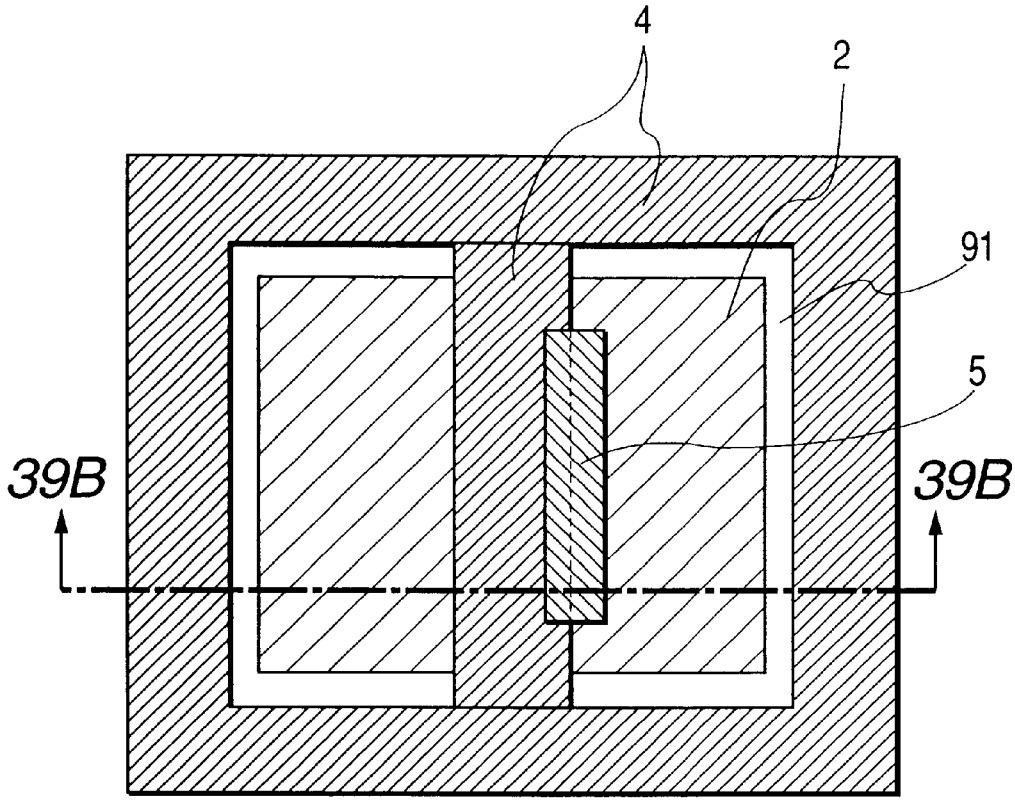
FIGS. 39A and 39B are a top view and a cross-sectional view of an electron-emitting device according to a fifth embodiment of the present invention.
Figure 39B:
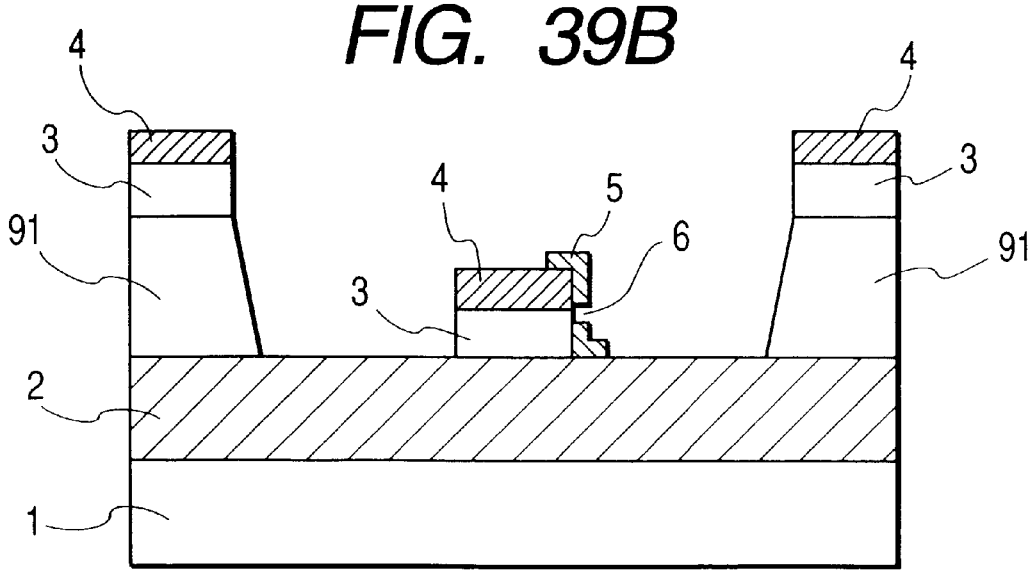

An explanation will now be given for an image-forming apparatus that is manufactured using the electron-emitting device of the fifth embodiment. For this electron-emitting device, as is shown in FIGS. 39A and 39B, in a region other than the high-potential side electrode 4 that is related to electron emission, a thick, 1 $\mu$m insulating inter-layer 91 was formed at a distance from the device and on both sides of the device. With this arrangement, parasite capacitance was reduced and a signal delay that occurs when the matrix is driven was prevented.

The devices of the fifth embodiment were arranged in a matrix shape and at a pitch of 150 $\mu$m horizontally and 300

μm vertically. As for wiring, the X-directional lines were connected to the high-potential side electrode, and the Y-directional lines were connected to the low-potential side electrode. Unlike the seventeenth embodiment, while taken into account a shift of the electron trajectory in the direction X, the phosphors were aligned at a distance of 3 mm from the devices, and not immediately above them. A voltage of 8 kV was then applied to the phosphors, and as a result, as in the seventeenth embodiment, a high-resolution image-forming apparatus could be provided that can be driven in a matrix due to the reduction of the capacitive element.

[Embodiment 19]

An explanation will now be given for another image-forming apparatus that employs an electron source on which multiple electron-emitting devices of this invention are arranged.

For this embodiment, the electron-emitting device in the twelfth embodiment that has a width W of 2 μm was employed.

Figure 49:
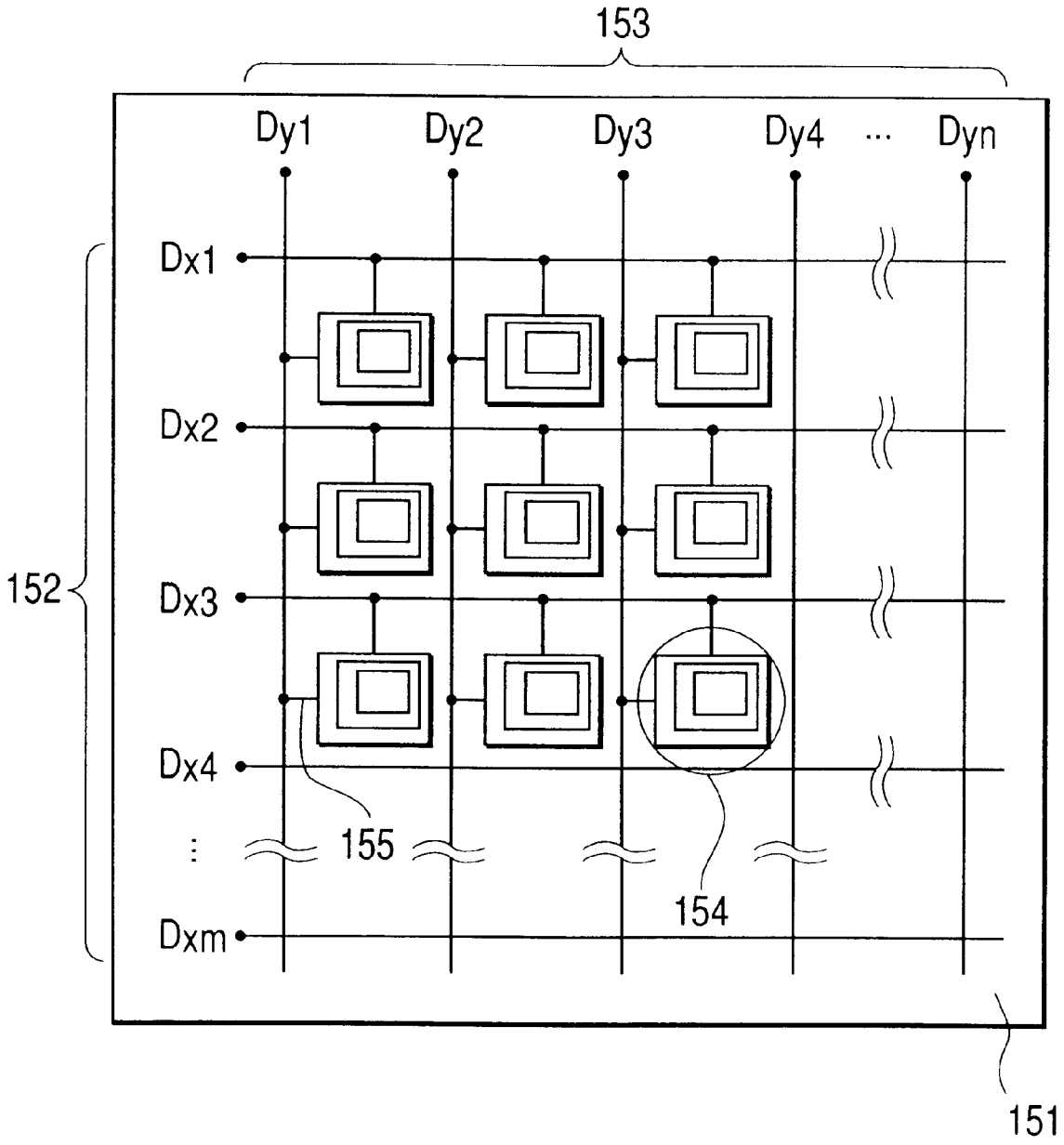
FIG. 49 is a diagram showing the wiring of an electron source according to a nineteenth embodiment of the present invention.

In FIG. 49, the electron-emitting device comprises: an electron source substrate 151; X-directional lines 152; Y-directional lines 153; electron-emitting devices 154 according to the invention; and connection lines 155.

The n Y-directional lines 153, Dy1 to Dyn, have a thickness of 0.3 μm and a width of approximately 150 μm. These lines 153 are laminated directly onto the substrate 151 so they can serve as high-potential side electrodes 4.

The m X-directional lines 152, Dx1 to Dxn, have a thickness of about 0.1 μm and a width of approximately 150 μm. These lines 152 are formed of Ta by vacuum evaporation in a region other than the raised portion of the convex structure, so that they can serve as low-potential side electrodes 2.

A 0.1 μm thick $SiO_2$ insulating inter-layer 91 is formed between the m X-directional lines 152 and the Y-directional lines 153 to electrically separate them (m and n are positive integers). The $SiO_2$ insulating inter-layer 91 is formed by sputtering.

The electron source for this embodiment is located in the image-forming apparatus in FIG. 31 in the same manner as in the seventeenth embodiment. For this arrangement, soda lime glass is employed as a substrate. When the electron beam of the electron-emitting device reaches the phosphor film, a substantially circular luminance pattern is formed while the location (immediately above the device) where the emission of the device is projected onto the phosphor film in the direction Z is used as the center. In this embodiment, as well as in the seventeenth embodiment, phosphor that corresponds to each pixel is positioned immediately above each device.

As a result, a high-resolution image-forming apparatus that can be driven in a matrix can also be provided, as in the seventeenth embodiment.

Further, in this embodiment, since the pixel has the same size in both directions X and Y, the resolution in direction Y is increased.

As is described above, when the electron-emitting device of this invention is employed, an electron source having a small beam spot can be provided.

In addition, when the electron-emitting device of this invention is employed, an efficient electron source having a small beam spot can be provided.

Furthermore, when the electron source is employed for an image-forming apparatus and an image is formed based on an input signal, a higher resolution image-forming apparatus, such as a flat color television, can be provided.

What is claimed is:

1. An electron-emitting apparatus comprising:

(A) a substrate, which has a first major surface and a second major surface that are positioned opposite each other;

(B) an electron-emitting device, which comprises a first electrode, to which a first voltage is applied, and a second electrode, to which a voltage Vf is applied, that are mounted, with an interval, on said first major surface;

(C) an anode electrode, which is located opposite and at a distance H from said first major surface;

(D) first voltage application means, for applying to said second electrode said voltage Vf that is higher than said first voltage; and (E) second voltage application means, for applying to said anode electrode a voltage Va that is higher than said voltage Vf, wherein a space defined between said anode electrode and said electron-emitting device is maintained in a reduced-pressure condition, and wherein, when a value $Xs=H*Vf/(\pi*Va)$ is established for a plane that is substantially perpendicular to said first major surface, a width w of said second electrode, in a direction substantially parallel to said first major surface, equals or exceeds 0.5 times said value Xs and is smaller than or equals 15 times said value Xs.

2. An electron-emitting apparatus according to claim 1, wherein said first electrode is located outside both ends of said second electrode, which is defined by said width w.

3. An electron-emitting apparatus according to claim 2, wherein an electroconductive film is located between said first and said second electrodes, and a gap is formed in a part of said electroconductive film.

4. An electron-emitting apparatus according to claim 2, wherein a first electroconductive film and a second electroconductive film are formed between said first and said second electrodes; wherein said first electroconductive film is connected to said first electrode, while said second electroconductive film is connected to said second electrode; and wherein said first and said second electroconductive films are positioned opposite each other on opposite sides of an intervening gap.

5. An electron-emitting apparatus according to claim 2, 3 or 4, wherein said second electrode is positioned nearer said anode electrode than is said first electrode.

6. An electron-emitting apparatus according to claim 5, wherein said second electrode is laminated over said first electrode via an insulating layer.

7. An electron-emitting apparatus according to claim 2, 3 or 4, wherein said first electrode is positioned nearer said anode electrode than is said second electrode.

8. An electron-emitting apparatus according to claim 7, wherein said first electrode is laminated over said second electrode via an insulating layer.

9. An electron-emitting apparatus according to claim 8, wherein an opening is formed in said first electrode and said insulating layer, and said second electrode is exposed through said opening.

10. An electron-emitting apparatus according to claim 8, wherein said first electrode comprises a pair of electrodes, which are positioned above said second electrode, via an insulating layer, at an interval so that said second electrode is exposed.

11. An electron-emitting apparatus according to claim 2, 3 or 4, wherein said second electrode and said first electrode are arranged on a plane that is substantially parallel to said first major surface.

12. An electron-emitting apparatus according to claim 11, wherein said first electrode comprises a pair of electrodes, and said second electrode is located between said pair of electrodes.

13. An electron-emitting apparatus according to claim 2, 3 or 4, wherein, of circles that are circumscribed on the external surface of said second electrode, on said plane that is substantially parallel to said first major surface, the smallest circle has a diameter Wmax that equals or is smaller than 15 times said value Xs.

14. An electron-emitting apparatus according to claim 13, wherein said diameter Wmax equals or exceeds 0.5 times said value Xs.

15. An electron-emitting apparatus according to claim 2, 3 or 4, wherein, of circles inscribed on the external surface of said second electrode, on said plane that is substantially parallel to said first major surface, the largest circle has a diameter Wmin that equals or exceeds 0.5 times said value Xs.

16. An electron-emitting apparatus according to claim 15, wherein said diameter Wmin equals or is smaller than 15 times said value Xs.

17. An electron-emitting apparatus according to claim 2, 3 or 4, wherein, of circles circumscribed on the external surface of said second electrode, on said plane that is substantially parallel to said first major surface, the largest circle has a diameter Wmin that equals or exceeds 0.5 times said value Xs and that is smaller than or equals 15 times said value Xs; and wherein, of circles inscribed on the external surface of said second electrode, on said plane that is substantially parallel to said first major surface, the smallest circle has a diameter Wmax that equals or exceeds 0.5 times said value Xs and that is smaller than or equals 15 times said value Xs.

18. An electron-emitting apparatus according to claim 2, 3 or 4, wherein a plurality of said electron-emitting devices are arranged on said first major surface.

19. An image-forming apparatus comprising:

(A) a substrate having a first major surface and a second major surface that are positioned opposite each other;

(B) an electron-emitting device, which comprises a first electrode, to which a first voltage is applied, and a second electrode, to which a voltage Vf is applied, that are mounted, with an interval, on said first major surface;

(C) a second substrate, on which an anode electrode, which is located opposite and at a distance H from said first major surface, and an image-forming member are mounted;

(D) first voltage application means, for applying to said second electrode said voltage Vf that is higher than said first voltage; and (E) second voltage application means, for applying to said anode electrode a voltage Va that is higher than said voltage Vf, wherein a space defined between said anode electrode and said electron-emitting device is maintained in a reduced-pressure condition, and wherein, when a value $Xs=H*Vf/(\pi*Va)$ is established for a plane that is substantially perpendicular to said first major surface, a width w of said second electrode in a direction substantially parallel to said first major surface equals or exceeds 0.5 times said value Xs and is smaller than or equals 15 times said value Xs.

20. An image-forming apparatus according to claim 19, wherein said first electrode is located outside both ends of said second electrode, which is defined by said width w.

21. An image-forming apparatus according to claim 20, wherein an electroconductive film is located between said first and said second electrodes, and a gap is formed in a part of said electroconductive film.

22. An image-forming apparatus according to claim 20, wherein a first electroconductive film and a second electroconductive film are formed between said first and said second electrodes; wherein said first electroconductive film is connected to said first electrode, while said second electroconductive film is connected to said second electrode; and wherein said first and said second electroconductive films are positioned opposite each other on opposite sides of an intervening gap.

23. An image-forming apparatus according to claim 20, 21 or 22, wherein said second electrode is positioned nearer said anode electrode than is said first electrode.

24. An image-forming apparatus according to claim 23, wherein said second electrode is laminated over said first electrode via an insulating layer.

25. An image-forming apparatus according to claim 20, 21 or 22, wherein said first electrode is positioned nearer said anode electrode than is said second electrode.

26. An image-forming apparatus according to claim 25, wherein said first electrode is laminated over said second electrode via an insulating layer.

27. An image-forming apparatus according to claim 26, wherein an opening is formed in said first electrode and said insulating layer, and said second electrode is exposed through said opening.

28. An image-forming apparatus according to claim 26, wherein said first electrode comprises a pair of electrodes, which are positioned above said second electrode, via an insulating layer, at an interval so that said second electrode is exposed.

29. An image-forming apparatus according to claim 20, 21 or 22, wherein said second electrode and said first electrode are arranged on a plane that is substantially parallel to said first major surface.

30. An image-forming apparatus according to claim 29, wherein said first electrode comprises a pair of electrodes, and said second electrode is located between said pair of electrodes.

31. An image-forming apparatus according to claim 20, 21 or 22, wherein, of circles that are circumscribed on the external surface of said second electrode, on said plane that is substantially parallel to said first major surface, the smallest circle has a diameter Wmax that equals or is smaller than 15 times said value Xs.

32. An image-forming apparatus according to claim 31, wherein said diameter Wmax equals or exceeds 0.5 times said value Xs.

33. An image-forming apparatus according to claim 20, 21 or 22, wherein, of circles inscribed on the external surface of said second electrode, on said plane that is substantially parallel to said first major surface, the largest circle has a diameter Wmin that equals or exceeds 0.5 times said value Xs.

34. An image-forming apparatus according to claim 33, wherein said diameter Wmin equals or is smaller than 15 times said value Xs.

35. An image-forming apparatus according to claim 20, 21 or 22, wherein, of circles circumscribed on the external surface of said second electrode, on said plane that is substantially parallel to said first major surface, the largest circle has a diameter Wmin that equals or exceeds 0.5 times said value Xs and that is smaller than or equals 15 times said value Xs; and wherein, of circles inscribed on the external surface of said second electrode, on said plane that is substantially parallel to said first major surface, the smallest circle has a diameter Wmax that equals or exceeds 0.5 times said value Xs and that is smaller than or equals 15 times said value Xs.

36. An image-forming apparatus according to claim 20, 21 or 22, wherein a plurality of said electron-emitting devices are arranged on said first major surface.

37. An electron-emitting apparatus comprising:

(A) a substrate, which has a first major surface and a second major surface that are positioned opposite each other;

(B) an electron-emitting device, which comprises a first electrode, to which a first voltage is applied, and a second electrode, to which a voltage Vf is applied, that are mounted, with an interval, on said first major surface;

(C) an anode electrode that is located opposite and at a distance H from said first major surface;

(D) first voltage application means, for applying to said second electrode said voltage Vf that is higher than said first voltage; and (E) second voltage application means, for applying to said anode electrode a voltage Va that is higher than said voltage Vf, wherein, when viewed from said anode electrode, said second electrode is sandwiched between said first electrode pair, and wherein, when a value $Xs=H*Vf/(\pi*Va)$ is established for a plane that is substantially perpendicular to said first major surface, a width w of said second electrode sandwiched between said first electrode pair equals or exceeds 0.5 times said value Xs and equals or is smaller than 15 times said value Xs.

38. An image-forming apparatus comprising:

(A) a substrate having a first major surface and a second major surface that are positioned opposite each other;

(B) an electron-emitting device, which comprises a first electrode, to which a first voltage is applied, and a second electrode, to which a voltage Vf is applied, that are mounted, with an interval, on said first major surface;

(C) a second substrate, on which an anode electrode, which is located opposite and at a distance H from said first major surface, and an image-forming member are mounted;

(D) first voltage application means, for applying to said second electrode said voltage Vf that is higher than said first voltage; and (E) second voltage application means, for applying to said anode electrode a voltage Va that is higher than said voltage Vf, wherein, when viewed from said anode electrode, said second electrode is sandwiched between said first electrode pair, and wherein, when a value $Xs=H*Vf/(\pi*Va)$ is established for a plane that is substantially perpendicular to said first major surface, a width w of said second electrode sandwiched between said first electrode pair equals or exceeds 0.5 times said value Xs and equals or is smaller than 15 times said value Xs.

* * * * *

UNITED STATES PATENT AND TRADEMARK OFFICE

CERTIFICATE OF CORRECTION

PATENT NO. : 6,288,494 B1
DATED : September 11, 2001
INVENTOR(S) : Takeo Tsukamoto et al.

It is certified that error appears in the above-identified patent and that said Letters Patent is hereby corrected as shown below:

Column 1,
Line 19, "well known" should read -- well-known --.

Column 6,
Line 13, "a" should read -- an --.

Column 7,
Line 60, "device;" should read -- device; and --; and
Line 66, "above" should read -- above --.

Column 11,
Line 13, "a" should read -- an --; and
Line 14, "above described" should read -- above-described --.

Column 12,
Line 51, "a" should read -- an --.

Column 13,
Line 38, "for of" should read -- for --.

Column 14,
Line 3, "arrived" should read -- reach --;
Line 24, "import" should read -- importance --;
Line 37, "above described" should read -- above-described --;
Line 48, "example" should read -- example of the --; and
Line 53, "example" should read -- example of the --.

Column 15,
Line 5, "can" should read -- can be --.

Column 16,
Line 63, "YB4 or GdB4;" should read -- $YB_4$ or $GdB_4$; --.

Column 17,
Line 54, "FIG.13A" should read-- FIGS.13A --.

Column 20,
Line 23, "$A1_2)_3$," should read -- $A1_2O_3$, --.

UNITED STATES PATENT AND TRADEMARK OFFICE

CERTIFICATE OF CORRECTION

PATENT NO. : 6,288,494 B1
DATED : September 11, 2001
INVENTOR(S) : Takeo Tsukamoto et al.

It is certified that error appears in the above-identified patent and that said Letters Patent is hereby corrected as shown below:

Column 24,
Line 46, "above described" should read -- above-described --.

Column 27,
Lines 25 and 34, "above described" should read -- above-described --.

Column 29,
Line 48, "$C_nH2n+2$" should read -- $C_nH_{2n+2}$ --; and
Line 50, "GnH2n;" should read -- $GnH_{2n}$; --.

Column 30,
Line 21, "above described" should read -- above-described --.

Column 31,
Line 28, "fall" should read -- of falling --; and
Line 60, "CHF3" should read -- $CHF_3$ --.

Column 33,
Line 26, "L0" should read -- LO --.

Column 39,
Line 9, "FIG.22t" should read -- FIG.22B --.

Column 42,
Line 16, "in was" should read -- was --.

Column 46,
Line 35, "e" should be deleted.

Column 48,
Line 37, "electrodes;" should read -- electrodes, --.

UNITED STATES PATENT AND TRADEMARK OFFICE

CERTIFICATE OF CORRECTION

PATENT NO. : 6,288,494 B1
DATED : September 11, 2001
INVENTOR(S) : Takeo Tsukamoto et al.

It is certified that error appears in the above-identified patent and that said Letters Patent is hereby corrected as shown below:

Column 50,
Line 8, "electrodes;" should read -- electrodes, --.

Signed and Sealed this

Ninth Day of April, 2002

*Attest:*

*Attesting Officer*

JAMES E. ROGAN
*Director of the United States Patent and Trademark Office*